US012590740B2

(12) United States Patent
Moon et al.

(10) Patent No.: US 12,590,740 B2
(45) Date of Patent: Mar. 31, 2026

(54) TURBO COMPRESSOR AND REFRIGERATION CYCLE DEVICE HAVING TURBO COMPRESSOR

(71) Applicant: LG ELECTRONICS INC., Seoul (KR)

(72) Inventors: Changgook Moon, Seoul (KR); Junchul Oh, Seoul (KR); Hyojo Bae, Seoul (KR); Seheon Choi, Seoul (KR); Kyungmin Kim, Seoul (KR); Jinhyeok Mun, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 557 days.

(21) Appl. No.: 18/013,230

(22) PCT Filed: Jul. 1, 2021

(86) PCT No.: PCT/KR2021/008372
§ 371 (c)(1),
(2) Date: Dec. 27, 2022

(87) PCT Pub. No.: WO2022/260208
PCT Pub. Date: Dec. 15, 2022

(65) Prior Publication Data

US 2023/0304706 A1 Sep. 28, 2023

(30) Foreign Application Priority Data

Jun. 9, 2021 (KR) ..... 10-2021-0075066

(51) Int. Cl.
*F25B 31/00* (2006.01)
*F04D 25/06* (2006.01)
(Continued)

(52) U.S. Cl.
CPC ..... *F25B 31/006* (2013.01); *F04D 25/06* (2013.01); *F04D 29/4206* (2013.01);
(Continued)

(58) Field of Classification Search
CPC ..... F04D 17/125; F04D 17/122; F04D 17/12; F04D 25/062; F04D 25/082;
(Continued)

(56) References Cited

U.S. PATENT DOCUMENTS 5,857,348 A 1/1999 Conry
6,729,858 B2 * 5/2004 Choi ..... F04D 17/122 417/372
(Continued)

FOREIGN PATENT DOCUMENTS

JP 11-13686 1/1999
JP 2009-270797 11/2009
(Continued)

OTHER PUBLICATIONS

Korean Notice of Allowance issued in Application No. 10-2020-0036479 dated Feb. 20, 2025.
(Continued)

*Primary Examiner* — Thomas Fink
(74) *Attorney, Agent, or Firm* — KED & ASSOCIATES

(57) ABSTRACT

A turbo compressor and a refrigeration cycle device having a turbo compressor are provided. The turbo compressor includes a housing having a motor chamber; a drive motor having a stator and a rotor in the motor chamber of the housing; a first compression portion and a second compression portion, respectively, provided on opposite ends of a rotary shaft; a connecting passage that connects an exit of the first compression portion and an entrance of the second compression portion; an inlet passage that penetrates a first side of the housing to communicate with an inside of the
(Continued)

motor chamber and guide a refrigeration fluid to the motor chamber; and an outlet passage that penetrates a second side of the housing to communicate with the inside of the motor chamber and guide the refrigeration fluid in the motor chamber out of the housing. Thus, a gas foil bearing provided in the motor chamber may be quickly actuated by supplying the refrigeration fluid to the motor chamber, and at a same time, heat generated from the motor chamber may be quickly dissipated even in a high-speed operation, thereby improving efficiency of the turbo compressor and a refrigeration cycle device having a turbo compressor.

26 Claims, 22 Drawing Sheets

(51) Int. Cl.

| | |
|---|---|
| ***F04D 29/42*** | (2006.01) |
| ***F25B 31/02*** | (2006.01) |
| *F04D 17/12* | (2006.01) |
| *F04D 29/057* | (2006.01) |

(52) U.S. Cl.
CPC ..... *F25B 31/026* (2013.01); *F04D 17/125* (2013.01); *F04D 29/057* (2013.01)

(58) Field of Classification Search
CPC ..... F04D 29/0513; F04D 29/057; F04D 29/5806; F16C 32/0692; F16C 32/0655; F16C 32/0603; F16C 32/0607; F16C 32/0614; F25B 31/006; F25B 31/026
See application file for complete search history.

(56) References Cited

U.S. PATENT DOCUMENTS

| | | | | |
|---|---|---|---|---|
| 8,931,304 | B2 | 1/2015 | Beers et al. | |
| 10,808,723 | B2 | 10/2020 | Nagao et al. | |
| 2014/0341710 | A1 | 11/2014 | Creamer | |
| 2018/0094626 | A1 | 4/2018 | Kobayashi et al. | |
| 2019/0271325 | A1* | 9/2019 | Masuda | F04D 29/041 |
| 2020/0232479 | A1* | 7/2020 | Nagao | F04D 29/056 |
| 2020/0291987 | A1* | 9/2020 | Moon | F16C 17/042 |
| 2021/0215171 | A1 | 7/2021 | Fujita et al. | |

FOREIGN PATENT DOCUMENTS

| | | |
|---|---|---|
| JP | 2015-183568 | 10/2015 |
| JP | 6175211 | 8/2017 |
| JP | 6552851 | 7/2019 |
| KR | 10-2000-0065627 | 11/2000 |
| KR | 10-2003-0015692 | 2/2003 |
| KR | 10-2003-0041574 | 5/2003 |
| KR | 10-2006-0080751 | 7/2006 |
| KR | 10-1070892 | 10/2011 |
| KR | 10-2017-0047450 | 5/2017 |
| KR | 10-2019-0002972 | 1/2019 |
| WO | WO 2018/154674 | 8/2018 |
| WO | WO 2020/100251 | 5/2020 |

OTHER PUBLICATIONS

International Search Report dated Feb. 25, 2022 issued in Application No. PCT/KR2021/008372.
Korean Office Action dated Dec. 13, 2022 issued in KR Application No. 10-2021-0075066.
German Office Action issued in Application No. 11 2021 002 623.2 dated Nov. 13, 2025.

* cited by examiner

TURBO COMPRESSOR AND REFRIGERATION CYCLE DEVICE HAVING TURBO COMPRESSOR

CROSS-REFERENCE TO RELATED APPLICATIONS

This application is the National Stage filing under 35 U.S.C. 371 of International Application No. PCT/KR2021/008372, filed on Jul. 1, 2021, which claims the benefit of the earlier filing date of and rights of priority to Korean Application 10-2021-0075066 filed on Jun. 9, 2021, the contents of which are all hereby incorporated by reference herein in their entirety.

BACKGROUND

1. Field

A turbo compressor and a refrigeration cycle device having a turbo compressor are disclosed herein.

2. Background

Generally, compressors are largely divided into positive displacement compressors and turbo compressors. A positive displacement compressor is a system that draws in, compresses, and discharges a fluid using a piston or a vane, as in a reciprocating or rotary compressor. On the other hand, a turbo compressor is a system that draws in, compresses, and discharges a fluid using a rotational element.

The positive displacement compressor determines a compression ratio by properly adjusting a ratio between intake volume and discharge volume, in order to obtain a desired discharge pressure. Accordingly, the positive displacement compressor has constraints in making the overall size of the compressor smaller in comparison to capacity.

The turbo compressor is similar to a turbo blower, but has a higher discharge pressure and a lower flow rate than the turbo blower. The turbo compressor increases the pressure on a continuously flowing fluid, and may be classified as an axial compressor when the fluid flows in an axial direction or a centrifugal compressor when the fluid flows in a radial direction.

Unlike positive displacement compressors, such as reciprocating compressors or rotary compressors, it is difficult to obtain a high pressure ratio as desired by compressing a fluid only once, due to various factors, such as processability, mass productivity, and durability, even if a shape of blades of a rotating impeller is optimally designed. In this regard, there is a well-known multi-stage turbo compressor which has a plurality of impellers in the axial direction and compresses a fluid in multiple stages.

The multi-stage turbo compressor compresses a fluid in multiple stages using a plurality of impellers mounted to a rotary shaft on one side of a rotor or by a plurality of impellers mounted to face each other on both ends of the rotary shaft. For convenience of explanation, the former may be classified as one side-type, and the latter may be classified as both end-type.

The one side-type turbo compressor may prevent a decrease in compression efficiency by shortening a pipeline or fluid passage connecting a plurality of impellers. However, in the case of the one side-type turbo compressor, the impellers on both sides may generate thrust in the same direction, and accordingly, axial turbulence increases, which may increase a size of a thrust bearing and making an overall size of the compressor too large. Also, as the load on a drive unit during high-speed operation increases, the drive unit may be overheated.

In the case of the both end-type turbo compressor, the impellers on both sides may generate thrust in opposite directions, and accordingly, axial turbulence may be prevented to a certain extent, which may decrease the size of the thrust bearing and enhancing motor efficiency. However, the both end-type turbo compressor requires a complicated and long pipeline or fluid passage to connect a plurality of impellers, which makes the compressor structure complicated and causes pressure loss in a process in which a fluid compressed by the impeller on one side moves to the impeller on the other side through a long flow path, thereby lowering compression efficiency.

U.S. Pat. No. 5,857,348 filed on Jan. 12, 1999 (hereinafter "Patent Document 1") discloses an example of a both-end type turbo compressor. The both-end type turbo compressor disclosed in Patent Document 1 has a first impeller constituting a single-stage compression part (hereinafter, "first compression part") on one side of a rotary shaft and a second impeller constituting a two-stage compression part (hereinafter, "second compression part") on the other side of the rotary shaft, with an outlet of the first compression part and an inlet of the second compression part being connected by a communicating pipe.

The above both-end type turbo compressor has a radial bearing and an axial bearing on both ends or one end of the rotary shaft with respect to a drive unit. It is advantageous for a typical turbo compressor including the both-end type turbo compressor to quickly release motor heat generated from the drive unit by high-speed (for example, 40,000 rpm or above) rotation and frictional heat from a bearing supporting the rotary shaft, in terms of compression efficiency.

U.S. Pat. No. 8,931,304 filed on Jan. 13, 2015 (hereinafter Patent Document 2") discloses a both-end type turbo compressor. In the both-end type turbo compressor disclosed in Patent Document 2, a refrigerant flow path is disclosed in which a refrigerant compressed in a single stage in the first compression part is directed into a motor chamber, and a drive motor and a bearing are cooled using the refrigerant compressed in a single stage and directed into the motor chamber and then drawn into the second compression part.

A turbo compressor having the above refrigerant flow path has a limitation in effectively cooling motor heat and frictional heat as a high-temperature refrigerant compressed in a single stage passes through the drive motor and the bearing. Also, the refrigerant, which is preheated as it passes through the motor chamber, is drawn into the second compression part, thus causing a volume loss due to an increase in specific volume of the refrigerant and leading to a decrease in compression efficiency.

Moreover, foil bearings are used in turbo compressors because they are suitable for the turbo compressors which rotate at high speed as stated above. Korean Unexamined Patent Application Publication No. 10-2004-0044115 published on Jun. 15, 2004 (hereinafter "Patent Document 3")) discloses an example of an air foil bearing. The air foil bearing disclosed in Patent Document 3 has an air intake port on a sleeve supporting a plurality of air foils to supply air into gaps between a rotary shaft and the air foils.

The above air foil bearing (or gas foil bearing) is formed such that the air intake port radially overlaps the air foil bearings, and the air supplied through the air intake port may therefore come into direct contact with some of the plurality of air foils (for example, bump foils). This may cause a variation in bearing height between the air foils making direct contact with air and the air foils making indirect contact with air, leading to a change in pressure field between the rotary shaft and the bearing and making the rotation of the rotary shaft unstable.

Embodiments disclosed herein provide a turbo compressor capable of quickly releasing heat generated from a motor housing, and a refrigeration cycle device having a turbo compressor. Further, embodiments disclosed herein are directed to providing a turbo compressor capable of quickly releasing heat generated from a motor housing by supplying a refrigerant passed through a condenser directly into the motor housing, and a refrigeration cycle device having the same.

Furthermore, embodiments disclosed herein are directed to providing a turbo compressor capable of improving the effect of cooling a motor housing by supplying a refrigerant passed through a condenser directly into the motor housing and circulating it uniformly throughout the inside of the motor housing, and a refrigeration cycle device having a turbo compressor.

Embodiments disclosed herein provide a turbo compressor capable of stably supporting a rotary shaft that rotates at high speed using a gas foil bearing, and a refrigeration cycle device having a turbo compressor. Further, embodiments disclosed herein are directed to providing a turbo compressor that uses a gas foil bearing, capable of increasing rotational stability of a rotary shaft by keeping a bearing height of the gas foil bearing facing the rotary shaft constant, and a refrigeration cycle device having a turbo compressor. Furthermore, embodiments disclosed herein are directed to providing a turbo compressor that uses a gas foil bearing, capable of keeping the bearing height of the gas foil bearing constant by supplying a refrigerant as a working fluid at a uniform pressure along a circumference of the foil bearing, and a refrigeration cycle device having a turbo compressor.

Embodiments disclosed herein provide a turbo compressor capable of maximizing compressor performance based on load. Further, embodiments disclosed herein are directed to providing a turbo compressor that supplies refrigerant to a motor housing, capable of performing a load follow operation using a refrigerant passed through the motor housing, and a refrigeration cycle device having a turbo compressor. Furthermore, embodiments disclosed herein are directed to providing a turbo compressor capable of selectively supplying a refrigerant passed through a motor housing toward a first compression part or a second compression part, and a refrigeration cycle device having the same.

Embodiments disclosed herein provide a turbo compressor including a housing having a motor chamber; a drive motor having a stator and a rotor in the motor chamber of the housing; a first compression part and a second compression part respectively provided on opposite ends of the rotary shaft; a connecting passage portion connecting an exit of the first compression part and an entrance of the second compression part; an inlet passage portion penetrating one side of the housing to communicate with an inside of the motor chamber and guide a refrigeration fluid to the motor chamber; and an outlet passage portion penetrating the other side of the housing to communicate with the inside of the motor chamber and guide the refrigeration fluid in the motor chamber out of the housing. Thus, a gas foil bearing provided in the motor chamber may be quickly actuated by supplying a refrigeration fluid to the motor chamber, and at the same time, heat generated from the motor chamber may be quickly dissipated even in a high-speed operation, thereby improving efficiency of the turbo compressor and the refrigeration cycle device having the same.

For example, the motor chamber may include a first chamber provided on one (first) axial side with respect to the drive motor and a second chamber provided on the other (second) axial side, wherein an axial bearing is provided in the first chamber to support with respect to an axial direction of the rotary shaft, and the inlet passage portion communicates with the first chamber. Thus, the axial bearing may be quickly and uniformly actuated, and at the same time, the axial bearing and the rotary shaft may be quickly cooled.

More specifically, the axial bearing may be provided between an actuating support portion extending radially from the rotary shaft and a plurality of fixing support portions fixed to the housing and facing opposite axial sides of the actuating support portion, and at least a part or portion of the inlet passage portion may radially overlap some of the plurality of fixing support portions that are positioned between the actuating support portion and the first compression part. Thus, the refrigeration fluid may be quickly and uniformly supplied to the axial bearing, thereby quickly and uniformly securing bearing force and quickly cooling the axial bearing.

For another example, the motor chamber may include a first chamber provided on one (first) axial side with respect to the drive motor and facing the first compression part and a second chamber provided on the other (second) axial side and facing the second compression part, wherein the first chamber and the second chamber communicate with each other, and the outlet passage portion communicates with the second chamber. Thus, the refrigeration fluid, after cooling the axial bearing, may pass through the drive motor and be released, thereby cooling the entire motor chamber.

More specifically, the inlet passage portion may include: a first inlet passage portion communicating with the first chamber; and a second inlet passage portion communicating with the second chamber, wherein an axial support portion is provided in the first chamber to support with respect to an axial direction of the rotary shaft, and a refrigerant intake passage is formed in the axial support portion to allow the first inlet passage portion to communicate with the first chamber. Thus, the refrigerant introduced into the first chamber may be guided to a desired position, and at the same time, the refrigerant may pass through a member constituting the axial bearing, thereby quickly cooling the axial bearing.

For another example, an axial support portion may be provided in the motor chamber to support with respect to an axial direction of the rotary shaft, the axial support portion including a thrust runner radially extending from the rotary shaft; a first partition wall fixed to the housing and positioned between the thrust runner and the first compression part; and a second partition wall axially spaced apart from the first partition wall and fixed to the housing, that axially overlaps the thrust runner and is positioned between the thrust runner and the drive motor, wherein a refrigerant intake passage constituting the inlet passage portion is provided in the first partition wall, and an end of the refrigerant intake passage is open to a side of the first partition wall facing the thrust runner. Thus, a refrigerant constituting the refrigeration fluid may be quickly supplied to the axial bearing.

More specifically, an axial bearing may be provided between one (first) side of the thrust runner and the first partition wall and between the other (second) side of the thrust runner and the second partition wall, wherein the end of the refrigerant intake passage is positioned radially farther away from the rotary shaft than the axial bearing. Thus, when a refrigerant is supplied, the refrigerant is prevented from coming into direct contact with the axial bearing, and therefore the axial bearing may have uniform bearing force. Moreover, even if there is one refrigerant intake passage, the refrigerant may be uniformly supplied to a space where the axial bearing is installed.

Moreover, an axial bearing may be provided between one side of the thrust runner and the first partition wall and between the other side of the thrust runner and the second partition wall, wherein the end of the refrigerant intake passage is positioned radially closer to the rotary shaft than the axial bearing is. Thus, when a refrigerant is supplied, the refrigerant is prevented from coming into direct contact with the axial bearing, and therefore the axial bearing may have uniform bearing force. Moreover, a mass flow of refrigerant in a gap where the axial bearing is provided may be increased, thereby securing a bearing force more quickly and improving a cooling effect. This is particularly more advantageous when there is a plurality of refrigerant intake passages.

More specifically, the refrigerant intake passage may include a first intake passage open to a second side of the first partition wall, which is one of opposite axial sides thereof and faces the thrust runner; and a second intake passage open to a first side or inner circumferential surface of the first partition wall, which is one of the opposite axial sides thereof and is the opposite side of the second side. Thus, refrigerant may be quickly and uniformly supplied to a radial bearing as well as to the axial bearing.

Moreover, a refrigerant passage may be formed to radially penetrate the rotary shaft. Thus, refrigerant may move quickly over a wide area in a gap where the axial bearing is installed, thereby securing uniform bearing force and improving a cooling effect.

More specifically, the refrigerant passage may radially penetrate at least one of opposite axial sides, with the thrust runner interposed in between, and a cross-sectional area of the refrigerant passage may be larger than or equal to the distance between either side of the thrust runner and a partition wall facing the same. Thus, refrigerant may be smoothly introduced into a gap provided on opposite axial sides of the thrust runner, thereby securing more uniform bearing force and improving a cooling effect.

Further, the refrigerant passage may include a first refrigerant passage radially penetrating one (first) axial side and a second refrigerant passage radially penetrating the other (second) axial side, with the thrust runner interposed in between, wherein the first refrigerant passage and the second refrigerant passage communicate with each other by a third refrigerant passage which extends axially. Thus, refrigerant may move smoothly between gaps provided on opposite axial sides of the thrust runner, thereby securing more uniform bearing force and improving a cooling effect.

Additionally, a fourth refrigerant passage may be formed to radially penetrate the thrust runner. Thus, the thrust runner may be cooled more effectively.

Further, a first refrigerant passage or a second refrigerant passage may radially penetrate at least one of opposite axial sides, with the thrust runner interposed in between, wherein the fourth refrigerant passage communicates with the first refrigerant passage or/and the second refrigerant passage by a third refrigerant passage which axially extends. Thus, refrigerant may move more smoothly in a bearing receiving space where the axial bearing is provided, thereby securing more uniform bearing force and improving a cooling effect.

For another example, an axial support portion may be provided in the motor chamber to support with respect to an axial direction of the rotary shaft, the axial support portion including a thrust runner radially extending from the rotary shaft; a first bearing shell fixed to the housing and positioned between the thrust runner and the first compression part; and a second bearing shell axially spaced apart from the first bearing shell and fixed to the housing, that axially overlaps the thrust runner and is positioned between the thrust runner and the drive motor, wherein the first bearing shell includes an inner wall portion with a first shaft hole into which one end of the rotary shaft is rotatably inserted; a first side wall portion formed in the shape of a ring which radially extends from one (first) side of the outer circumferential surface of the inner wall portion; a second side wall portion formed in the shape of a ring which radially extends from the other (second) side of the outer circumferential surface of the inner wall portion; and a refrigerant receiving portion provided between the first side wall portion and the second side wall portion, with an inner peripheral side facing the rotary shaft and being blocked by the inner wall portion, and an outer peripheral side facing the inner circumferential surface of the housing and being at least partially open, wherein the inlet passage portion radially overlaps the refrigerant receiving portion. Thus, refrigerant may be spread through the refrigerant receiving portion of the first bearing shell, thereby quickly cooling the first bearing shell. Besides, it is easy to form a plurality of refrigerant passages, thereby reducing manufacturing costs and the cooling effects.

More specifically, a first radial bearing may be provided between the first shaft hole of the inner wall portion and the outer circumferential surface of the rotary shaft, and a refrigerant passage may be formed through at least either the inner wall portion or the first side wall portion to allow the refrigerant receiving portion to communicate with the motor chamber, wherein the refrigerant passage is open toward the motor chamber, in a position axially closer to the first compression part than the first radial bearing is. Thus, the height of the exit of the refrigerant passage may be reduced, and therefore the mass flow of refrigerant may be increased, thereby improving a bearing force and increasing a cooling effect.

Further, a first discharge sealing portion may be formed on an outer surface of the first side wall portion axially facing the first compression part, for sealing a gap between the first compression part and the first side wall portion, wherein the refrigerant passage is open so as to communicate with the motor chamber, in a position closer to the rotary shaft than the first discharge sealing portion is. Thus, the refrigerant passage may be positioned between the first discharge sealing portion and the first radial bearing, thereby smoothly supplying refrigerant to the first radial bearing.

Furthermore, a plurality of refrigerant passages may be formed at preset or predetermined intervals along a radius, and a passage cover may be provided on the outer surface of the first side wall portion axially facing the first compression part, for allowing open ends of the plurality of refrigerant passages to communicate with each other, wherein a passage connecting groove is formed on one side surface of the passage cover facing the first side wall portion to radially extend, for allowing the plurality of refrigerant passages to communicate with each other, and the passage connecting groove communicates with a shaft hole of the inner wall portion. Thus, large amounts of refrigerant may be supplied to the front of the first radial bearing, thereby increasing the bearing force of the first radial bearing provided in the first bearing shell and also increasing the cooling effect.

Furthermore, a first discharge sealing portion may be formed on the other side of the passage cover facing the first compression part, for sealing a gap between the first compression part and the first side wall portion. Thus, refrigerant is prevented from leaking to the motor chamber from the first compression part, thereby increasing compression efficiency and a bearing force of the bearing provided in the motor chamber and quickly cooling the bearing and the rotary shaft.

Moreover, a first axial bearing may be provided between the second side wall portion and the thrust runner, and a refrigerant passage may be formed through at least either the inner wall portion or the second side wall portion to allow the refrigerant receiving portion to communicate with the motor chamber, wherein the refrigerant passage is open, in a position radially closer to the outer circumferential surface of the rotary shaft than the first axial bearing is. Thus, a mass flow of refrigerant supplied to the first axial bearing may be increased, thereby increasing a bearing force of the first axial bearing and a cooling effect.

Additionally, a first intake passage may penetrate at least either the inner wall portion or the second side wall portion to allow the refrigerant receiving portion to communicate with the motor chamber, and a second intake passage may penetrate at least either the inner wall portion or the first side wall portion to allow the refrigerant receiving portion to communicate with the motor chamber. Thus, a refrigerant serving as a working fluid may be provided on one axial side of the first radial bearing, thereby increasing a bearing force of the first radial bearing and a cooling effect.

For another example, the turbo compressor may further include a second bearing shell fixed to the housing and positioned between the drive motor and the second compression part, wherein the second bearing shell has a second shaft hole into which the other end of the rotary shaft is rotatably inserted, and a refrigerant passage penetrating through the second shaft hole on a side of the second bearing shell facing the motor chamber. Thus, even if the gap between the second compression part and the second radial bearing is sealed, a refrigerant serving as a working fluid may be smoothly provided, thereby increasing a bearing force of the first radial bearing and a cooling effect.

For another example, the motor chamber may be divided into a first chamber and a second chamber on opposite axial sides, with the drive motor interposed in between, and the inlet passage portion may include: a first inlet passage portion communicating with the first chamber; and a second inlet passage portion communicating with the second chamber, wherein the first inlet passage portion and the second inlet passage portion communicate with the motor chamber on the same axial line. Thus, the first inlet passage portion and the second inlet passage portion may be easily connected to the housing, and at the same time, refrigerant may circulate over a great length in the motor chamber, thereby increasing a cooling effect of the motor chamber.

Further, the outlet passage portion may be positioned farthest away from the first inlet passage portion or the second inlet passage portion in a circumferential direction. Thus, refrigerant may circulate over a great length for a lengthy period of time in the motor chamber, thereby increasing a cooling effect.

Furthermore, the inner diameter of the first inlet passage portion may be larger than or equal to the inner diameter of the second inlet passage portion. Thus, more refrigerant may be supplied to the first chamber, and therefore the bearing provided in the first chamber may be more quickly actuated and quickly cooled.

For another example, the motor chamber may be divided into a first chamber and a second chamber on opposite axial sides, with the drive motor interposed in between, wherein an axial support portion is provided in the first chamber to support with respect to an axial direction of the rotary shaft, and the outlet passage portion communicates with the second chamber. Thus, a refrigerant introduced into the first chamber may circulate through the first chamber, thereby increasing the bearing force of the bearing provided in the first chamber and at the same time increasing the effect of cooling the bearing provided in the first chamber and the rotary shaft.

Further, the outlet passage portion may include a first connecting passage having one (first) end communicating with the second chamber, and another (second) end communicating with the connecting passage portion; a second connecting passage having one (first) end communicating with the connecting passage portion, and another (second) end communicating with an entrance of the first compression part; and a refrigerant control valve for controlling the flow of a refrigerant passed through the motor chamber to be directed toward the first connecting passage or the second connecting passage. Thus, a refrigerant passed through the motor chamber may be properly guided to the first compression part or the second compression part according to an operation mode of the compressor, thereby maximizing compression efficiency.

Furthermore, the refrigerant control valve may further include a valve control portion for controlling opening/closing directions according to preset or predetermined conditions, wherein the valve control portion allows the second chamber to communicate with the entrance of the second compression part under a high-load condition, and allows the second chamber to communicate with the entrance of the first compression part under a low-load condition. Thus, the enthalpy of refrigerant supplied to the second compression part may be lowered under the high-load condition to increase compression efficiency, whereas a temperature of refrigerant supplied to the first compression part may be raised under a low-load condition to lower a cooling force.

Embodiments disclosed herein further provide a refrigeration cycle device including a compressor; a condenser connected to a discharge side of the compressor; an expander connected to an exit of the condenser; and an evaporator having an entrance connected to an exit of the expander, and an exit connected to an intake side of the compressor, wherein the compressor includes the above-described turbo compressor. Thus, the turbo compressor may quickly and uniformly secure bearing force for each bearing by using a gas foil bearing, thereby stably supporting the rotary shaft. At the same time, the turbo compressor may perform a load-dependent operation properly according to an operating condition of the refrigeration cycle device, thereby improving efficiency of the refrigeration cycle device including the turbo compressor.

More specifically, the inlet passage portion may be connected between the exit of the condenser and an entrance of the expander. Thus, the refrigerant of the refrigeration cycle device may be used, and the turbo compressor and the refrigeration cycle device having the same may be operated effectively and cooled.

A turbo compressor and a refrigeration cycle device having the same according to embodiments disclosed herein may include an inlet passage portion penetrating one (first) side of the housing to communicate with an inside of the motor chamber and guide a refrigeration fluid to the motor chamber; and an outlet passage portion penetrating the other (second) side of the housing to communicate with the inside of the motor chamber and guide the refrigeration fluid in the motor chamber out of the housing. Thus, a gas foil bearing provided in the motor chamber may be quickly actuated by supplying a refrigeration fluid to the motor chamber, and at the same time, heat generated from the motor chamber may be quickly dissipated even in a high-speed operation, thereby improving efficiency of the turbo compressor and the refrigeration cycle device having the same.

Moreover, the motor chamber may be divided into a first chamber and a second chamber with respect to a drive motor, and the first chamber may have an axial bearing and communicate with the inlet passage portion. Thus, the axial bearing may be quickly and uniformly actuated, and at the same time, the axial bearing and the rotary shaft may be quickly cooled.

Additionally, at least a part or portion of the inlet passage portion may radially overlap a fixing support portion positioned between an actuating support portion and a first compression part. Thus, the refrigeration fluid may be quickly and uniformly supplied to the axial bearing, thereby quickly and uniformly securing bearing force and quickly cooling the axial bearing.

Further, the motor chamber may include a first chamber facing the first compression part and a second chamber facing the second compression part, wherein the outlet passage portion communicates with the second chamber. Thus, the refrigeration fluid, after cooling the axial bearing, may pass through the drive motor and be released, thereby cooling the entire motor chamber.

Further, a refrigerant intake passage constituting the inlet passage portion may be provided in a first partition wall facing a thrust runner, and an end of the refrigerant intake passage may be open to a side of the first partition wall. Thus, a refrigerant constituting the refrigeration fluid may be quickly supplied to the axial bearing.

Furthermore, the end of the refrigerant intake passage may be positioned radially farther away from the rotary shaft than the axial bearing is. Thus, when a refrigerant is supplied, the refrigerant is prevented from coming into direct contact with the axial bearing, and therefore the axial bearing may have a uniform bearing force. Moreover, even if there is one refrigerant intake passage, the refrigerant may be uniformly supplied to a space where the axial bearing is installed.

Also, the end of the refrigerant intake passage may be positioned radially closer to the rotary shaft than the axial bearing is. Thus, when a refrigerant is supplied, the refrigerant is prevented from coming into direct contact with the axial bearing, and therefore the axial bearing may have uniform bearing force. Moreover, the mass flow of refrigerant in a gap where the axial bearing is provided may be increased, thereby securing bearing force more quickly and improving the cooling effect. This is particularly more advantageous when there is a plurality of refrigerant intake passages.

A first intake passage of the refrigerant intake passage may be open to a second side of the first partition wall facing the thrust runner, and a second intake passage of the refrigerant intake passage may be open to a first side or inner circumferential surface of the first partition wall. Thus, refrigerant may be quickly and uniformly supplied to a radial bearing as well as to the axial bearing.

A refrigerant passage may be formed to radially or axially penetrate the rotary shaft including the thrust runner. Thus, refrigerant may move quickly over a wide area in a gap where the axial bearing is installed, thereby securing uniform bearing force and improving the cooling effect.

A refrigerant receiving portion constituting a first bearing shell may be provided between a first side wall portion and a second side wall portion, with an inner peripheral side of the refrigerant receiving portion being blocked by the inner wall portion, and an outer peripheral side being open, wherein the inlet passage portion guiding refrigerant to the first chamber radially overlaps the refrigerant receiving portion. Thus, refrigerant may be spread through the refrigerant receiving portion of the first bearing shell, thereby quickly cooling the first bearing shell. Besides, it is easy to form a plurality of refrigerant passages, thereby reducing the manufacturing costs and the cooling effects.

Further, a refrigerant passage may be formed through at least either the inner wall portion or the first side wall portion to allow the refrigerant receiving portion to communicate with the motor chamber, wherein the refrigerant passage is formed closer to the first compression part than the first radial bearing is. Thus, a height of the exit of the refrigerant passage may be reduced, and therefore a mass flow of refrigerant may be increased, thereby improving the bearing force and increasing the cooling effect.

A refrigerant passage may be formed through at least either of the inner wall portion and the second side wall portion which constitute the first bearing shell to allow the refrigerant receiving portion to communicate with the motor chamber, wherein the refrigerant passage is formed in a position radially closer to the outer circumferential surface of the rotary shaft than the first axial bearing is. Thus, the mass flow of refrigerant supplied to the first axial bearing may be increased, thereby increasing the bearing force of the first axial bearing and the cooling effect.

Further, a refrigerant passage may penetrate through the second shaft hole on a side of the second bearing shell. Thus, even if the gap between the second compression part and the second radial bearing is sealed, a refrigerant serving as a working fluid may be smoothly provided, thereby increasing the bearing force of the first radial bearing and the cooling effect.

Furthermore, the first inlet passage portion and the second inlet passage portion may communicate with the motor chamber on the same axial line, and the outlet passage portion may be positioned farthest away from the first inlet passage portion or the second inlet passage portion in a circumferential direction. Thus, refrigerant may circulate over a great length for a lengthy period of time in the motor chamber, thereby increasing the cooling effect.

A refrigerant control valve may be provided between a first connecting passage and a second connecting passage, and a refrigerant passed through the motor chamber may be directed selectively to an intake side of the second compression part or an intake side of the first compression part. Thus, a refrigerant passed through the motor chamber may be properly guided to the first compression part or the second compression part according to the operation mode of the compressor, thereby maximizing the compression efficiency.

In a turbo compressor and a refrigeration cycle device having a turbo compressor according to embodiments disclosed herein, the compressor may include the above-described compressor. Thus, the turbo compressor may quickly and uniformly secure bearing force for each bearing by using a gas foil bearing, thereby stably supporting the rotary shaft. At the same time, the turbo compressor may perform a load-dependent operation properly according to an operating condition of the refrigeration cycle device, thereby improving the efficiency of the refrigeration cycle device including the turbo compressor.

DETAILED DESCRIPTION

Hereinafter, a turbo compressor according to embodiments and a refrigeration cycle apparatus having a turbo compressor will be described with reference to the accompanying drawings. The embodiments will be described, for example, with respect to a turbo compressor which is both one side-type and both end-type, in which a first impeller and a second impeller are mounted to both ends of a rotary shaft, and an outlet of a first compression part including the first impeller connects to an inlet of a second compression part, but is not necessarily limited to this. For example, an inlet passage portion described hereinafter may be equally applied to a single-sided turbo compressor having at least one impeller on one end of a rotary shaft.

Moreover, a turbo compressor according to an embodiment will be described with respect to an example that applies to a chiller system that supplies chilled water to where it is needed, but its applicability is not limited to the chiller system. For example, a turbo compressor according to an embodiment is equally applicable to a refrigeration cycle system using refrigerant.

In addition, in the description of a turbo compressor according to an embodiment, a lengthwise direction of a rotary shaft is defined as an axial direction, a thickness direction of the rotary shaft is defined as a radial direction, an intake side of each impeller (or compression part) on an axial line is defined as a front, a discharge side of each impeller is defined as a rear, and a front side is defined as a first side, and a rear side is defined as a second side.

Figure 1:
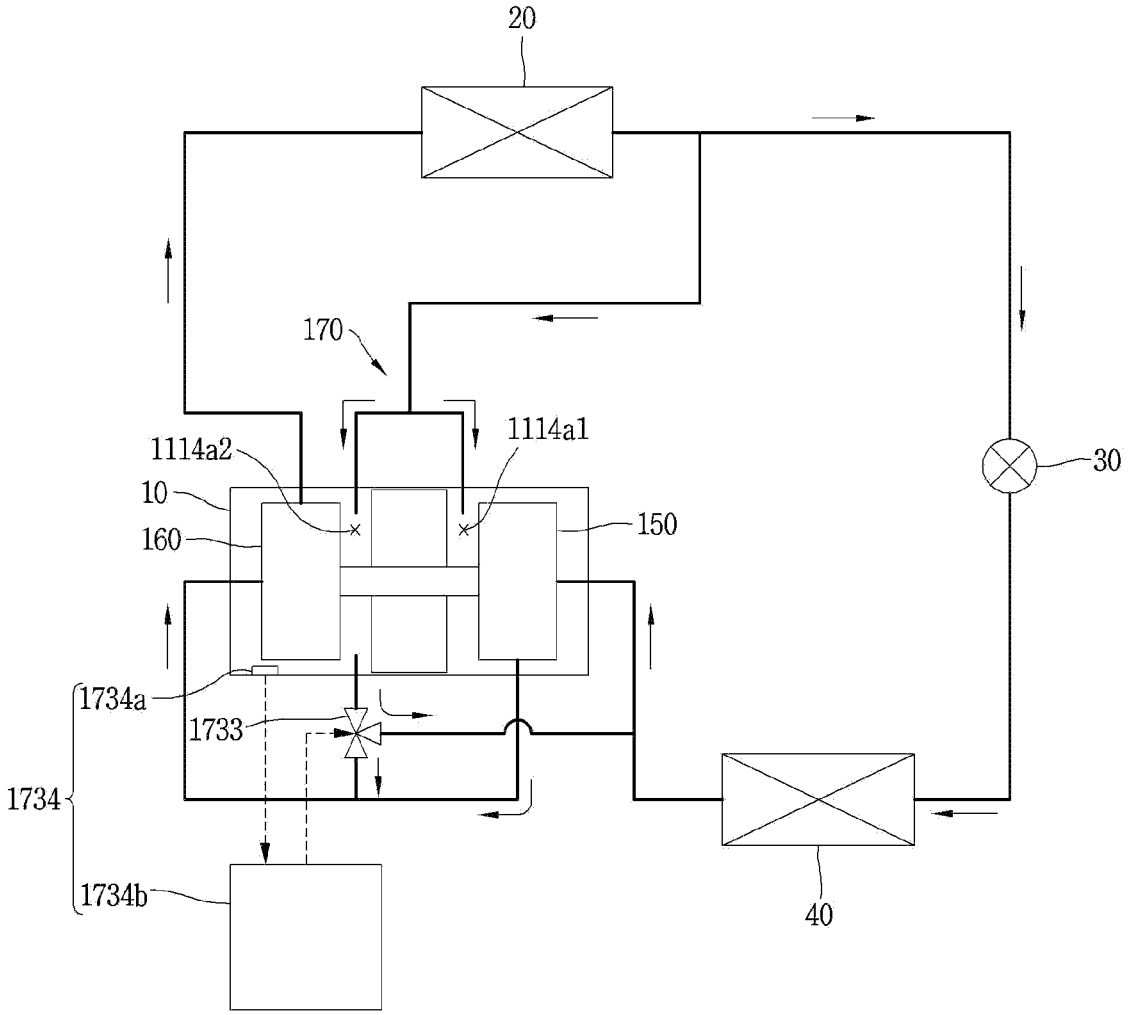
FIG. 1 is a system diagram of a refrigeration cycle including a turbo compressor according to an embodiment.

FIG. 1 is a system diagram of a refrigeration cycle including a turbo compressor according to an embodiment. Referring to FIG. 1, a refrigeration cycle apparatus to which a turbo compressor according to an embodiment is applied is configured in such a way that a compressor 10, a condenser 20, an expander 30, and an evaporator 40 constitute a closed loop. That is, the condenser 20, the expander 30, and the evaporator 40 are sequentially connected to a discharge side of the compressor 10, and an outlet of the evaporator 40 is connected to an intake side of the compressor 10. Thus, a sequence of processes is repeated, in which a refrigerant compressed in the compressor 10 is discharged toward the condenser 20, and this refrigerant passes through the expander 30 and the evaporator 40 sequentially and is then drawn back into the compressor 10.

Figure 2:
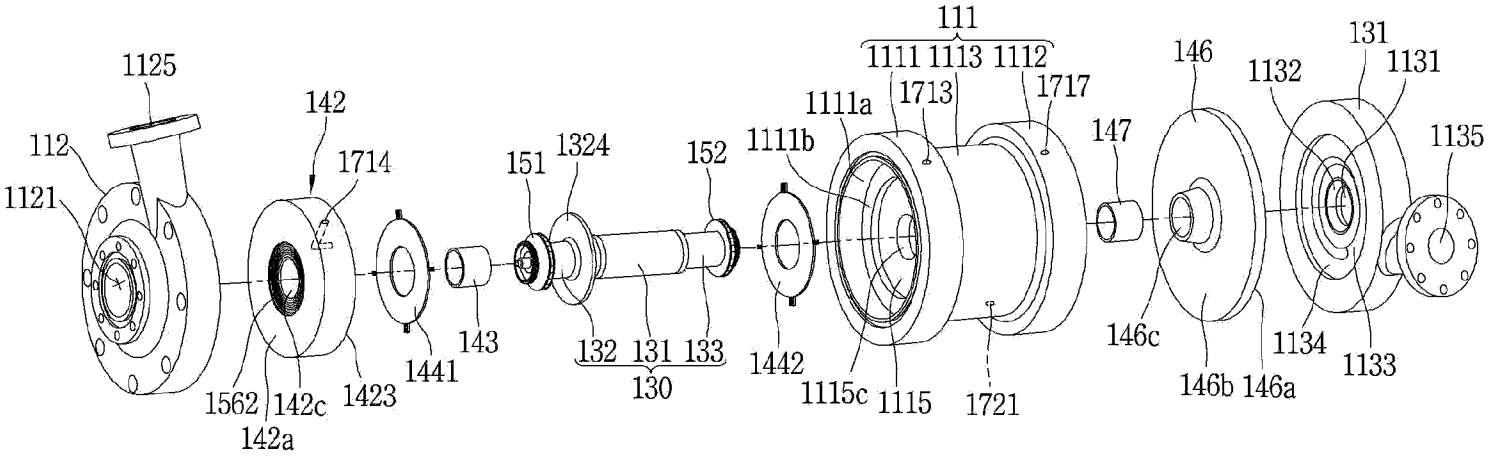
FIG. 2 is an exploded perspective view of a turbo compressor according to an embodiment.
Figure 3:
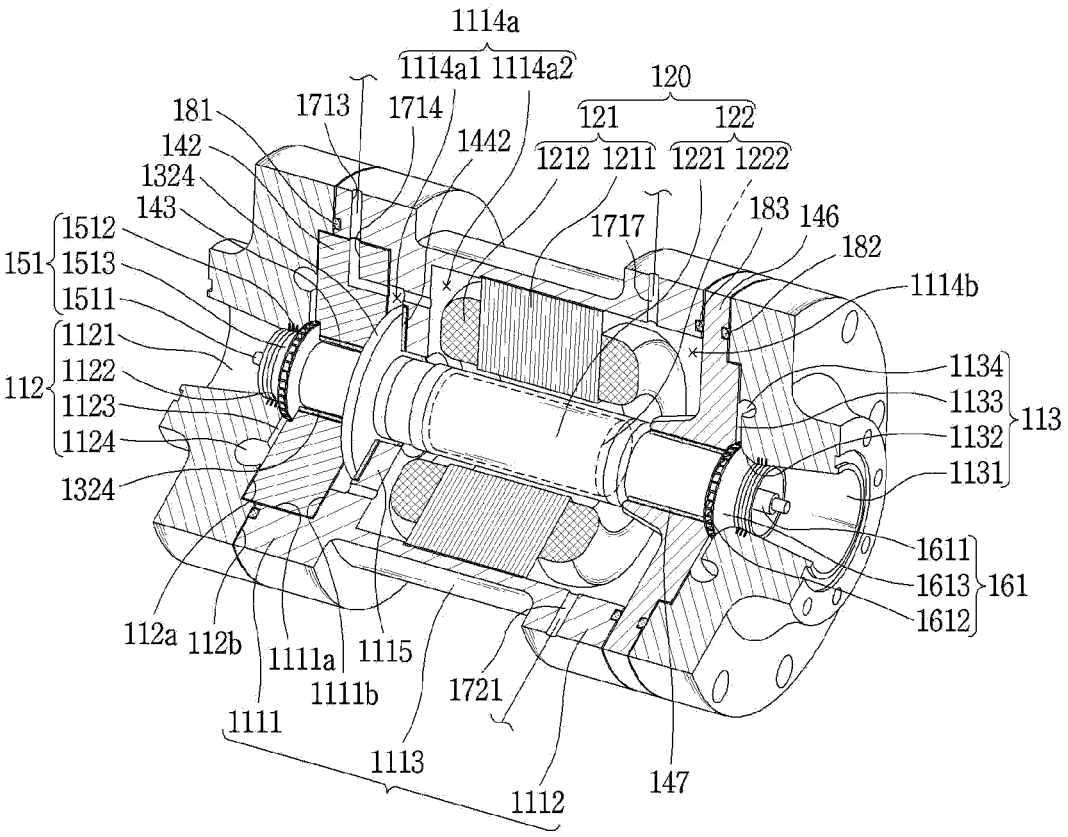
FIG. 3 is an assembled perspective view of an inside of the turbo compressor of FIG. 2.
Figure 4:
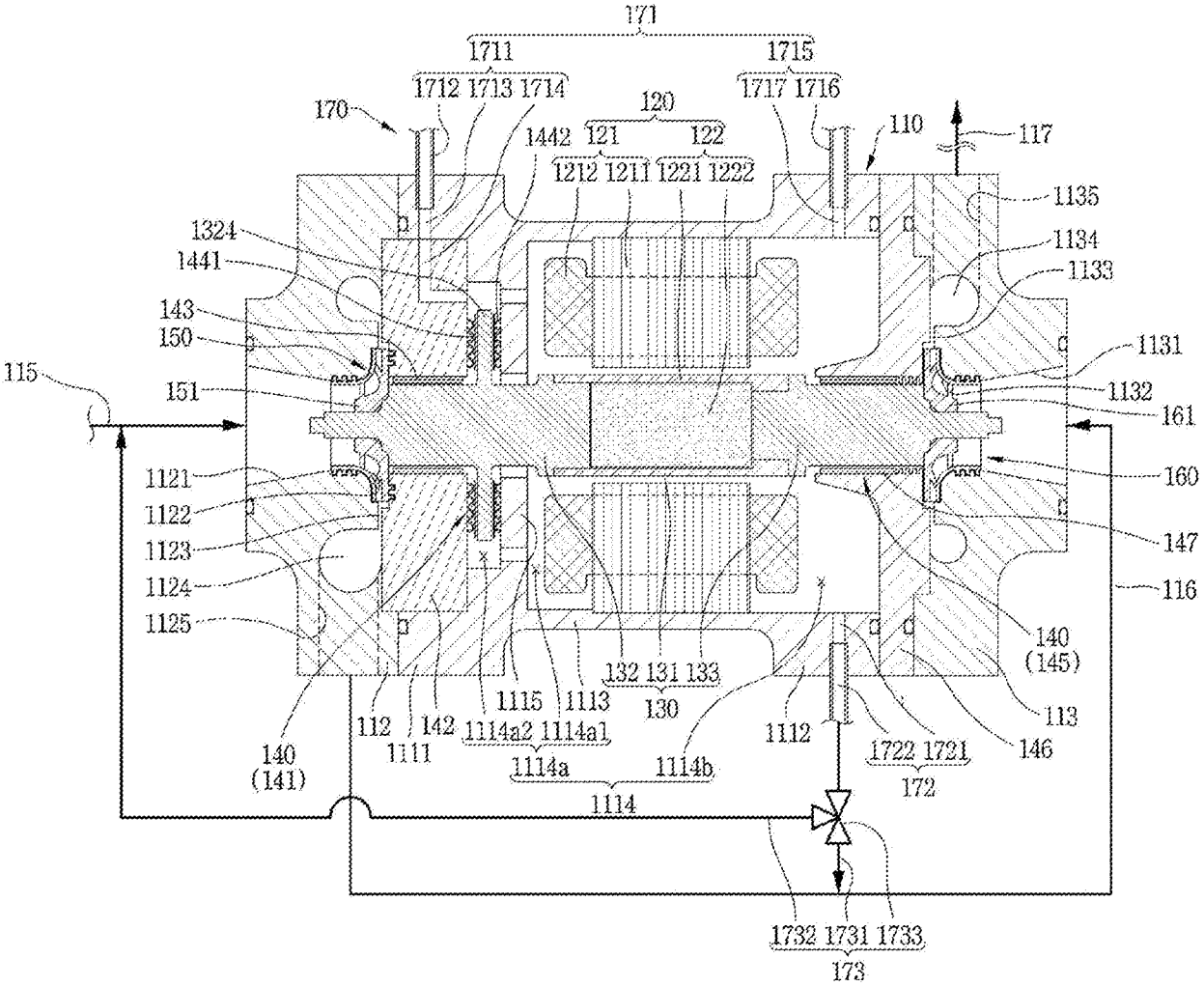
FIG. 4 is a cross-sectional view of the inside of the turbo compressor of FIG. 3.
Figure 5:
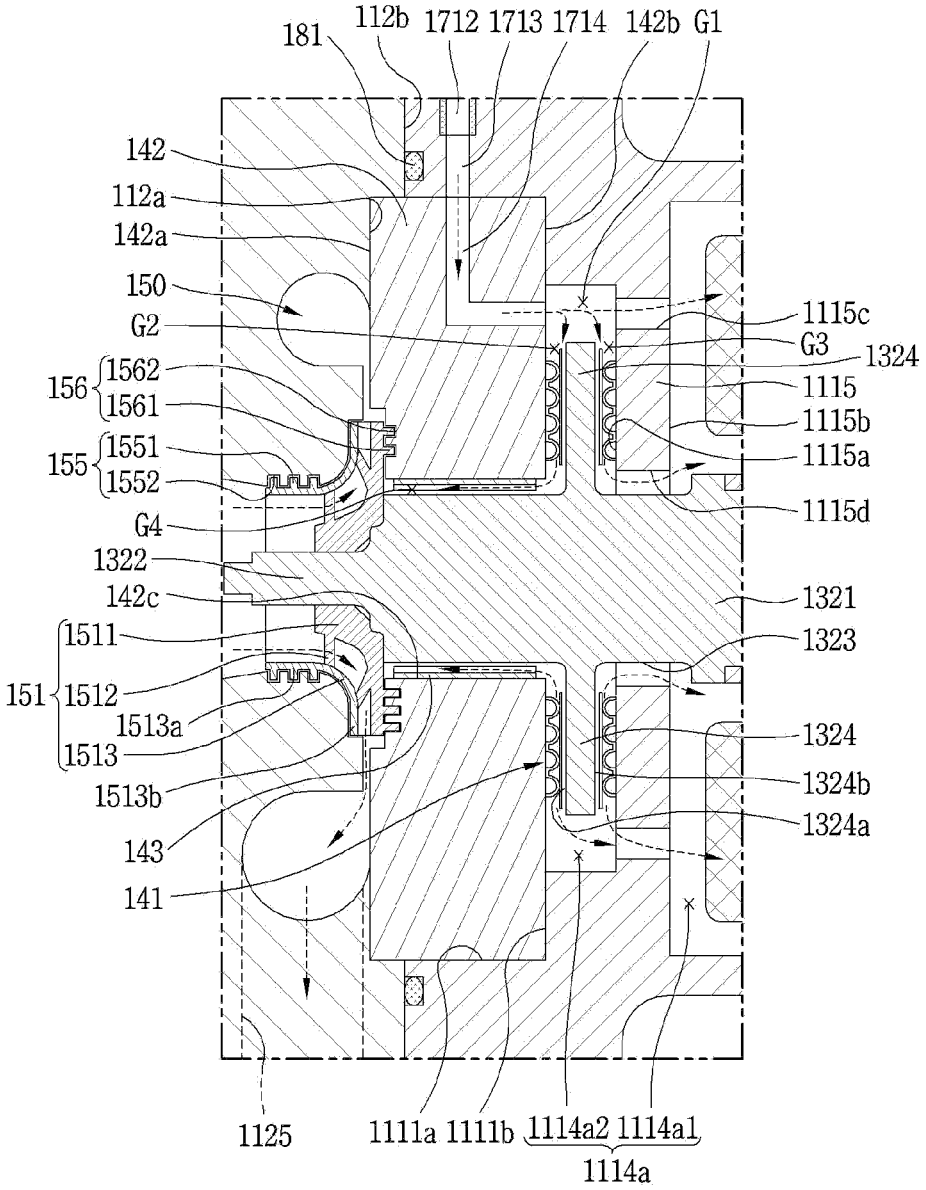
FIG. 5 is an enlarged cross-sectional view of a first compression part in FIG. 4.
Figure 6:
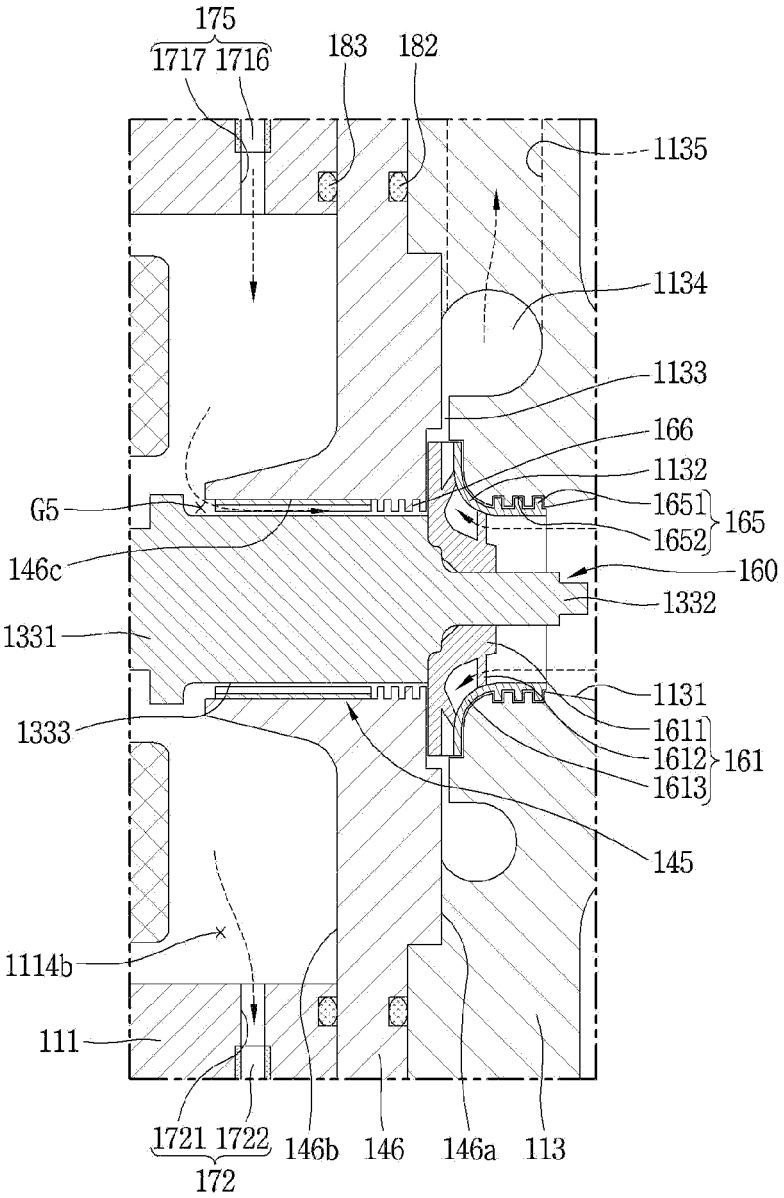
FIG. 6 is an enlarged cross-sectional view of a second compression part in FIG. 4.

FIG. 2 is an exploded perspective view of a turbo compressor according to an embodiment. FIG. 3 is an assembled perspective view of the inside of the turbo compressor of FIG. 2. FIG. 4 is a cross-sectional view of the inside of the turbo compressor of FIG. 3. FIG. 5 is an enlarged cross-sectional view of a first compression part in FIG. 4. FIG. 6 is an enlarged cross-sectional view of a second compression part in FIG. 4.

Referring to these drawings, the turbo compressor 10 according to the embodiment includes a housing 110, a motor part (motor) 120 constituting a drive motor, a rotary shaft 130, a bearing portion 140, a first compression part or portion (first-stage compression part) 150, a second compression part or portion (second-stage compression part) 160, and a refrigerant passage portion (refrigerant passage) 170. Referring to FIGS. 2 to 4, the housing 110 according to the embodiment forms an exterior of the compressor 10, and includes a motor housing 111, a first impeller housing 112, and a second impeller housing 113.

The motor housing 111 may be formed in the shape of a cylinder whose opposite axial ends are open. It should be noted that a first flange portion 1111 and a second flange portion 1112 are formed respectively on opposite ends of the motor housing 111, which extend radially so as to be fastened to a first impeller housing 112 and a second impeller housing 113 which are described hereinafter, and a recessed portion 1113 formed by recessing a central outer circumferential surface of the motor housing 111 may be formed between the first flange portion 1111 and the second flange portion 1112. Thus, opposite ends of the motor housing 111 are made thick, thereby ensuring fastening strength, whereas its center is made thin so that motor heat generated from the motor part 120 is quickly released.

The first flange portion 1111 may be formed with a ring-shaped, bearing shell seating groove 1111*a*, into which a part or portion of a first bearing shell 142 described hereinafter is inserted, and a radially stepped bearing shell seating surface 1111*b* formed on an inner circumferential surface of the bearing shell seating groove 1111*a*. A bearing support portion 1115 described hereinafter may be formed to extend radially from one side of the bearing shell seating surface 1111*b*. The bearing support portion 1115 will be described hereinafter.

A depth of the bearing shell seating groove 1111*a* may be equal to or slightly smaller than the thickness of the first bearing shell 142. Thus, a part or portion of a first side 142*a* of the first bearing shell 142 seated on the bearing shell seating surface 1111*b* may be supported radially by being inserted into a bearing shell receiving groove 1112*a* formed in the first impeller housing 112 which is described hereinafter.

On the whole, the second flange portion 1112 may be formed in a similar manner to the first flange portion 1111, with a stator 112 located midway between them. It should be noted that a second side 146*a* of a second bearing shell 146 described hereinafter may be tightly fastened to an end face of the second flange portion 1112.

A motor chamber 114 is formed within the motor housing 111. The motor chamber 1114 is press-fitted by shrink-fitting a stator 121 described hereinafter at the center. Thus, the motor chamber 1114 may be segmented into a first chamber 1114*a* on the side of the first compression part 150 and a second chamber 1114*b* on the side of the second compression part 160, with respect to the stator 121 described hereinafter.

The first chamber 1114*a* may be open toward the first compression part 150 but sealed off by the first impeller housing 112, more precisely, the first bearing shell 142, and the second chamber 1114*b* may be open toward the second compression part 160 but sealed off by the second impeller housing 113, more precisely, the second bearing shell 146. The first chamber 1114*a* and the second chamber 1114*b* substantially communicate with each other through a gap between a stator core 1211 constituting the stator 121 of the motor part 120 and a stator coil 1212 or through a gap between the stator 121 and the rotor 122. Accordingly, a refrigerant in the motor chamber 1114 may move smoothly between the two spaces 1114*a* and 1114*b* depending on a pressure difference.

The bearing support portion 1115 constituting a part or portion of a first bearing portion 141, which is described hereinafter, may be formed midway through the first chamber 1114*a*. Thus, the first chamber 1114*a* may be divided into a motor receiving space 1114*a*1 and a bearing receiving space 1114*a*2 with respect to the bearing support portion 1115.

Referring to FIGS. 4 and 5, the bearing support portion 1115 may extend radially from an inner circumferential surface of the motor housing 111 constituting the first chamber 1114*a* toward the rotary shaft 130. However, the bearing support portion 1115 may be press-fitted to the inner circumferential surface of the motor housing 111 or fastened with a fastening member (not shown) such as a bolt. The bearing support portion 1115 according to the embodiment is illustrated as extending integrally from the inner circumferential surface of the motor housing 111.

As the bearing support portion 1115 is formed in the first chamber 1114*a*, the stator 121 may be press-fitted in a direction from the second flange portion (second edge) 1111 of the motor housing 111 toward the first flange portion (first edge) 1112.

Accordingly, a stator fixing ridge (not shown) may be formed on the inner circumferential surface of the motor housing 111 which constitutes an edge of the first chamber 1114*a*, thereby limiting a depth to which the stator 121 is press-fitted.

Although not shown, in a case where the bearing support portion 1115 is formed in the second chamber 1114*b*, the stator 121 may be press-fitted in a direction from the first flange portion 1111 toward the second flange portion 1112. In this case, a stator fixing ridge (not shown) may be formed on the inner circumferential surface of the motor housing 111 which constitutes an edge of the second chamber 1114*b*.

Although not shown, in a case where the bearing support portion 1115 is post-assembled, the stator 121 may be press-fitted in either of the two directions. In this case, the stator 121 may be fixed using the bearing support portion 1115.

The bearing support portion 1115 may be formed in the shape of an annular disc. For example, a first through hole 1115*c* may be formed in a center of the bearing support portion 1115 to penetrate opposite axial sides 1115*a* and 1115*b*. The first through hole 1115*c* may radially support an end of the rotary shaft 130 on the side of the first compression part, as a first radial bearing 143 is provided on the rotary shaft 130.

The first through hole 1115*c* is formed with an inner diameter that allows the rotary shaft 130 to be penetrated. For example, the first through hole 1115*c* is formed larger than an outer diameter of a first impeller shaft portion 132 described hereinafter and smaller than an outer diameter of a thrust runner 1324 described hereinafter. Thus, when assembling the rotary shaft 130, the first impeller shaft portion 132 is inserted through the first through hole 1115*c* of the bearing support portion 1115, axially from the first flange portion 1111 of the motor housing 111 to the second flange portion 1112, and then a second side 1324*b* of the thrust runner 1324 is axially supported on the first side 1115*a* of the bearing support portion 1115 which axially faces the second side 1324*b*, thereby forming a second axial bearing 1442 described hereinafter. This will be described hereinafter with respect to the bearing portion.

The bearing support portion 1115 may have a refrigerant through hole 1115*d* penetrating opposite axial sides, between the first through hole 1115*c* constituting an inner circumferential surface of the bearing support portion 1115 and a root end constituting the inner circumferential surface of the motor housing 111. The refrigerant through hole 1115*d* may be formed as a plurality around the circumference. Accordingly, the motor receiving space 1114*a*1 and the bearing receiving space 1114*a*2 may communicate with each other by the first through hole 1115*c* and the refrigerant through hole 1115*d*.

The bearing receiving space 1114*a*2 may be formed on the opposite side of the stator 121, with the bearing support portion 1115 located in the middle between them. The bearing receiving portion 1114*a*2 may be formed by an inner space of the above-described first flange portion 1111—that is, by an inner circumferential surface of the bearing shell seating surface 1111*a*, the first side 1115*a* of the bearing support portion 1115, and the first impeller housing 112 described hereinafter.

The bearing receiving space 11142 may be formed as a generally sealed space, except for the first through hole 1115*c* and refrigerant through hole 1115*d* of the bearing support portion 1115 and a first shaft hole 142*c* of the first bearing shell 142 described hereinafter. It should be noted that, in this embodiment, a first inlet passage portion 1711 described hereinafter may be formed so as to supply liquid refrigerant passed through the condenser 20 to the bearing receiving space 1114*a*2.

The first inlet passage portion 1711 may be connected to an outlet of the condenser 20 through a first refrigerant inlet pipe 1712. Accordingly, the liquid refrigerant passed through the condenser 20 is introduced into the bearing receiving space 1114*a*2 constituting part of the first chamber 1114*a*, and this liquid refrigerant may be introduced into the first radial bearing 143 provided on an inner circumferential surface of the first bearing shell 142, a first axial bearing 1441 provided on a second side 142*b* of the first bearing shell 142, and a second axial bearing 1442 provided on the first side 115*a* of the bearing support portion 1115. Accordingly, the liquid refrigerant as a working fluid produces a bearing force on an end of the first compression part of the rotary shaft 130 by supporting the bearings 143, 1441, and 1442 constituting the first bearing portion 141, and at the same cools the bearings 143, 1441, and 1442 constituting the first bearing portion 141 and the rotary shaft 130 facing them. The radial bearing 143 and the first and second axial bearings 1441 and 1442 will be hereinafter.

The second chamber 1114*b* substantially communicates with the first chamber 1114*a* as explained above. However, it should be noted that a second refrigerant inlet pipe 1716 may be connected to the motor housing 111 constituting the second chamber 1114*b*. Like the first refrigerant inlet pipe 1712, the second refrigerant inlet pipe 1716 may be connected to the outlet of the condenser 20. Thus, a part or portion of the liquid refrigerant passed through the condenser 20 may be introduced into the second chamber 1114*b*, and this liquid refrigerant may be introduced into a second radial bearing 147 communicating with the second chamber 1114*b*. Accordingly, the liquid refrigerant as the working fluid produces a bearing force on a second end of the rotary shaft by supporting a bump foil constituting the second radial bearing 147, and at the same time, cools the second radial bearing 147 and the rotary shaft facing it. The second radial bearing 147 will also be described hereinafter.

Referring to FIGS. 2 to 5, a second side of the first impeller housing 112 facing the motor housing 111 is tightly attached and fastened with a bolt to the first flange portion 1111 of the motor housing 111, and the first impeller housing 112 may be formed roughly in the shape of a disc. A first sealing member 181, such as a gasket or an O-ring, may be provided between the second side of the first impeller housing 112 and the first flange portion 1111 of the motor housing 111 facing it, so that the first chamber 1114*a* of the motor housing 111, more precisely, the bearing receiving space 1114*a*2, may be tightly sealed.

For example, the bearing shell receiving groove 112*a* may be formed on the second side of the first impeller housing 112 and wider than the outer diameter of a first volute 1124 described hereinafter, and an annular, first housing fastening surface 112*b* may be formed outside of the bearing shell receiving groove 112*a* and stepped from the bearing shell receiving groove 112*a*. The first housing fastening surface 112*b* may be tightly attached and fastened with a bolt to the first flange portion 1111 of the motor housing 111, with the first sealing member 181 interposed between them.

The first impeller housing 112 according to this embodiment includes a first intake port 1121, a first impeller receiving portion 1122, a first diffuser 1123, a first volute 1124, and a first discharge port 1125. The first intake port 1121 may be formed in such a direction as to penetrate opposite axial sides at the center of the first impeller housing 112. For example, the first intake port 1121 may be open on a front side (first side) of the first impeller housing 112 and extend axially. The first intake port 1121 may be formed in the shape of a truncated cone, with a wide entrance end to which a refrigerant intake pipe 115 is connected, and a narrow exit end to which the first impeller receiving portion 1122 is connected. Therefore, a flow rate and flow velocity of refrigerant drawn in through the first intake port 1121 may be increased.

The first impeller receiving portion 1122 may extend from the exit end of the first intake port 1121 toward an outer circumferential surface of the first impeller 151, and the first impeller 151 may be rotatably inserted into the first impeller receiving portion 1122. Thus, the first impeller receiving portion 1122 may be defined as a first stationary side shroud, an inner circumferential surface of the first impeller receiving portion 1122 may be curved along the shape of an outer side of the first impeller 151.

The first impeller receiving portion 1122 may be formed in such a way that its inner circumferential surface is spaced as small an air gap as possible apart from the outer side of the first impeller 151. Accordingly, the refrigerant drawn in through the first intake port 1121 is prevented from leaking out of the first impeller, that is, between the inner circumferential surface of the first impeller receiving portion 1122 and the outer circumferential surface of the first impeller 151, thereby reducing intake losses of refrigerant.

A first intake sealing portion 155 or part of the first intake sealing portion 155 may be formed on the inner circumferential surface of the first impeller receiving portion 112. Accordingly, refrigerant leakage between the inner circumferential surface of the first impeller receiving portion 1122 and the outer circumferential surface of the first impeller 151 may be prevented more effectively.

For example, a first outer sealing portion 1551 may be formed on the inner circumferential surface of the first impeller receiving portion 1122. The first outer sealing portion 1551 may be formed from a kind of labyrinth seal that is continuously toothed along an axis on the inner circumferential surface of the first impeller receiving portion 1122. The first outer sealing portion 1551 may be formed from one or two or more toothed annular grooves or annular projections. The first intake sealing portion 155 including the first outer sealing portion 1551 may form an axial sealing portion.

The first intake sealing portion 155 may be formed as the above-described first outer sealing portion 1551 alone, or may be formed from a combination of the first outer sealing portion 1551 and a first inner sealing portion 1552, with the first inner sealing portion 1552 being formed on the outer side of the first impeller 151 the first outer sealing portion 1551 radially faces. In the case where the first intake sealing portion 155 is formed from a combination of the first outer sealing portion 1551 and the first inner sealing portion 1552, both of the sealing portions 1551 and 1552 may be formed symmetrically so that a projection of the first outer sealing portion 1551 is inserted a predetermined depth into a groove of the first inner sealing portion 1552, and a projection of the first inner sealing portion 1552 is inserted a predetermined depth into a groove of the first outer sealing portion 1551. Thus, the sealing length of the first intake sealing portion 155 becomes narrow and long, thereby preventing refrigerant leakage between the inner circumferential surface of the first impeller receiving portion 1122 and the outer circumferential surface of the first impeller 151.

However, in a case where the first outer sealing portion 1551 and the first inner sealing portion 1552 are formed to interlock with each other, the projections and grooves on both of the sealing portions 1551 and 1552 may overlap each other. Then, when the first impeller housing 112 is axially pushed and assembled to the motor housing 111, the projections on one side sealing portion are caught on the wall surfaces of the grooves on the other side sealing portion, which makes it impossible to assemble the first impeller housing 112 to the motor housing 111.

As such, in a case where the first outer sealing portion 1551 and the first inner sealing portion 1552 constituting the first intake sealing portion 155 interlock with each other to form a labyrinth seal, the first impeller housing 112 may be divided into left and right housings to be assembled.

For example, the first impeller housing 112 may include a first left housing and a first right housing, and the first left housing and the first right housing may be joined together in a butt joint on opposite sides of the first impeller 151, with the first impeller 151 in between. Afterwards, the first impeller housing 112 may be bolted to the first flange portion 1111 of the motor housing 111. Accordingly, a sealing effect between the inner circumferential surface of the first impeller housing and the outer circumferential surface of the first impeller 151 may be increased by forming an outer sealing portion and an inner sealing portion in multiple stages on the first impeller housing 112 and the first impeller 151, respectively, and interlocking them. Thus, a refrigerant drawn into the first impeller through the first intake port is prevented from leaking between the inner circumferential surface of the first impeller housing 112 and the outer circumferential surface of the first impeller 151, thereby increasing compressor performance.

The first diffuser 1123 may extend from a trailing edge of the first impeller receiving portion 112. For example, the first diffuser 1123 may be formed as a space between the first side 142*a* of the first bearing shell 142 and the second side (not shown) of the first impeller housing 112 facing it.

The first diffuser 1123 may include spiral protrusions from the first side 142*a* of the first bearing shell 142 which are formed around a circumference at preset or predetermined intervals. The first diffuser 1123 also may be formed as a space between the first bearing shell 142 and the first impeller housing 112 facing it, from which the above-mentioned spiral protrusion is excluded. Due to centrifugal force, a refrigerant passing through the first diffuser 1123 has a higher pressure as it becomes closer to the first volute 1124.

The first volute 1124 may be formed by being connected to a wake of the first diffuser 1123. For example, the first volute 1124 may be recessed from an axial rear side of the first impeller housing 112. The first volute 1124 may be formed in the shape of a ring to cover an outer circumferential surface of the first diffuser 1123 in such a way that its cross-sectional area increases toward the first discharge port 1125 described hereinafter.

The first discharge port 1125 may be formed by penetrating an outer side of the first impeller housing 112, midway along a circumference of the first volute 1124. Accordingly, an entrance end of the first discharge port 1125 may be connected to the first volute 1124, and an exit end thereof may be connected to a second intake port of the second impeller housing 113 via a refrigerant connecting pipe 116 described hereinafter.

Referring to FIGS. 4 and 6, a second side of the second impeller housing 113 facing the motor housing 111 is tightly attached to the second flange portion 1112 of the motor housing 111. While the first impeller housing 112 is inserted and fastened into the motor housing 111, the second impeller housing 113 may be tightly fastened to an end face of the motor housing 111. Accordingly, an outer diameter of the second impeller housing 113 may be made larger than an inner diameter of the motor housing 111.

The second impeller housing 113 may be made almost similar to the first impeller housing 112. For example, the second impeller housing 113 according to this embodiment may include a second intake port 1131, a second impeller receiving portion 1132, a second diffuser 1133, a second volute 1134, and a second discharge port 1135. The second intake port 1131 may be made almost identical to the first intake port 1121, the second impeller receiving portion 1132 may be made almost identical to the first impeller receiving portion 1122 (which may be defined as a second stationary side shroud), the second diffuser 1133 may be made almost identical to the first diffuser 1123, the second volute 1134 may be made almost identical to the first volute 1124, and the second discharge 1135 may be made almost identical to the first discharge 1125. A description of the second impeller housing 113 will be replaced with the description of the first impeller housing 112.

Referring to FIGS. 2 to 4, the motor part 120 according to the embodiment includes stator 121 and rotor 122. The stator 121 includes a stator core 1211 fixed to the motor housing 111 by press-fitting and a stator coil 1212 wound on the stator core 1211.

The stator core 1211 may be formed in the shape of a cylinder, and one (first) axial end of the stator core 1211 may be axially supported on a stator fixing ridge (not shown) provided on an inner circumferential surface of the motor housing 111. A plurality of teeth is formed around a circumference to radially protrude from an inner circumferential surface of the stator core 1211, with slots between them.

The stator coil 1212 is wound around the teeth through the slots. Accordingly, a circumferential gap is created between both sides of the stator coil 1212 in the slots, and this circumferential gap serves as a refrigerant passage through which the first chamber 1114*a* and second chamber 1114*b* of the motor housing 111 communicate with each other.

The rotor 122 is spaced apart from the inner circumferential surface of the stator 121 so as to be rotatable within the stator 121. The rotor 122 includes rotor core 1221 and permanent magnet 1222, and the rotor core 1221 may be coupled to the rotary shaft 130 or be omitted. In the case where the rotor core 1221 is omitted, the permanent magnet 1222 may be attached to the outer circumferential surface of the rotary shaft 130 or mounted within the rotary shaft 130. In this embodiment, an example is illustrated in which the permanent magnet 1222 is inserted into the rotary shaft 130 and a part or portion of the rotary shaft constitutes the rotor core 1221.

Referring to FIG. 3 and FIG. 4, the rotary shaft 130 according to this embodiment includes a drive shaft portion 131, a first impeller shaft portion 132, and a second impeller shaft portion 133. The drive shaft portion 131 is formed in a cylindrical shape and rotatably inserted into the stator 121. For example, a length of the drive shaft portion 131 may be larger than or equal to an axial length of the stator 121, and the drive shaft portion 131 may be coupled in such a way that its axial center lies radially on a same line as the axial center of the stator 121.

A magnet receiving portion 1311 is formed inside the drive shaft portion 131, and the permanent magnet 1222 constituting the rotor 122 is inserted into the magnet receiving portion 1311. Accordingly, the drive shaft portion 131 constitutes a part or portion of the rotary shaft 130, and at the same time, constitutes a part or portion of the rotor 122 along with the permanent magnet 1222.

The magnet receiving portion 1311 may have almost the same shape as an outer circumferential surface of the permanent magnet 122, and an inner diameter of the magnet receiving portion 1311 may have almost the same shape as an outer diameter of the permanent magnet 1222. Accordingly, the permanent magnet 1222 inserted into the magnet receiving portion 1311 may maintain its position in the best way possible in the magnet receiving portion 1311.

A magnet fixing ridge 1311*a* axially supporting one end of the permanent magnet 1222 may be formed with a difference in level, on the inside of the drive shaft portion 131, that is, on the inner circumferential surface of the magnet receiving portion 1311. Accordingly, when assembling the permanent magnet 122, the permanent magnet 1222 may be positioned easily at the center of the stator, and the permanent magnet 122 also may be stably held in its position at the center of the stator even if the rotary shaft 130 rotates at a high speed.

Although not shown, at least one magnet locking portion (not shown) may be further formed between the inner circumferential surface of the magnet receiving portion 1311 and the outer circumferential surface of the permanent magnet 1222 facing it. The magnet locking portion may be formed in such a way that the inner circumferential surface of the magnet receiving portion 13111 and the outer circumferential surface of the permanent magnet 122 correspond to each other. For example, the magnet locking portion may be formed in a D-cut shape, or may be formed with a locking projection and a locking groove that extend axially.

The first impeller shaft portion 132 includes a first shaft fixing portion 1321, a first impeller fixing portion 1322, a first bearing surface portion 1323, and a thrust runner 1324. The first shaft fixing portion 1321 extends axially from the first bearing surface portion 1323 towards the second impeller shaft portion 133, and is made smaller than the outer diameter of the first bearing surface portion 1323. Thus, the first shaft fixing portion 1321 may be inserted into and fixed to an end (hereinafter, first end) of the drive shaft portion 131, on the side of the first compression part. For example, the first shaft fixing portion 1321 may be welded and coupled to the first end of the drive shaft portion 131 while being press-fitted thereto. Although not shown, an anti-rotation portion (not shown) made into a D-cut shape or formed with a projection and a groove (or slit) may be further formed between the first shaft fixing portion 1321 of the first impeller shaft portion 132 and the first end of the drive shaft portion 131.

The first impeller fixing portion 1322 extends axially from the first bearing surface portion 1323 toward the first impeller 151 which is opposite the first shaft fixing portion 1321. The first impeller fixing portion 1322 may be made smaller than an outer diameter of the first shaft fixing portion 1321, as well as an outer diameter of the first bearing surface portion 1323, and may be inserted into and coupled to a first hub 1511 of the first impeller 151 described hereinafter.

The first impeller fixing portion 1322 may be made angular or into a D cut shape. Thus, the first impeller fixing portion 1322, while being inserted in the first impeller 151, may transmit torque of the motor part 120 without slip.

The first bearing surface portion 1323 is formed in the shape of a circular bar or a cylinder between the first shaft fixing portion 1321 and the first impeller fixing portion 1322. The first bearing surface portion 1323 is a portion that is inserted into the first radial bearing 143 described hereinafter and radially supported by it. An outer circumferential surface of the first bearing surface portion 1323 may be formed in the shape of a smooth tube so as not to produce rotational resistance to the first radial bearing 143.

Referring to FIGS. 3 to 5, the thrust runner 1324 may be formed in the shape of a disc as it extends like a flange between the first shaft fixing portion 1321 and the first impeller fixing portion 1322, in other words, on the outer circumferential surface of the first bearing surface portion 1323. The thrust runner 1324 may be provided between the bearing support portion 1115 and the first bearing shell 142 and supported on both sides of the axis between the bearing support portion 1115 and the first bearing shell 142. In other words, the thrust runner 1324 may form an axial moving side support portion (moving side support portion), and the bearing support portion 1115 and the first bearing shell 142 each may form an axial stationary support portion (stationary side support portion). Accordingly, the rotary shaft 130 may be supported on both sides of the axis, along with the first impeller 151 and second impeller 161 coupled to both ends of the rotary shaft 130.

The bearing support portion 1115 and the first bearing shell 142 constituting the stationary side support portion may form the second chamber 1115*b*, with the thrust runner 1324 interposed in between. Thus, the first bearing shell 142 may be defined as a first partition wall, and the bearing support portion 1115 may be defined as a second partition wall.

The thrust runner 1324 may be formed in such a way that an outer circumferential surface thereof is separated from an inner circumferential surface of the bearing receiving space 114*a*2. The outer diameter of the thrust runner 1324 may be smaller than the inner diameter of the bearing receiving space 1114*a*2, and the outer circumferential surface of the thrust runner 1324 and a first gap G1 may be formed between the inner circumferential surface of the bearing receiving space 114*a*2 which are radially separated by a preset distance.

The first gap G1 may communicate with a second gap G2 described hereinafter where the first axial bearing 1441 is provided and a third gap G3 described hereinafter where the second axial bearing 1442 is provided. In other words, an outer circumferential surface of the second gap G2, which constitutes the space between a first side 1324*a* of the thrust runner 1324 and the second side 142*b* of the first bearing shell 142 facing it, may communicate with an inner circumferential surface of the first gap G1, and an outer circumferential surface of the third gap G3, which constitutes the space between the second side 1324*b* of the thrust runner 1324 and the first side 1115*a* of the bearing support portion 1115 facing it, may communicate with the inner circumferential surface of the first gap G1.

Accordingly, a refrigerant may be introduced into the first gap G1 constituting the bearing receiving space 1114*a*2 through a first refrigerant inlet 1713, and this refrigerant may be introduced into the second gap G2 and the third gap G3 as it moves through the first gap G1 in the circumferential direction. As this refrigerant moves from the outer circumferential surface of the second gap G2 and third gap G3 to the inner circumferential surface thereof, it is radially supplied to the first axial bearing 1441 and the second axial bearing 1442, and therefore the first axial bearing 1441 and the second axial bearing 1442 each may maintain uniform bearing force.

The first shaft hole 142*c* of the first bearing shell 142 constituting a fourth gap G4 may communicate with the inner circumferential surface of the second gap G2, and the first through hole 1115*c* of the bearing support portion 1115 may communicate with the inner circumferential surface of the third gap G3. Accordingly, a refrigerant moving from the outer circumferential surface of the second gap G2 to the inner circumferential surface thereof may be introduced into the first shaft hole 142*c*, and this refrigerant may be supplied from one (first) end of the first radial bearing 143 provided in the first shaft hole 142*c* to the other (second) end thereof, and therefore the first radial bearing 143 may maintain uniform bearing force.

A refrigerant moving from the outer circumferential surface of the third gap G3 to the inner circumferential surface thereof passes through the first through hole 1115*c* and moves to the motor receiving space 1114*a*1. Although not shown, the first axial bearing 1441 may be provide on the first side 1324*a* of the thrust runner 1324, and the second axial bearing 1442 may be provided on the second side 1324*b* of the thrust runner 1324. In this case, both the first axial bearing 1441 and the second axial bearing 1442 are installed on the rotary shaft 130, thereby making easier installation and assembly of the first axial bearing 1441 and the second axial bearing 1442. The first axial bearing 1441 and the second axial bearing 1442 will be described hereinafter.

Referring to FIG. 4, the second impeller shaft portion 133 may be inserted into and fixed to an end (hereinafter, second end) of the drive shaft portion 131, on the side of the second compression part. For example, the second impeller shaft portion 133, like the first impeller shaft portion 132, may be welded and coupled to the second end of the drive shaft portion 131 while being press-fitted thereto.

The second impeller shaft portion 133 and the first impeller shaft portion 132 are symmetrical with respect to the drive shaft portion 131, and the thrust runner 1324 may be excluded as no axial bearing is provided in the second bearing portion 145. That is, the second impeller shaft portion 133 may include a second shaft fixing portion 1331, a second impeller fixing portion 1332, and a second bearing surface portion 1333. However, in some cases, the axial bearing may be provided in the second bearing portion 145 as well, and therefore the thrust runner 1324 may be provided in the second impeller shaft portion 133.

The bearing portion 140 according to this embodiment includes the first bearing portion 141 and the second bearing portion 145. The first bearing portion 141 may be provided between the motor part (or drive motor) 120 and the first compression part 150, and the second bearing portion 145 may be provided between the motor part (or drive motor) 120 and the second compression part 160.

Referring to FIGS. 4 and 5, the first bearing portion 141 includes first bearing shell 142, first radial bearing 143, first axial bearing 1441, and second axial bearing 1442. The first radial bearing 143 is located on an inner circumferential surface of the first bearing shell 142, the first radial bearing 1441 is located on the second side 142*b* of the first bearing shell 142, and the second axial bearing 1442 is located on the first side 1115*a* of the bearing support portion 1115.

The first bearing shell 142 may be fastened with bolts to the motor housing 111 between the bearing support portion 1115 and the first impeller housing 112. For example, the first bearing shell 142 is inserted into the bearing shell seating groove 1111*a*, and the second side 142*b* of the first bearing shell 142 which is opposite the first compression part is fastened with a bolt to the bearing shell seating surface 1111*b* while being tightly attached thereto.

However, in some cases, no fastening bolt may be provided, and both sides of the first bearing shell 142 may be tightly attached and fixed to the bearing shell seating surface 1111*b* of the motor housing 111 and the impeller shell receiving groove 112*a* of the first impeller housing 112, respectively. In this case, as there is no separate fastening member for fastening the first bearing shell 142, the first bearing shell 142 may be easily assembled at a low cost.

The first bearing shell 142 may be formed in the shape of a ring whose inner and outer peripheries are blocked. For example, the first bearing shell 142 may have a preset or predetermined axial length, and be formed in the shape of a ring whose center is axially penetrated by the first shaft hole 142*c*. Accordingly, a front end of the first impeller shaft portion 132 constituting the rotary shaft 130 may pass through the first shaft hole 142*c* and be coupled to the first impeller 151 described hereinafter.

The first shaft hole 142*c* may be spaced a preset or predetermined distance apart from the first bearing surface portion 1323 constituting the outer circumferential surface of the first impeller shaft portion 132 to form the fourth gap G4, and the first radial bearing 143 may be provided in the fourth gap G4. Accordingly, the first impeller shaft portion 132 constituting the rotary shaft 130 may be radially supported by the first radial bearing 143.

The first bearing shell 142 may have a front sealing portion 1561 on a first side 142*a* facing the first impeller 151, which constitutes a part or portion of a first discharge sealing portion 156. The front sealing portion 1561 may be formed from an annular labyrinth seal consisting of at least one tooth that is formed radially. Accordingly, the first discharge sealing portion 156 including the front sealing portion 1561 forms a radial sealing portion. In this case, the first discharge sealing portion 156 may be formed from the front sealing portion 1561 alone, or may be formed from a combination of the front sealing portion 1561 and a rear sealing portion 1562, with the rear sealing portion 1562 being formed on a rear surface of the first impeller 151 the front sealing portion 1561 radially faces.

For example, in the case where the first discharge sealing portion 156 is formed from a combination of the front sealing portion 1561 and the rear sealing portion 1562, both of the sealing portions 1561 and 1562 may be formed symmetrically so that a projection of the front sealing portion 1561 is inserted a predetermined depth into a groove of the rear sealing portion 1562, and a projection of the rear sealing portion 1562 is inserted a predetermined depth into a groove of the front sealing portion 1561. Thus, a sealing length of the first discharge sealing portion 156 becomes narrow and long, thereby preventing refrigerant from leaking to the motor chamber 114 through a gap between a front surface of the first bearing shell 142 and the rear surface of the first impeller 151.

The first discharge sealing portion 156 including the front sealing portion 1561 may be formed in a position where it axially overlaps the first impeller 151. Thus, it is possible to minimize leakage of refrigerant passing through the first diffuser 1123 past the first impeller 151 through the gap between the rear side (second side) of the first impeller 151 and the front side (first side) of the first bearing shell 142, thereby increasing compression efficiency.

In this case, however, the first radial bearing 143 and the first and second axial bearings 1441 and 1442, which are described hereinafter, are not supplied with sufficient amounts of refrigerant as the working fluid, which may lead to a delay in the formation of bearing force in the bearings or overheating of the bearings. In this regard, as in this embodiment, the first radial bearing 143 and the first and second axial bearings 1441 and 1442 may be formed with a separate refrigerant flow path described hereinafter, so that refrigerant is supplied to each of the bearings. Consequently, refrigerant leakage in the first compression part 150 may be reduced, and therefore compression efficiency may be increased, thereby increasing reliability of the bearings 143, 1441, and 1442 and preventing overheating thereof. This will be described hereinafter.

A first radial bearing 143 described hereinafter may be provided on an inner circumferential surface of the first shaft hole 142*c* of the first bearing shell 142, and the first axial bearing 1441 may be provided on the second side 142*b* of the first bearing shell 142 facing the thrust runner 1324. Although not shown, the first radial bearing 143 may be provided on the outer circumferential surface (first bearing surface portion) of the rotary shaft 130, and the first axial bearing 1441 may be provided on the first side 142*a* of the thrust runner 1324.

The first radial bearing 143 may be formed as a gas foil bearing. For example, the first radial bearing 143 may include a corrugated bump foil (not shown) and an arc-shaped top foil (not shown).

The first radial bearing 143 may be provided on the inner circumferential surface of the first bearing shell 142 so as to radially face the outer circumferential surface of the rotary shaft 130, more precisely, the first bearing surface portion 1323. Thus, when the rotary shaft 130 rotates, refrigerant as the working fluid is introduced into the first radial bearing 143, forming a kind of fluid film and radially supporting the rotary shaft 130. As the gas foil bearing is universally known, detailed description thereof has been omitted.

It should be noted that, in the first radial bearing 143 according to this embodiment, the bump foil may bulge outward in the radial direction and be corrugated along the circumference, and that the top foil may be separated from the outer circumferential surface of the rotary shaft 130 by a preset or predetermined distance. Consequently, the first radial bearing 143 may be formed with an axial refrigerant passage whose opposite axial ends are open.

In view of this, in this embodiment, a refrigerant intake passage 1714 described hereinafter may be formed in such a way as to be positioned outside a range of an axis of the first radial bearing 143. Accordingly, refrigerant entering the bearing receiving space 114*a*2 may be introduced from one (first) axial end of the first radial bearing 143 to the other (second) axial end, so that a fluid film is formed uniformly between the rotary shaft 130 and the first radial bearing 143. The refrigerant intake passage 1714 will be described hereinafter in the description of the refrigerant passage portion.

As described previously, the first axial bearing 1441 may be fixed and installed to the second side 142*b* of the first bearing shell 142. The first axial bearing 1441 may have the shape of a disc, and be formed as a gas foil bearing just like the first radial bearing 143.

For example, the first axial bearing 1441 may include a first bump foil (not shown) having a corrugated shape and a first top foil (not shown) having an arc plate shape, and be disposed in such a way that the second side 142*b* of the first bearing shell 142 faces the first side 1324*a* of the thrust runner 1324. Likewise, as the gas foil bearing is universally known, detailed description thereof has been omitted.

It should be noted that, in the first axial bearing 1441 according to this embodiment, the first bump foil (not shown) may bulge outward in the axial direction and be corrugated along the circumference, and that the first top foil (not shown) may be separated from the thrust runner 1324 by a preset or predetermined distance. Consequently, a radial refrigerant passage whose opposite axial ends are open may be formed in the radial direction of the first axial bearing 1441.

In view of this, in this embodiment, the refrigerant intake passage 1714 described hereinafter may be formed in such a way as to be positioned outside a range of a radius of the first axial bearing 1441. Accordingly, a refrigerant entering the bearing receiving space 114*a*2 may be introduced from one (first) radial end of the first axial bearing 1441 to the other (second) radial end, so that a fluid film is formed uniformly between the first side 1324*a* of the thrust runner 1324 and the first axial bearing 1441.

The second axial bearing 1442 has basically the same construction and operational effects as the first axial bearing 1441, except for an installation position. For example, the second axial bearing 1442 may be provided on the first side 1115*a* of the bearing support portion 1115 facing the second side 1324*a* of the thrust runner 1324. Accordingly, refrigerant entering the bearing receiving space 1114*a*2 causes a fluid film to be formed uniformly between the second side 1324*b* of the thrust runner 1324 and the second axial bearing 1442.

Referring to FIGS. 4 and 6, the second bearing portion 145 according to this embodiment includes the second bearing shell 146 and the second radial bearing 147. The second radial bearing 147 may be provided in a second shaft hole 146*c* constituting an inner circumferential surface of the second bearing shell 146.

The second bearing shell 146 may be provided between the motor housing 111 and the second impeller housing 113. For example, a first side 146*a* of the second bearing shell 146 facing the second compression part 160 may be tightly attached and fastened to the second impeller housing 113, with a second sealing member 182 interposed between them, and a second side 146*b* of the second bearing shell 146 which is axially opposite the first side 146*a* may be tightly attached and fastened to the second flange portion 1112 of the motor housing 111, with a third sealing member 183 interposed between them. Although not shown, the second bearing shell 146 may be inserted into the second flange portion 1112 of the motor housing 111 and fixed thereto as it is pressed against the motor housing 111 and the second impeller housing 113. In this case, a separate fastening member for fastening the second bearing shell 146 is not required, thereby simplifying the assembling process of the second bearing shell 146.

The second bearing shell 146 may be formed in the shape of a ring whose inner and outer peripheries are blocked. For example, the second bearing shell 146 may have a preset or predetermined axial length, and be formed in the shape of a ring whose center is axially penetrated by the second shaft hole 146.

An inner diameter of the second shaft hole 146*c* may be larger than an outer diameter of the rotary shaft 130, more precisely, an outer diameter of the second bearing surface portion 1333 provided on the second impeller shaft portion 133. Accordingly, a front end of the second impeller shaft portion 133 constituting the rotary shaft 130 may be coupled to the second impeller 161 described hereinafter after passing through the second shaft hole 146*c* of the second bearing shell 146.

A second discharge sealing portion 166 may be provided on an inner circumferential surface of the second shaft hole 146*c*. The second discharge sealing portion 166 may be made into an annular labyrinth seal with grooves formed at preset or predetermined intervals along the axis. Thus, it is possible to minimize leakage of refrigerant passing through the second diffuser 1133 past the second impeller 161 through a fifth gap G5 between an outer circumferential surface of the second impeller shaft portion 133 and an inner circumferential surface of the second bearing shell 146, thereby increasing compression efficiency.

The second radial bearing 147 may be provided on one side of the second discharge sealing portion 166, that is, on a side of the inner circumferential surface of the second shaft hole 146*c* adjacent to the motor part 120. The second radial bearing 147 may be formed a gas foil bearing, just like the first radial bearing 143. A description of the second radial bearing 147 will be replaced with the description of the first radial bearing 143.

It should be noted that, as described above, the second radial bearing 147 is provided to face and communicate with the motor chamber (more precisely, the second chamber) 1114, thus enabling liquid refrigerant injected into the motor chamber 1114 to be supplied directly to the second radial bearing 147. Accordingly, the space between the second compression part 160 and the motor chamber (more precisely, the second chamber) 1114 is sealed by the second discharge sealing portion 166, thereby increasing compression efficiency in the second compression part 160, enabling the second radial bearing 147 to provide quick bearing force by the refrigerant introduced into the second chamber 1114*b*, and cooling the second radial bearing 147 and the rotary shaft 130.

Referring to FIGS. 4 and 5, the first compression part 150 according to this embodiment includes a first impeller 151, a first diffuser 1123, and a first volute 1124. However, description of the first diffuser 1123 and the first volute 1124, among the components of the first compression part 150, is identical to the previous description of the first impeller housing 112. That is, the first diffuser 1123 may be formed between the first impeller housing 112 and the first bearing shell 142, and the first volute 1124 may be formed on the first impeller housing 112. Thus, the first compression part 150 will be described hereinafter with respect to the first impeller 151.

The first impeller 151 includes a first hub 1511, a first blade, and a first shroud. As described previously, the first impeller 151, together with the first diffuser 1123 and the first volute 1124, form the first compression part 150 which is the first-stage compression part in a functional sense. Accordingly, the intake side of the first impeller 151 may be connected to the refrigerant intake pipe 115, and the discharge side of the first impeller 151 may be connected by the refrigerant connecting pipe 116 to the intake side of the second impeller 161 which constitutes part of the second-stage compression part (second compression part).

The first hub 1511 is a part or portion that is coupled to the rotary shaft 130 to receive torque, and the first impeller shaft portion 132 of the rotary shaft 130 may be inserted into and coupled to the center of the first hub 1511.

The first hub 1511 may have the same diameter in the axial direction. The first hub 1511 may be formed in the shape of a truncated cone, in which its outer diameter gets larger toward the rear away from the front, as in this embodiment.

Accordingly, refrigerant may be compressed as it moves smoothly from the front to the rear along an outer circumferential surface of the first hub 1511.

A first front sealing portion 1561 constituting a part or portion of the above-described first discharge sealing portion 156 may be formed on one side of the first hub 1511, that is, on a second side thereof facing the first bearing shell 142. The front sealing portion 1561 may form a labyrinth seal by interlocking with the rear sealing portion 1562 provided on the first side 142*a* of the first bearing shell 142. Thus, it is possible to keep a refrigerant passing through the first diffuser 1123 from leaking to the first chamber 1114*a* constituting the motor chamber 1114.

The first blade 1512 may include a plurality of blades spaced at equal intervals along a circumference of the first hub 1511. The first blade 1512 including a plurality of blades may radially extend from an outer circumferential surface of the first hub 1511 and be formed in a spiral shape along the axis. Accordingly, refrigerant axially drawn in through the first intake port 1121 of the first impeller housing 112 moves toward the first diffuser 1513 as it is wound in a spiral form while passing through the first blade 1512 of the first impeller 151. This further increases a flow velocity of the refrigerant passing through the first diffuser 1513, thereby further increasing a first pressure at the first compression part 150.

The first shroud 1513 may be formed to cover an outer side of the first blade 1512. For example, the first shroud 1513 may be formed in the shape of a hollow cylinder, that is, in the shape of a truncated cone so as to correspond to an imaginary shape connecting to the outer side of the first blade 1512.

The first shroud 1513 may be formed to extend integrally from an outer side of the first blade 1512 by 3D printing or powder metallurgy, or may be manufactured separately and post-assembled. This embodiment is illustrated with an example in which the first shroud 1513 is post-assembled and welded. Although not shown, the first shroud 1513 may cover only part of the first blade 1512 or be formed on a current side rather than on the first blade 1512.

Referring to FIGS. 4 and 5, the first shroud 1513 may include a first entrance portion 1513*a* and a first exit portion 1513*b*. The first entrance portion 1513*a* may be formed in the shape of a cylinder which has a single diameter, and the first exit portion 1513*b* may be formed in the shape of a cone which has multiple diameters. A first end of the first exit portion 1513*b* may be connected to a second end of the first entrance portion 1513*a* and formed integrally with it.

Inner and outer peripheries of the first entrance portion 1513*a* may be formed in the shape of a smooth tube. However, the above-described first inner sealing portion 1552 constituting the first intake sealing portion 155 may be formed on an outer circumferential surface of the first entrance portion 1513*a*.

The first inner sealing portion 1552 may be formed from an annular sealing projection, and the annular sealing projection may consist of at least one annular sealing projection, for example, a plurality of annular sealing projections arranged at predetermined intervals along the axis. Accordingly, the annular sealing projection of the first inner sealing protion1 552 may be inserted into an annular sealing groove of the above-described first outer sealing portion 1551, thereby forming an axial labyrinth seal.

Inner and outer peripheries of the first exit portion 1513*b* may be formed in the shape of a smooth tube. However, in some cases, an annular sealing projection like the above-described first inner sealing portion 1552 may be formed on the outer circumferential surface of the first exit portion 1513*b*. In this case, an annular sealing groove like the above-described first outer sealing portion 1551 may be formed on the inner circumferential surface of the impeller receiving portion 1122 of the first impeller housing 112 facing the first exit portion 1513*b*. In this case, the first inner sealing portion 1552 and the first outer sealing portion 1551 may be angled with respect to the axis, thereby forming an angled labyrinth seal. Accordingly, leakage of a refrigerant drawn into the first impeller 151 through a gap between the first impeller 151 and the first impeller housing 112 may be prevented more effectively.

Referring to FIG. 4 and FIG. 6, the second compression part 160 according to this embodiment includes a second impeller 161, a second diffuser 1133, and a second volute 1134. A description of the second diffuser 1133 and the second volute 1134, among the components of the second compression part 160, is identical to what has been described above with respect to the second impeller housing 113. That is, the second diffuser 1133 may be formed between the second impeller housing 113 and the second bearing shell 146, and the second volute 1134 may be formed on the second impeller housing 113. Thus, the second compression part will be described hereinafter focusing on the second impeller 161.

The second impeller 161 includes a second hub 1611, a second blade 1612, and a second shroud 1613. As described previously, the second impeller 161, together with the second diffuser 1133 and the second volute 1134, form a two-stage compression part in a functional sense. Accordingly, an intake side of the second impeller 161 may be connected to a discharge side of the first impeller 151 by the refrigerant connecting pipe 116, and a discharge side of the second impeller 161 may be connected to an inlet side of the condenser 20 by a refrigerant discharge pipe 117.

Although the second impeller 161 is made smaller than a diameter of the first impeller 151, its overall shape is almost identical to that of the first impeller 151. Accordingly, description of the shape of the second impeller 161 will be replaced with the description of the first impeller 151. However, no sealing portion is formed on the second side of the second impeller 161, unlike the first impeller 151, as the second discharge sealing portion 166 is formed between the second bearing shell 146 and the rotary shaft 130.

Referring to FIGS. 2 to 6, the refrigerant passage portion 170 according to this embodiment includes an inlet passage portion (inlet passage) 171, an outlet passage portion (outlet passage) 172, and a connecting passage (connecting passage) portion 173. The inlet passage portion 171 is a passage that directs refrigerant from the refrigeration cycle apparatus to the motor chamber 1114 of the motor housing 111, the outlet passage portion 172 is a passage through which the refrigerant in the motor chamber 114 leaves the motor housing 111, and the connecting passage portion 173 is a passage that directs the refrigerant from the motor housing 111 to the second compression part 160 or the first compression part 150 depending on an operation mode.

The inlet passage portion 171 may include a first inlet passage portion (first inlet passage) 171 and a second inlet passage portion (second inlet passage) 1715. The first inlet passage portion 1711 is a passage that directs refrigerant to the first chamber 1114*a* of the motor housing 1114*a*, and the second inlet passage portion 1715 is a passage that directs refrigerant to the second chamber 1114*b* of the motor housing 111. Thus, the first inlet passage portion 1711 and the second inlet passage portion 1715 may include a parallel pipeline in which multiple exits branch off from a single entrance, or a serial pipeline having respective inlets and outlets. This embodiment will be described with respect to the parallel pipeline.

For example, an entrance end of the first inlet passage portion 1711 and an entrance end of the second inlet passage portion 1715 may be separated at the exit of the condenser 20 and connected in parallel, and an exit end of the first inlet passage portion 1711 may be connected to the first chamber 1114*a* of the motor housing 111, and an exit end of the second inlet passage portion 1715 may be connected to the second chamber 1114*b* of the motor housing 111. Accordingly, liquid refrigerant passed through the condenser 20 may be injected into the first chamber 1114*a* through the first inlet passage portion 1711 and into the second chamber 1114*b* through the second inlet passage portion 1715, respectively.

Referring to FIGS. 4 and 5, the first inlet passage portion 1711 may include a first refrigerant inlet pipe 1712, a first refrigerant inlet 1713, and a refrigerant intake passage 1714. One (first) end of the first refrigerant inlet pipe 1712, together with a second refrigerant inlet pipe 1716 described hereinafter, may be branched midway through the refrigeration cycle apparatus, that is, at the exit of the condenser 20, and the other (second) end may be inserted into and coupled to the first refrigerant inlet 1713 which penetrates a space between the outer and inner peripheries of the motor housing 111 constituting the first chamber 1114*a* of the motor chamber 1114.

The first refrigerant inlet pipe 1712 may be made smaller or larger than the inner diameter of a refrigerant circulation pipe constituting the refrigerant cycle apparatus, the refrigerant circulation pipe being positioned between the condenser 20 and the expander 30. Thus, it is possible to prevent a refrigerant circulating through the refrigerant cycle apparatus from entering the motor housing 111 of the compressor 10 in excessive amounts.

One end of the first refrigerant inlet 1713 may be connected to the first refrigerant inlet pipe 1712, and the other end of the first refrigerant inlet 1713 may be connected to the refrigerant intake passage 1714. Therefore, the first refrigerant inlet pipe 1712 and the first refrigerant inlet 1713 may communicate with the first chamber 1114*a* of the motor housing 111.

For example, an entrance end of the refrigerant intake passage 1714 may be open to the outer circumferential surface of the first bearing shell 142, in a position where it at least partially overlaps the first bearing shell 142 in the radial direction, and the other end of the refrigerant intake passage 1714 may be open to the second side 142*b* of the first bearing shell 142 facing the thrust runner 1324. Accordingly, refrigerant introduced into the refrigerant intake passage 1714 through the first refrigerant inlet pipe 1712 and the first refrigerant inlet 1713 cools the first bearing shell 142 while passing through the inside of the first bearing shell 142. Thus, it is possible to prevent overheating of the first radial bearing 143 and first axial bearing 1441 provided on the first bearing shell 142.

The refrigerant intake passage 1714 may be formed in the shape of a single hole whose inner diameter between two ends is almost the same. This makes easy formation of the refrigerant intake passage 1714, and allows for quick injection of refrigerant into a desired position in the bearing receiving space 1114*a*2.

The exit end of the refrigerant intake passage 1714 may be open to the second side 142*b* of the first bearing shell 142, and the refrigerant intake passage 1714 may be formed in such a way that its exit end is positioned within the range of the radius of the thrust runner 1324. For example, the exit end of the refrigerant intake passage 1714 may be formed in a position where it at least partially overlaps the first gap G1 in the axial direction, which is formed between the inner circumferential surface of the motor housing 111 and the outer circumferential surface of the thrust runner 1324 radially facing that inner circumferential surface, but does not overlap the first axial bearing 1441 in the axial direction.

In other words, the exit end of the refrigerant passage 1714 may be positioned outside the range of the radius of the first axial bearing 1441. Accordingly, refrigerant injected into the bearing receiving space 1114*a*2 is supplied to the outer circumferential surface of the first axial bearing 1441, and this refrigerant passes through the inside of the first axial bearing 1441, from the outer circumferential surface to the inner circumferential surface, thereby enabling the first axial bearing 1441 to provide uniform bearing force.

Moreover, the first inlet passage portion 1711 may be larger than or the same size as the second inlet passage portion 1715. In other words, the cross-sectional area of the pipeline of the first inlet passage portion 1711 may be equal to the cross-sectional area of the pipeline of the second inlet passage portion 1715, or the cross-sectional area of the pipeline of the first inlet passage portion 1711 may be larger than the cross-sectional area of the pipeline of the second inlet passage portion 1715.

For example, an inner diameter of the first refrigerant inlet pipe 1712 constituting the first inlet passage 1711 or an inner diameter of the first refrigerant inlet 1713 may be larger than an inner diameter of the second refrigerant inlet pipe 1716 constituting the second inlet passage portion 1715 described hereinafter or an inner diameter of a second refrigerant inlet port 1717. Consequently, a large amount of liquid refrigerant may be introduced toward the first chamber 1114*a*, more precisely, toward the bearing receiving space 1114*d*2, so that the different bearings 143, 1441, and 1442 received in the bearing receiving space 1114*d*2 operate more quickly and are cooled.

Referring to FIGS. 4 and 6, the second inlet passage portion 1715 may include the second refrigerant inlet pipe 1716 and the second refrigerant inlet port 1717. One (first) end of the second refrigerant inlet pipe 1716, together with the first refrigerant inlet pipe 1712, may be branched midway through the refrigeration cycle apparatus, and the other (second) end may be inserted into and coupled to the second refrigerant inlet port 1717 which penetrates the space between the outer and inner peripheries of the motor housing 111 constituting the second chamber 1114*b* of the motor chamber 1114.

The second refrigerant inlet pipe 1716 may be made smaller or larger than the inner diameter of the refrigerant circulation pipe constituting the refrigeration cycle device. Thus, it is possible to prevent refrigerant circulating through the refrigeration cycle device from entering the motor housing 111 of the compressor 10 in excessive amounts.

The second refrigerant inlet port 1717 may be formed to lie on roughly a same axial line as the first refrigerant inlet 1713. Accordingly, the first refrigerant inlet 1713 and the second refrigerant inlet port 1717 are positioned farthest away from a refrigerant outlet port 1721 described hereinafter, so that refrigerant may stay for a long time in the first chamber 1114*a* and second chamber 1114*b* of the motor chamber 1114, thereby effectively cooling the bearings and the motor part.

Although not shown, the inlet passage portion 171 may be made up of one inlet passage portion. In this case, the inlet passage portion 171, like the above-described first inlet passage portion 1711, may be formed to communicate with the first chamber 1114*a* of the motor chamber 1114, as the axial bearings 1441 and 1442 are provided in the first chamber 1114*a*.

Referring to FIGS. 4 and 6, the outlet passage portion 172 includes a refrigerant outlet port 1721 and a refrigerant outlet pipe 1722. The refrigerant outlet port 1721 may be formed by penetrating the space between the inner and outer peripheries of the motor housing 111 in the second chamber 1114*b* of the motor chamber 1114. The refrigerant outlet port 1721 may be formed in the circumferential direction, in a position spaced apart from the second refrigerant inlet port 1717—for example, in a position where it has a phase difference of around 180° from the second refrigerant inlet port 1717. Accordingly, the refrigerant outlet port 1721 is positioned farthest away from the second refrigerant inlet port 1717 in the circumferential direction, so that a refrigerant introduced into the second chamber 1114*b* stays for a long time in the second chamber 1114*b*, thereby effectively cooling the motor part and the second radial bearing 147.

One (first) end of the refrigerant outlet pipe 1722 may be inserted into and coupled to the refrigerant outlet port 1721, and the other (second) end of the refrigerant outlet pipe 1722 may be connected to the intake side of the first compression part 150 or the intake side of the second compression part 160 through a refrigerant control valve 1733 described hereinafter. Although not shown, the other end of the refrigerant outlet pipe 1722 may be connected to the refrigerant circulation pipe of the refrigeration cycle device. For example, the other end of the refrigerant outlet pipe 1722 may be connected to a space (hereinafter, first position) between an exit of the expander 30 and an entrance of the evaporator 40 or to a space (hereinafter, second position) between an exit of the evaporator and an entrance (first intake port) of the compressor. In these cases, however, it may be desirable that the refrigerant outlet pipe 1722 is connected to the second position rather than the first position, because a refrigerant passed through the motor chamber 1114 turns from liquid refrigerant to gaseous refrigerant.

Referring to FIG. 4, the connecting passage portion 173 according to this embodiment includes a first connecting pipe 1731, a second connecting pipe 1732, a refrigerant control valve 1733, and a valve control portion 1734. The first connecting pipe 1731 may be connected to the outlet passage portion 172 and the intake side of the second compression part 160, and the second connecting pipe 1732 may be connected between the outlet passage portion 172 and the intake side of the first compression part 150.

More specifically, the first connecting pipe 1731 may be connected between the refrigerant outlet pipe 1722 and the refrigerant connecting pipe 116, and the second connecting pipe 1732 may be connected midway between the refrigerant outlet pipe and the refrigerant intake pipe. Thus, refrigerant discharged through the refrigerant outlet pipe 1722 may move to the intake side of the second compression part 160 through the first connecting pipe 1731 or move to the intake side of the first compression part 150 through the second connecting pipe 1732. In other words, during a high-load operation, refrigerant supplied to the motor chamber 1114 through the inlet passage portion 171 may move to the second compression part 160 and be compressed in a second stage, and during a low-load operation, may move to the first compression part 150 and lower the cooling force of the first compression part 150.

The refrigerant control valve 1733 may be installed at a point where the refrigerant outlet pipe 1722, the first connecting pipe 1731, and the second connecting pipe 1732 meet. For example, the refrigerant control valve 1733 may be configured as a 3-way valve, and the other end of the refrigerant outlet pipe may be connected to a first opening of the refrigerant control valve 1733, one end of the first connecting pipe 1731 may be connected to a second opening, and one end of the second connecting pipe 1732 may be connected to a third opening.

An opening and closing direction of the refrigerant control valve 1733 may be controlled by the valve control portion 1734 described hereinafter. For example, the high-load operation may be controlled such that the space between the refrigerant outlet pipe 1722 and the first connecting pipe 1731 is opened and the space between the refrigerant pipe 1722 and the second connecting pipe 1732 is closed, and the low-load operation may be controlled such that the space between the refrigerant outlet pipe 1722 and the second connecting pipe 1732 is opened and the space between the refrigerant pipe 1722 and the first connecting pipe 1731 is closed.

Although not shown, the refrigerant control valve 1733 may be installed midway through the refrigerant outlet pipe 1722, midway through the first connecting pipe 1731, and midway through the second connecting pipe 1732, separately. In this case, the refrigerant control valve 1733 may be configured as a 2-way valve, and the direction of refrigerant flow depending on load is the same as in the previous embodiment.

Referring to FIGS. 1 and 4, the valve control portion 1734 may select whether to discharge refrigerant injected into the motor housing 111 midway through the refrigerant cycle apparatus to the intake side of the second compression part 160 or to the intake side of the first compression part 150, and may include a measurement portion 1734*a* and a control portion 1734*b*. The measurement portion 1734*a* may include a pressure sensor, a temperature sensor, and a flow rate sensor so as to measure a state of the refrigerant—for example, a pressure P, a temperature T, and a heat quantity Q of the refrigerant.

The control portion 1734*b* may calculate a change AQ in flow of refrigerant supplied to the motor chamber 1114 of the motor housing 111 through the inlet passage portion 171, calculate a range of operation based on the change in flow to determine whether a required load is out of a range of operation, and control the refrigerant control valve 1733 so as to fix the refrigerant control valve 1733 if the required load is within the range of operation or to adjust the flow based on the required load if the required load is out of the range of operation.

The above-described turbo compressor according to this embodiment operates as follows.

That is, when power is applied to the motor part 120, a torque is generated by an inductive current between the stator 121 and the rotor 122, and the rotary shaft 130 rotates together with the rotor 122 by this torque. Then, the torque from the motor part 120 is transferred to the first impeller 151 and the second impeller 161 by the rotary shaft 130, and the first impeller 151 and the second impeller 161 rotate simultaneously in their respective impeller receiving portions 1122 and 1232.

Then, refrigerant passed through the evaporator 40 of the refrigerant cycle apparatus is introduced into the first impeller receiving portion 1122 through the refrigerant intake pipe 115 and the first inlet port 1121, and this refrigerant moves while whirling around the first blade 1512 of the first impeller 151, which increases static pressure and at the same time causes the refrigerant to pass through the first diffuser 1123 with a centrifugal force.

Then, the kinetic energy of the refrigerant passing through the first diffuser 1123 leads to an increase in pressure head by the centrifugal force in the diffuser 1123, and the centrifugally compressed, high-temperature, high-pressure refrigerant is collected in the first volute 1124 and discharged from the first compression part 150 through the first discharge port 1125.

The refrigerant discharged from the first compression part 150 is directed to the second intake port 1131 of the second impeller housing 113 constituting the second compression part 160 through the refrigerant connecting pipe 116, and this refrigerant moves while whirling around the second blade 1612 of the second impeller 161, which increases the static pressure again and at the same time causes the refrigerant to pass through the second diffuser 113 with a centrifugal force. Then, the refrigerant passing through the second diffuser 1133 is compressed to a desired pressure by centrifugal force, and the second-stage compressed, high-temperature, high-pressure refrigerant repeats a sequence of processes in which it is collected in the second volute 1134 and discharged to the condenser 20 through the second discharge port 1135 and the refrigerant discharge pipe 117.

In this instance, the first impeller 151 and the second impeller 161 are subjected to a thrust force, which the refrigerant drawn in through the first inlet port 1121 and the second inlet port 1131 of the impeller housings 112 and 113 exerts to push the impellers 151 and 161 backward. However, in the case of a so-called both-end type turbo compressor in which the first impeller 151 and the second impeller 161 are disposed against each other, a thrust generated from the first impeller 151 and a thrust generated from the second impeller 161 may cancel each other because they act in opposite directions.

Nonetheless, even in the case of such a both-end type turbo compressor, a thrust generated from the first compression part 150 and a thrust generated from the second compression part 160 may not be equal or constant. Due to this, the rotary shaft 130 may be axially pushed toward the first compression part 150 or the second compression part 160, and in ordinary circumstances, the axial bearings 1441 and 1442 may be installed on the first compression part 150 or/and the second compression part 160.

Moreover, the radial bearings 143 and 147 may be provided inside the housing 110 and support the rotary shaft 130 radially with respect to the housing 110. The radial bearings 143 and 147 may be provided on opposite axial sides of the rotary shaft 130—that is, on the first compression part 150 and the second compression part 160.

High-temperature friction heat is generated between the above-described axial bearings 1441 and 1442 and radial bearings 143 and 147 and the rotary shaft 130 as the rotary shaft 130 rotates at high speed (approximately, 40,000 rpm). Also, the motor part 120 creates a high-speed torque, thereby generating high-temperature motor heat. Accordingly, the motor chamber 1114 of the motor housing 111 may be overheated due to friction heat and motor heat, which may lower compressor performance. In view of this, a separate cooling fluid, other than the above-described refrigerant, may be supplied to the motor housing 111 to cool the heat generated from the motor chamber 1114, or as explained previously, a part or portion of the refrigerant passed through the condenser 20 may be supplied to the motor housing 111 to cool the heat generated from the motor chamber 1114.

In this embodiment, one (first) end of the first refrigerant inlet pipe 1712 and one (first) end of the second refrigerant inlet pipe 1716 may be connected in parallel to the exit of the condenser 20, and the other (second) end of the first refrigerant inlet pipe 1712 and the other (second) end of the second refrigerant inlet pipe 1716 may be connected respectively to the first refrigerant inlet 1713 and second refrigerant inlet pipe 1716 penetrating the motor housing 111 and communicate respectively with the first chamber 1114*a* and second chamber 1114*b* constituting the motor chamber 1114.

Accordingly, liquid refrigerant passed through the condenser 20 may be injected into the first chamber 1114*a* and the second chamber 1114*b*, and this refrigerant evaporates by exchanging heat with the bearings 143, 147, 1441, and 1442 provided in the first chamber 1114*a* and the second chamber 1114*b*, thereby cooling these bearings and the motor part.

For example, a part or portion of liquid refrigerant introduced into the first chamber 1114*a*, more specifically, the bearing receiving space 1114*a*2, through the first refrigerant inlet pipe 1713 passes through the second gap G2 which is formed between the first side 1324*a* of the thrust runner 1324 and the second side 142*b* of the first bearing shell 142 facing it. In this instance, the refrigerant cools the first axial bearing 1441, the second side 142*b* of the first bearing shell 142 facing the first axial bearing 1441, and the first side 1324*a* of the thrust runner 1324, while moving from the outer circumferential surface of the first axial bearing 1441 to the inner circumferential surface thereof.

Moreover, a part or portion of liquid refrigerant introduced into the first chamber 1114*a*, more specifically, the bearing receiving space 1114*a*2, through the first refrigerant inlet pipe 1713 passes through the second gap G2 which is formed between the second side 1324*b* of the thrust runner 1324 and the first side 1115*a* of the bearing support portion 1115 facing it. In this instance, the refrigerant cools the second axial bearing 1442, the first side 1115*a* of the bearing support portion 1115 facing the second axial bearing 1442, and the second side 1324*b* of the thrust runner 1324, while moving from the outer circumferential surface of the second axial bearing 1442 to the inner circumferential surface thereof.

In addition, a part or portion of the refrigerant introduced into the second gap G2 is introduced into the fourth gap G4 provided between the first shaft hole 142*c* of the first bearing shell 142 and the rotary shaft, and serves as a working fluid for the first radial bearing 143 provided in the fourth gap G4 and at the same time cools the first radial bearing 143 and the rotary shaft 130.

Also, another part or portion of the liquid refrigerant which is introduced into the bearing receiving space 1114*a*2 moves toward the second axial bearing 1442 through the first gap G1 formed between the inner circumferential surface of the motor housing 111 and the outer circumferential surface of the thrust runner 1324, and this refrigerant moves from the outer circumferential surface of the second axial bearing 1442 to the inner circumferential surface thereof and cols the second axial bearing 1442, the second side 1324*b* of the thrust runner 1324 facing the second axial bearing 1442, and the first side 1115*a* of the bearing support portion 1115.

This refrigerant moves to the motor receiving space 1114*a*1 of the first chamber 1114*a* through the first through hole 1115*c* and refrigerant through hole 1115*d* provided in the bearing support portion 1115, and this refrigerant axially passes through a gap (not shown) in the motor part 120 and moves to the second chamber 1114*b*. In this instance, the motor part 120 makes contact with the refrigerant passing through the gap in the motor part 120 and the refrigerant introduced into the second chamber 1114*b*.

A part or portion of the refrigerant that has moved to the second chamber 1114*b*, together with a part or portion of the refrigerant supplied to the second chamber 1114*b* through the second refrigerant inlet pipe 1716 and the second refrigerant inlet port 1717, is introduced into the second shaft hole 146*c* of the second bearing shell 146, and this refrigerant serves as a working fluid for the second radial bearing 147 and at the same time cools the second radial bearing 147 and the rotary shaft 130.

The refrigerant introduced into the second chamber 1114*b* circulates through the second chamber 1114*b* and then leaves the motor housing 111 through the refrigerant outlet port 1721 and the refrigerant outlet pipe 1722, and this refrigerant may be supplied to the intake side of the second compression part 160 or the intake side of the first compression part 150 through a pipeline to which the refrigerant outlet pipe 1722 is connected via the refrigerant control valve 1733. In this instance, the valve control portion 1734 may improve compression efficiency by performing a load-dependent operation in which the opening and closing direction of the refrigerant control valve 1733 is controlled in real time.

Figure 8:
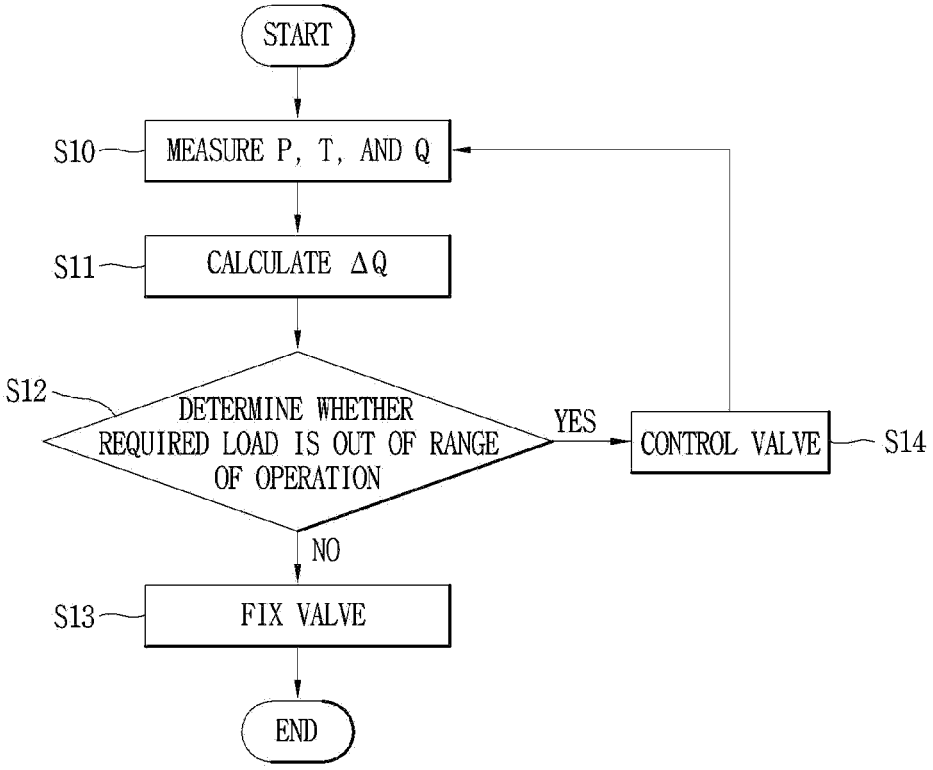
FIG. 8 is a flowchart illustrating a process of controlling a direction of flow of refrigerant in a turbo compressor according to an embodiment.

Referring to FIGS. 1 and 8, the measurement portion 1734*a* measures the pressure P, temperature T, and heat quantity Q of the refrigerant. The control portion 1734*b* may calculate a change AQ in flow which has occurred when refrigerant is additionally supplied to the first compression part 150 or the second compression part 160, based on the values measured by the measurement portion 1734*a* (S11), calculates the range of operation based on the change in flow to determine whether a required load is out of the range of operation (S12), and fixes the opening and closing direction of the refrigerant control valve 1733 if the required load is within the range of operation (S13), or adjusts the opening and closing direction of the refrigerant control valve 1733 to control the flow based on the required load if the required load is out of the range of operation (S14).

Figure 7A:
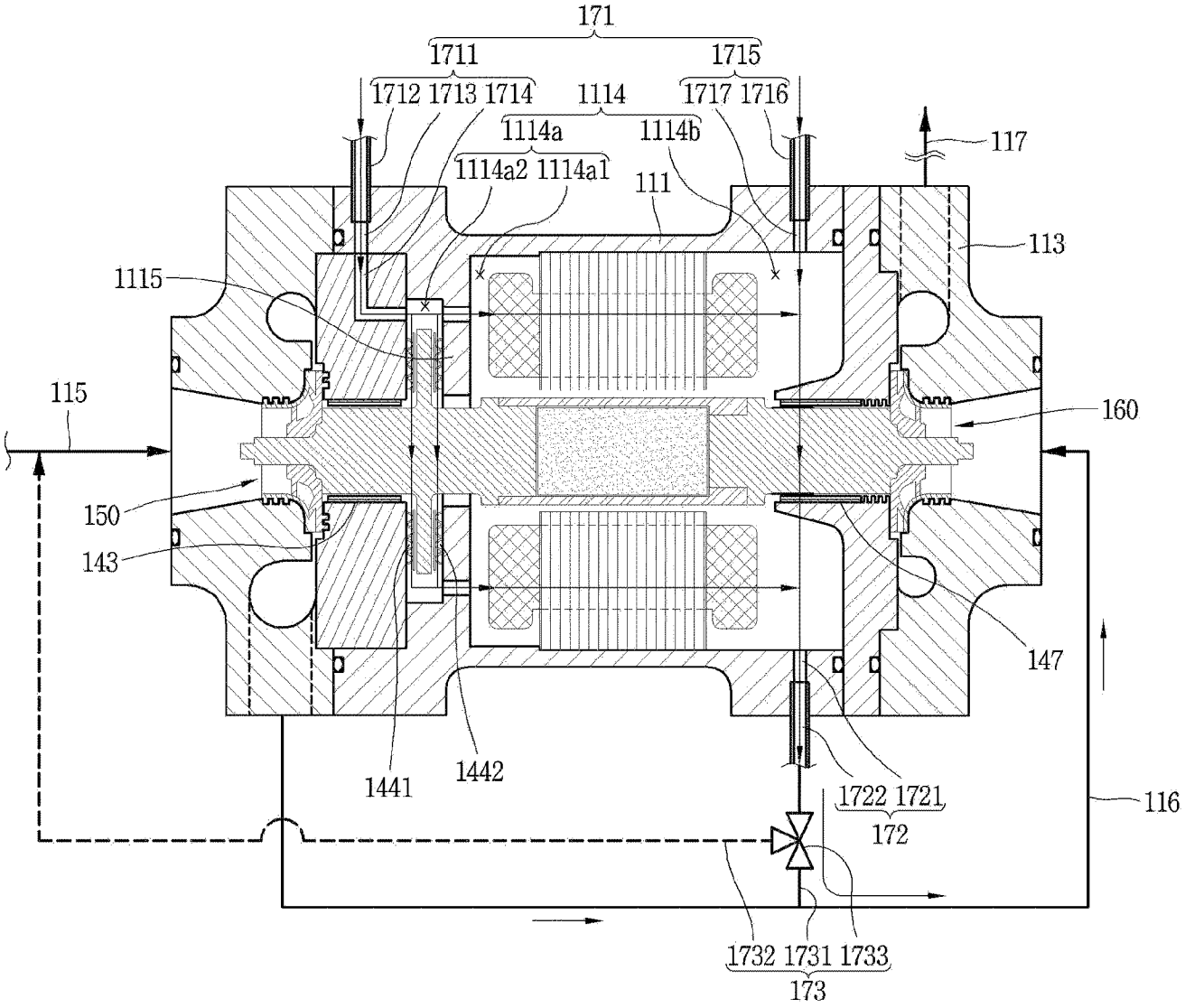
FIGS. 7A and 7B are schematic views depicting a refrigerant flow for each operation mode in a turbo compressor according to an embodiment.
Figure 7B:
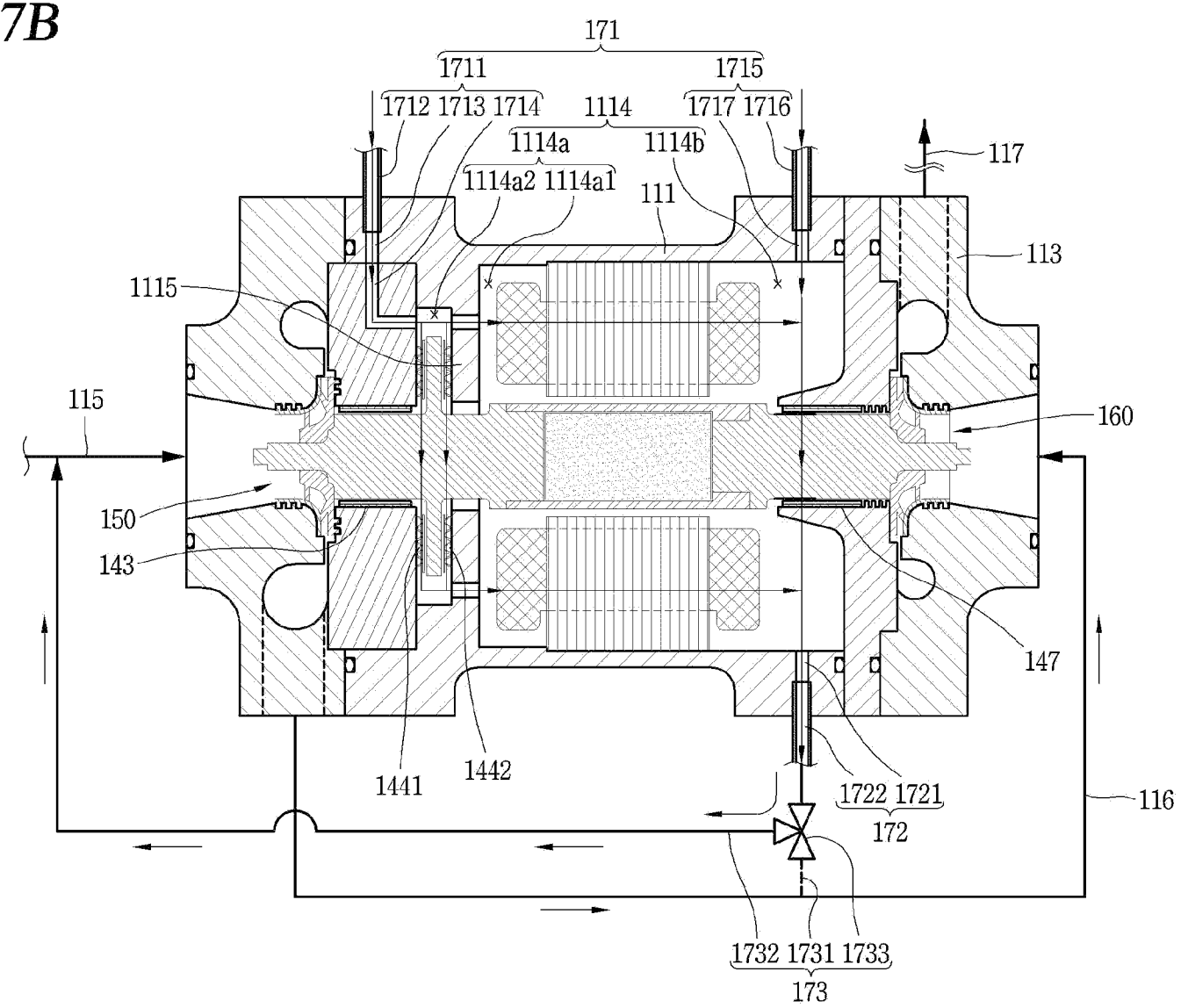

For example, during a high-load operation, the refrigerant control valve 1733 may be opened to the first connecting pipe 1731 to supply refrigerant passed through the motor housing 111 to the second compression part 160, as shown in FIG. 7A. The refrigerant passed through the motor housing 111 has a lower refrigerant temperature than the refrigerant compressed in the first stage in the first compression part 150. Then, the temperature of the refrigerant introduced into the second compression part 160 is lowered, thereby increasing the amount of refrigerant intake, and at the same time, energy required to run the second compression part 160 may be reduced, thereby improving compression efficiency.

However, the flow of refrigerant supplied to the second compression part 160 may be properly adjusted depending on the situation. For example, a minimum flow for running the compressor may be supplied in a surging state, and a possible maximum flow may be supplied in a choking state. For this, the opening or closing direction of the refrigerant control valve 1733 or/and the opening degree thereof may be controlled by a control method for the above-described valve control portion 1734.

On the other hand, during a low-load operation, the refrigerant control valve 1733 may be opened toward the second connecting pipe 1732 to supply refrigerant passed through the motor housing 111 toward the first compression part 150. The refrigerant passed through the motor housing 111 has a higher temperature than an intake refrigerant drawn into the first compression part 150. This increases the temperature of the intake refrigerant and causes an intake loss, thereby reducing the cooling force of the compressor to an appropriate level. In this case, too, the opening and closing direction or/and opening amount of the refrigerant control valve 1733 may be controlled by a control method for the above-described valve control portion 1734.

Another example of a refrigerant passage will be described hereinafter. That is, in the previous embodiment, the outer circumferential surface of the rotary shaft is blocked, whereas the refrigerant passage in this embodiment may be formed by penetrating the outer circumferential surface of the rotary shaft.

Figure 9:
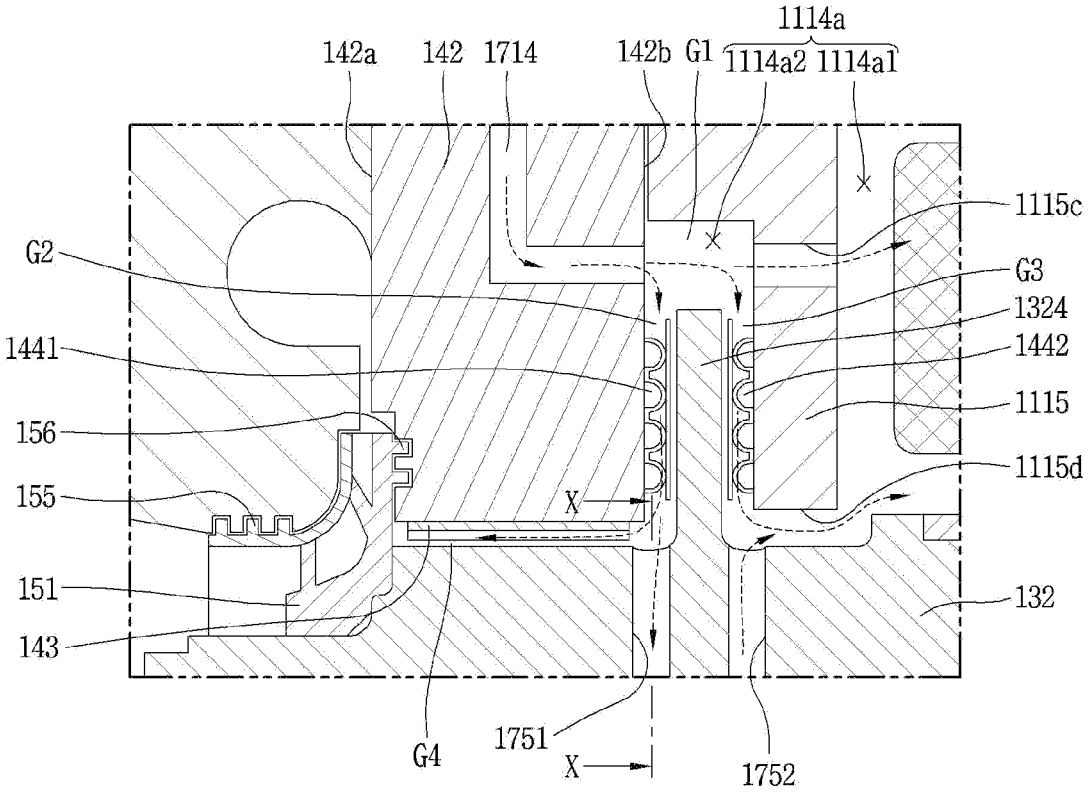
FIG. 9 is a cross-sectional view showing an example of a refrigerant passage according an embodiment.
Figure 10:
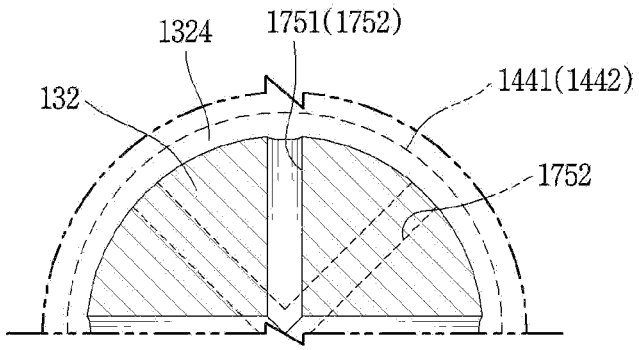
FIG. 10 is a cross-sectional view, taken along line "X-X" of FIG. 9.

FIG. 9 is a cross-sectional view showing an example of a refrigerant passage according to an embodiment. FIG. 10 is a cross-sectional view taken along the line "X-X" of FIG. 9.

Referring to FIG. 9 and FIG. 10, the refrigerant intake passage 1714 according to an embodiment may be formed in such a way as to penetrate the second side 142*b* of the first bearing shell 142 on the outer circumferential surface of the first bearing shell 142, as in the previous embodiments, and the exit of the refrigerant intake passage 1714 may be formed in a position where it overlaps the first gap G1 which is formed between the outer circumferential surface of the thrust runner 1324 and the inner circumferential surface of the motor housing 111. Description of the refrigerant intake passage 1714 will be replaced with the description of the refrigerant intake passage in the previous embodiments.

However, in this embodiment, at least one refrigerant passage 1751 and 1752 may be formed through the outer circumferential surface of the first impeller shaft portion 132 constituting the rotary shaft 130. Accordingly, even if the exit of refrigerant intake passage 1714 is opened toward the bearing receiving space 1114*a*2 beyond the range of the thrust runner 1324, refrigerant may be uniformly spread between the second side 142*b* of the first bearing shell 142 constituting an axial bearing surface and the first side 1324*a* of the thrust runner 1324.

More specifically, the refrigerant passage 1751 may be formed in a position where at least a part or portion of it radially overlaps the second gap G2 between the second side 142*b* of the first bearing shell 142 and the first side 1324*a* of the thrust runner 1324, or/and in a position where at least a part or portion of it radially overlaps the third gap G3 between the first side 1115*a* of the bearing support portion 1115 and the second side 1324*b* of the thrust runner 1324. In this embodiment, an example is illustrated in which the first refrigerant passage 1751 is formed in a position where it overlaps the second gap G2, and the second refrigerant passage 1752 is formed in a position where it overlaps the third gap G3. In this case, the first refrigerant passage 1751 and the second refrigerant passage 1752 may be formed separately, and the first refrigerant passage 1751 and the second refrigerant passage 1752 may communicate with each other.

For example, as in FIGS. 9 and 10, the first refrigerant passage 1751 and the second refrigerant passage 1752 may be formed to radially penetrate opposite axial sides, respectively, with the thrust runner 1324 interposed in between. In this case, the refrigerant in the second gap G2 moves only in the second gap G2 through the first refrigerant passage 1751, and the refrigerant in the third gap G3 moves only in the third gap G3 through the second refrigerant passage 1752. In other words, the second gap G2 and the third gap G3 form separate refrigerant passages.

Moreover, only one first refrigerant passage 1751 and only one second refrigerant passage 1752 may be formed, or a plurality of them may be formed at predetermined intervals along the circumference, as in this embodiment. In the case where a plurality of first refrigerant passages 1751 and a plurality of second refrigerant passages 1752 are formed, the first refrigerant passages 1751 and the second refrigerant passages 1752 may be formed on the same axial line because of workability, or may be formed on different axial lines by taking into account the rigidity of the rotary shaft 130, as shown in FIG. 10.

A cross-sectional area of the first refrigerant passage 1751 may be larger than or equal to the second gap G2, and a cross-sectional area of the second refrigerant passage 1752 may be larger than or equal to the third gap G3. Accordingly, refrigerant passed through the second gap G2 or/and the third gap G3 may smoothly pass through the first refrigerant passage 1751 and the second refrigerant passage 1752.

As described above, in the case where the first refrigerant passage 1751 and the second refrigerant passage 1752 are formed on the rotary shaft 130, even if the exit of the refrigerant intake passage 1714 is formed further on the outer peripheral side than the first axial bearing 1441 or the second axial bearing 1442, refrigerant introduced into the second gap G2 or/and the third gap G3 through the refrigerant intake passage 1714 may quickly move farther from the refrigerant intake passage 1714 through the first refrigerant passage 1751 or/and the second refrigerant passage 1752. Accordingly, the first axial bearing 1441 and the second axial bearing 1442, which are formed from a gas foil bearing, may acquire bearing force quickly and uniformly, and at the same time, the first axial bearing 1441 and the second axial bearing 1442 and the thrust runner 1324 of the corresponding rotary shaft 130 may be quickly cooled.

In addition, refrigerant may move actively without getting sluggish in the second gap G2 or/and the third gap G3, thereby making a part or portion of the refrigerant to quickly enter the first shaft hole 142*c* of the first bearing shell 142 constituting the fourth gap G4. Accordingly, the first radial bearing 143 provided in the first shaft hole 142*c* of the first bearing shell 142 is able to acquire bearing force quickly and uniformly, and at the same time, the first radial bearing 143 and the first impeller shaft portion 132 of the rotary shaft 130 may be quickly cooled.

Yet another embodiment of a refrigerant passage will be described hereinafter. That is, in the previous embodiment, the first refrigerant passage and the second refrigerant passage may be formed separately, but in some cases, the first refrigerant passage and the second refrigerant passage may communicate with each other.

Figure 11:
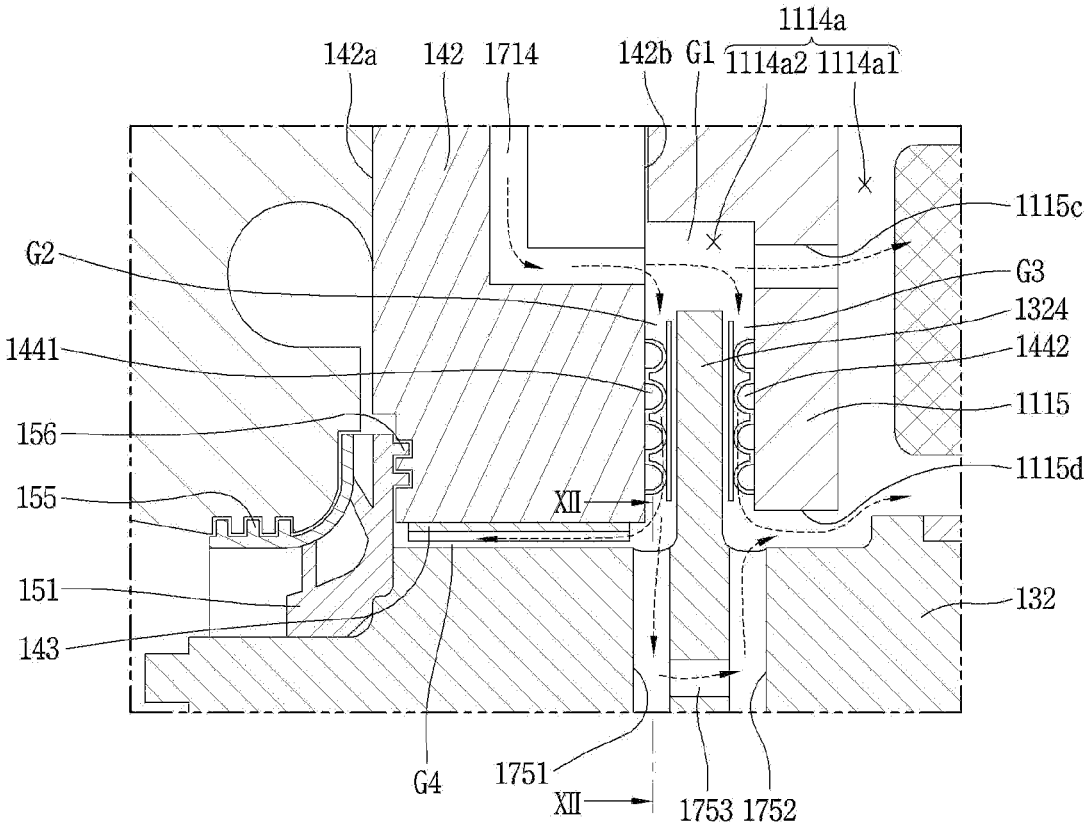
FIG. 11 is a cross-sectional view showing another example of a refrigerant passage according to an embodiment.
Figure 12:
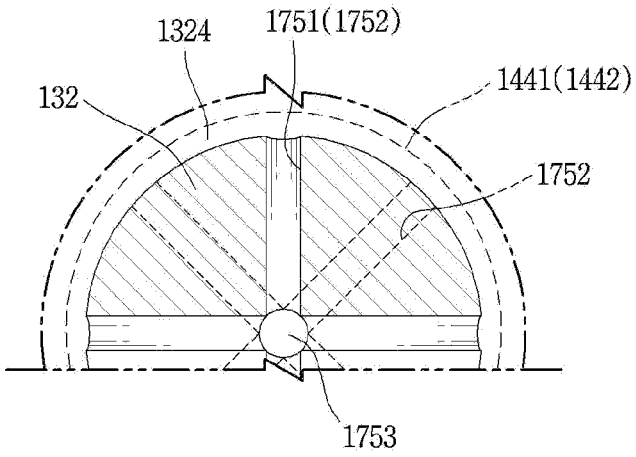
FIG. 12 is a cross-sectional view, taken along line "XII-XII" of FIG. 11.

FIG. 11 is a cross-sectional view showing another example of a refrigerant passage according to an embodiment. FIG. 12 is a cross-sectional view, taken along line "XI-XI" of FIG. 11.

Referring to FIG. 11 and FIG. 12, a first refrigerant passage 1751, a second refrigerant passage 1752, and a third refrigerant passage 1753 may be formed on a rotary shaft according to an embodiment. The first refrigerant passage 1751 and the second refrigerant passage 1752 are penetrated radially on opposite sides, with the thrust runner 1324 interposed in between, as is with the previous embodiment. Thus, description of this will be replaced with the description of the previous embodiment.

However, in this embodiment, the first refrigerant passage 1751 and the second refrigerant passage 1752 may communicate with each other through the third refrigerant passage 1753 which axially penetrates them. For example, the third refrigerant passage 1753 may be formed by axially penetrating the inside of the rotary shaft 130 between the first refrigerant passage 1751 and the second refrigerant passage 1752.

A cross-sectional area of the third refrigerant passage 1753 may be larger than or equal to a cross-sectional area of the first refrigerant passage 1751 or/and a cross-sectional area of the second refrigerant passage 1752. Accordingly, refrigerant communication between the first refrigerant passage 1751 and the second refrigerant passage 1752 may be done smoothly through the third refrigerant passage 1753.

As described above, in the case where the first refrigerant passage 1751 and the second refrigerant passage 1752 communicate with each other through the third refrigerant passage 1753, even if the first refrigerant passage 1751 and the second refrigerant passage 1752 are positioned at different distances from the exit of the refrigerant intake passage 1714, differences in the amount of refrigerant supplied to the second gap G2 and the third gap G3 may be minimized. Thus, the first axial bearing 1441 and the second axial bearing 1442 may maintain uniform bearing force, and at the same time, may effectively cool frictional force in these bearings 1441 and 1442.

Although not shown, the third refrigerant passage may be formed by penetrating between the first side 1324*a* and second side 1324*b* of the thrust runner 1324. In this case, the third refrigerant passage may be formed near the root of the thrust runner 1324. If the third refrigerant passage is formed on the thrust runner 1324 as described above, this has the advantage of maintaining a rigidity of the rotary shaft 130 while allowing for communication between the first refrigerant passage 1751 and the second refrigerant passage 1752.

Another example of a refrigerant passage will be described hereinafter. That is, in the previous embodiment, a refrigerant passage may be formed on one side or both sides of the rotary shaft, with the thrust runner in between, but in some cases, a refrigerant passage may be formed by penetrating the thrust runner.

Figure 13:
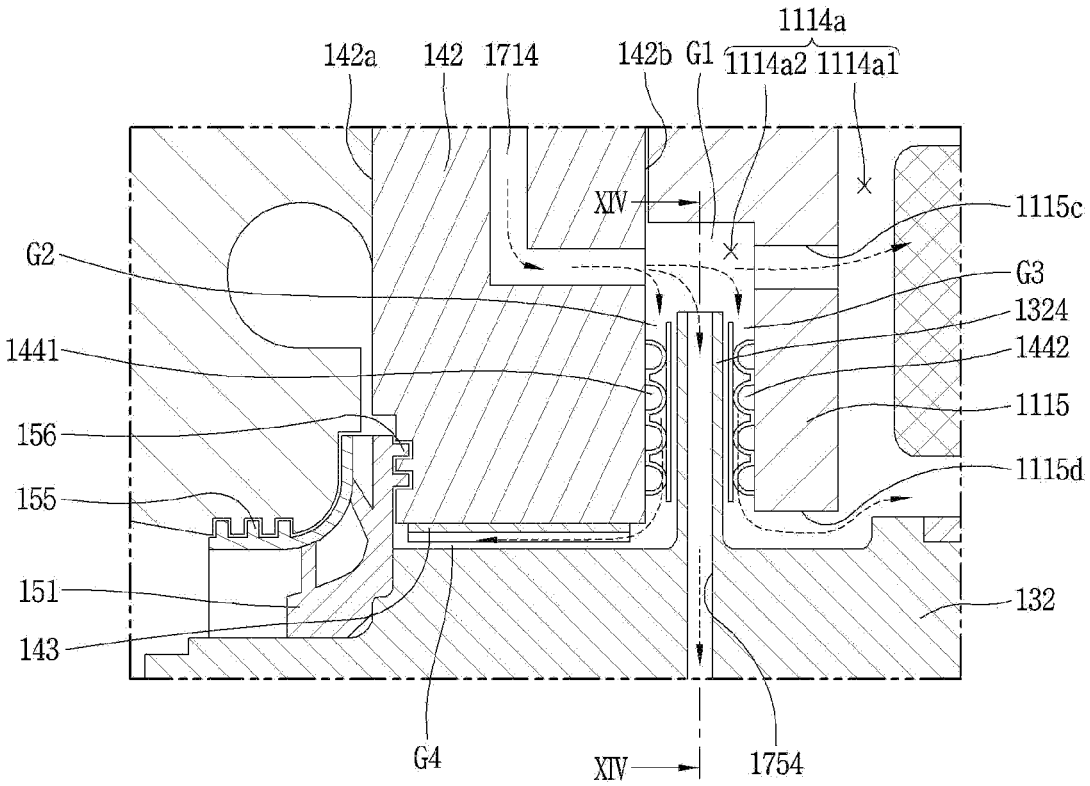
FIG. 13 is a cross-sectional view showing yet another example of a refrigerant passage according to an embodiment.
Figure 14:
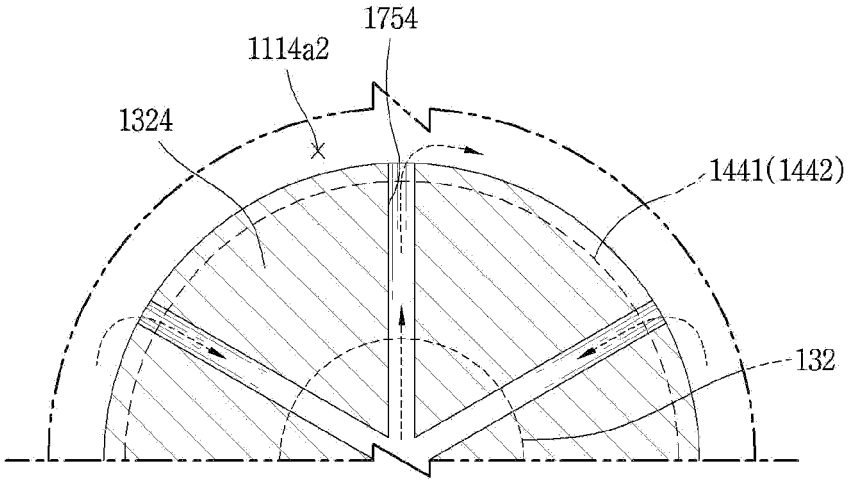
FIG. 14 is a cross-sectional view, taken along line "XIV-XIV" of FIG. 13.
Figure 15:
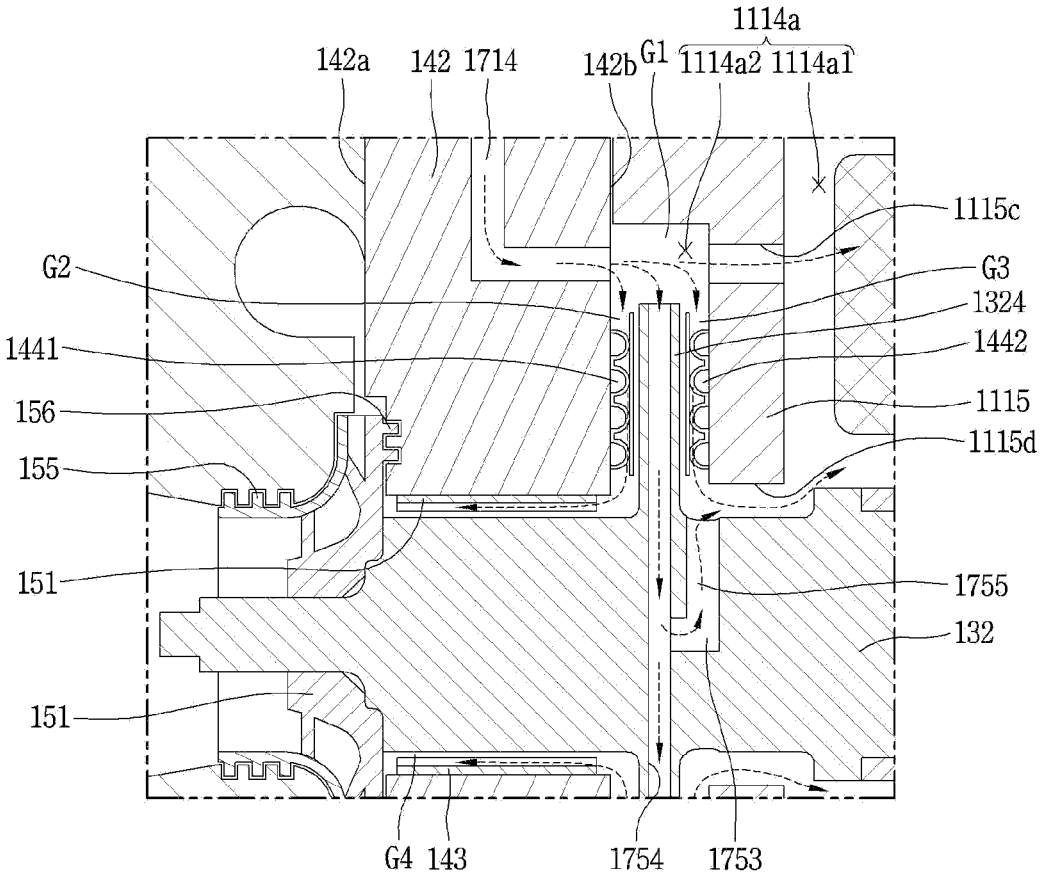
FIG. 15 and FIG. 16 are cross-sectional views showing further examples of a refrigerant passage according to an embodiment.
Figure 16:
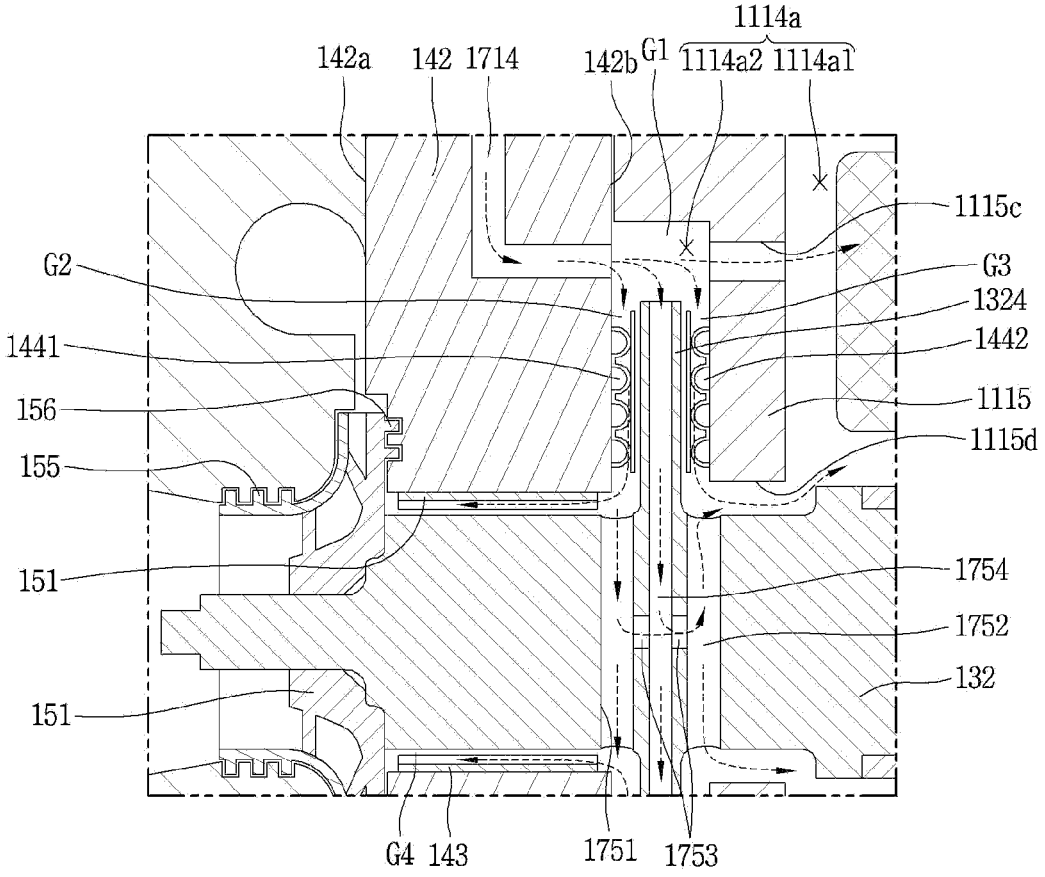

FIG. 13 is a cross-sectional view showing yet another example of a refrigerant passage according to an embodiment. FIG. 14 is a cross-sectional view, taken along line "XIV-XIV" of FIG. 13. FIG. 15 and FIG. 16 are cross-sectional views showing further examples of a refrigerant passage according to an embodiment.

Referring to FIG. 13 and FIG. 14, the refrigerant intake passage 1714 according to an embodiment may penetrate the second side 142*b* of the first bearing shell 142 on the outer circumferential surface of the first bearing shell 142, as in the previous embodiments, and may be formed in a position where it overlaps the second gap G2 which is formed between the outer circumferential surface of the thrust runner 1324 and the inner circumferential surface of the motor housing 111. Accordingly, description of the refrigerant intake passage 1714 will be replaced with the description of the refrigerant intake passage in the previous embodiments.

However, in this embodiment, a fourth refrigerant passage 1754 may penetrate the thrust runner 1324, from one outer circumferential surface to the other outer circumferential surface. For example, the fourth refrigerant passage 1754 may be formed in such a way as to radially penetrate the outer circumferential surface of the thrust runner 1324. Thus, liquid refrigerant introduced into the bearing receiving space 1114*a*2 may pass through the inside of the thrust runner 1324, thereby quickly cooling the rotary shaft 130 including the thrust runner 1324.

Only one fourth refrigerant passage 1754 may be formed, or as in this embodiment, a plurality of fourth refrigerant passages 1754 may be formed at equal intervals along the circumference of the thrust runner 1324. The fourth refrigerant passage 1754 may be formed to be linear, in such a way as to pass through the axial center of the rotary shaft 130. Accordingly, the fourth refrigerant passage 1754 may be made as long as possible.

However, in some cases, the fourth refrigerant passage 1754 may be angled with respect to the radius. For example, the fourth refrigerant passage 1754 may be tilted in the direction of rotation of the rotary shaft 130. In this case, refrigerant in the bearing receiving space 1114*a*2 may be quickly introduced into the fourth refrigerant passage 1754.

The inner diameter of the fourth refrigerant passage 1754 may be smaller than or equal to the inner diameter of the refrigerant intake passage 1714. Accordingly, the fourth refrigerant passage 1754 may be formed inside the thrust runner 1324, and at the same time, the thrust runner 1324 may be prevented from getting too thick, thereby preventing an increase in motor load.

Even if the fourth refrigerant passage 1754 is formed on the thrust runner 1324 as described above, the first refrigerant passage 1751 and the second refrigerant passage 1752 may be further formed on the outer circumferential surface of the rotary shaft 130, that is, on one axial side or both axial sides of the thrust runner 1324. FIG. 15 illustrates an example in which the second refrigerant passage 1752 is formed on one axial side of the thrust runner 1324, and FIG. 16 illustrates an example in which the first refrigerant passage 1751 and the second refrigerant passage 1752 are formed on opposite axial sides of the thrust runner 1324, respectively.

Moreover, in the case where the fourth refrigerant passage 1754 is formed on the thrust runner 1324, and the first refrigerant passage 1751 or the second refrigerant passage 1752 is formed on one axial side of the thrust runner 1324 or they are formed on opposite axial sides of the thrust runner 1324, respectively, the first refrigerant passage 1751, the second refrigerant passage 1752, and the fourth refrigerant passage 1754 which radially penetrate may communicate with each other by the third refrigerant passage 1753 which axially penetrates. Accordingly, the refrigerant in the bearing receiving space 1114*a*2 may continuously pass through the inside of the rotary shaft 130 including the thrust runner 1324 and more quickly cool the rotary shaft 130 including the thrust runner 1324.

Moreover, as the refrigerant in the bearing receiving space 1114*a*2 quickly moves through each of the refrigerant passages provided inside the rotary shaft 130, the refrigerant in the bearing receiving space 1114*a*2 is prevented from getting sluggish, which allows the first radial bearing 143 as well as both of the axial bearings 1441*a* and 1442 to quickly acquire bearing force.

Another example of a refrigerant intake passage will be described hereinafter. That is, in the previous embodiment, the exit of the refrigerant intake passage is positioned more on the outer circumferential surface than the first axial bearing, whereas, in some cases, the exit of the refrigerant intake passage may be positioned more on the inner circumferential surface than the first axial bearing.

Figure 17:
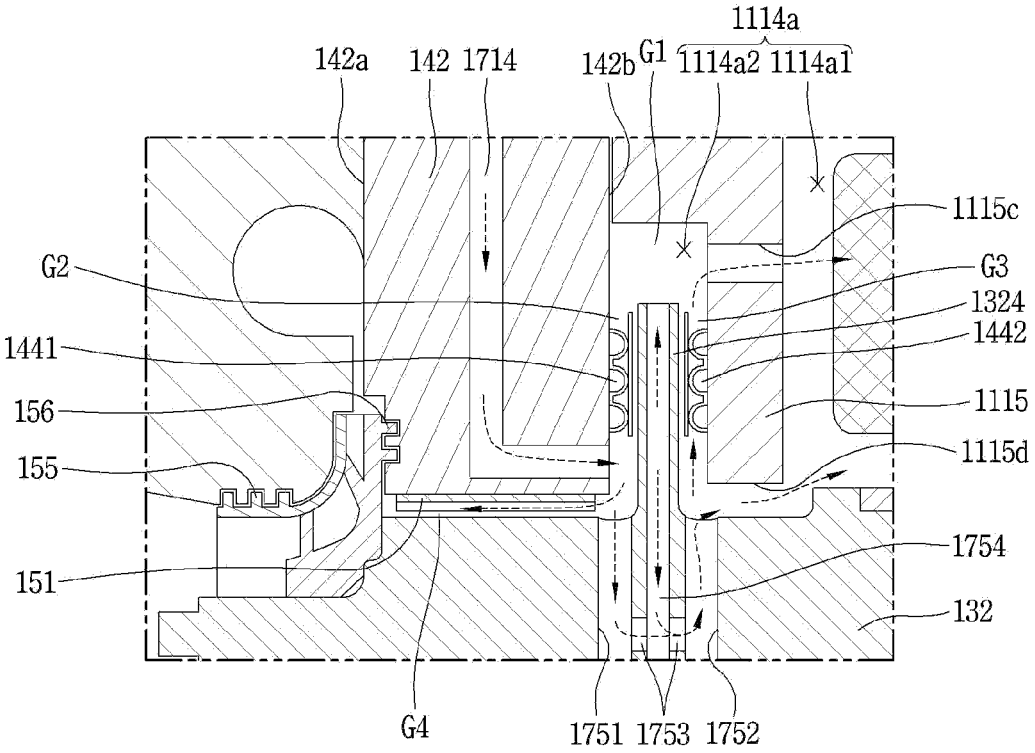
FIG. 17 is a cross-sectional view of another example of a refrigerant intake passage according to an embodiment.

FIG. 17 is a cross-sectional view of another example of a refrigerant intake passage according to an embodiment. Referring to FIG. 17, the refrigerant intake passage 1714 according to this embodiment may penetrate the second side 142*b* from the outer circumferential surface of the first bearing shell 142 as in the previous embodiments. It is similar to the refrigerant intake passage 1714 in the previous embodiments, so description thereof will be replaced with the description of the refrigerant intake passage 1714 in the previous embodiments. However, the refrigerant intake passage 1714 according to this embodiment may be positioned within the range of the thrust runner 1324 an end thereof which constitutes its exit faces, that is, further inward than the inner circumferential surface of the first axial bearing 1441.

In other words, the refrigerant intake passage 1714 according to this embodiment may be formed in a position where it radially overlaps the thrust runner 1324 while not radially overlapping the first axial bearing 1441. Accordingly, refrigerant supplied between the first bearing shell 142 and the thrust runner 1324 may smoothly move from the inner circumferential surface of the first axial bearing 1441 to the outer circumferential surface thereof.

Moreover, the amount of refrigerant flow is inversely proportional to the height of the refrigerant intake passage 1714. In other words, the smaller the height of the refrigerant intake passage 1714, that is, the closer to the center of the rotary shaft 130, the larger the amount of refrigerant flow. Accordingly, the first axial bearing 1441 and the second axial bearing 1442 may quickly acquire bearing force, and these bearings 1441 and 1442 and the rotary shaft 130 may be quickly cooled.

Further, as the refrigerant intake passage 1714 is formed adjacent to the first shaft hole 142*c*, liquid refrigerant may be quickly introduced into the first shaft hole 142*c* constituting the fourth gap G4. Accordingly, the liquid refrigerant passed through the refrigerant intake passage 1714 may be quickly and uniformly supplied to the first radial bearing 143 provided in the first shaft hole 142*c*. As such, the first radial bearing 143 may quickly acquire bearing force, and the rotary shaft 130 and the first radial bearing 143 may be cooled more quickly.

Although not shown, in this case, the refrigerant supplied between the first bearing shell 142 and the thrust runner 1324 may smoothly move from the inner circumferential surface of the first axial bearing 1441 to the outer circumferential surface thereof, even if no refrigerant passage is formed on the rotary shaft 130. This makes machining of the rotary shaft 130 easy as no refrigerant passage is formed on the rotary shaft 130, and at the same time, ensures the rigidity of the rotary shaft 130.

Yet another example of a refrigerant intake passage will be described hereinafter. That is, in the previous embodiments, the refrigerant intake passage may penetrate the second side from the outer circumferential surface of the first bearing shell, whereas, in some cases, the first refrigerant inlet may penetrate the first side from the outer circumferential surface of the first bearing shell.

Figure 18:
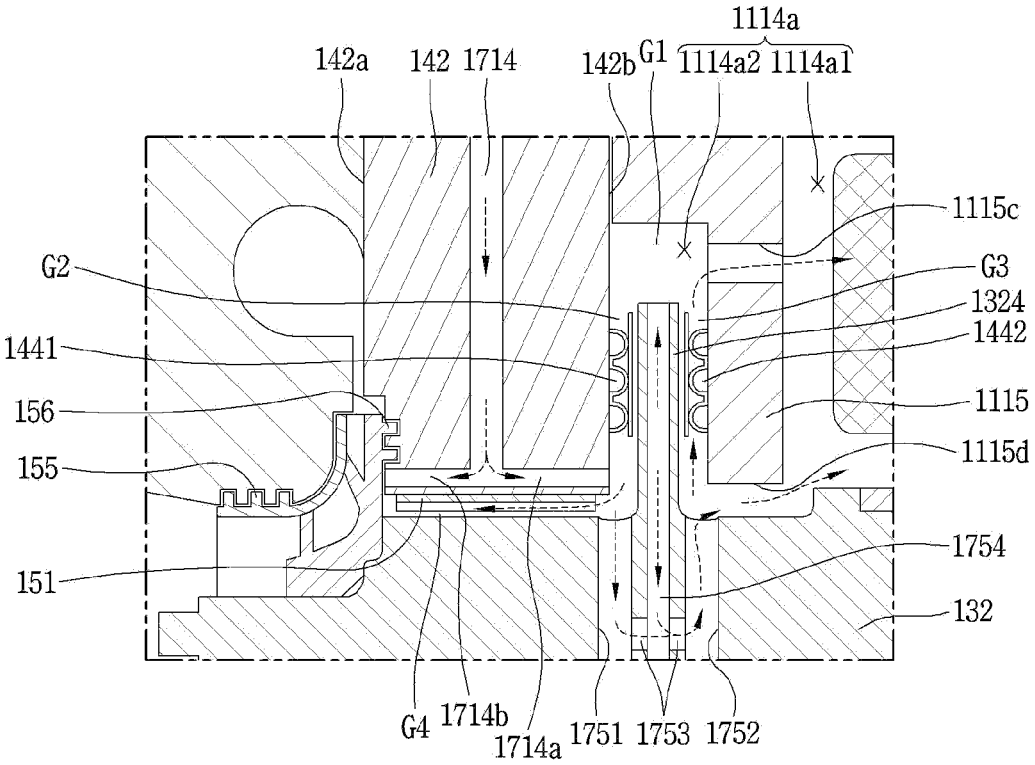
FIG. 18 is a cross-sectional view of another example of a refrigerant intake passage according to an embodiment.

FIG. 18 is a cross-sectional view of another example of a refrigerant intake passage according to an embodiment. Referring to FIG. 18, the refrigerant intake passage 1714 according to this embodiment may penetrate the inside of the first bearing shell 142 and communicate with the first chamber 1114*a* as in the previous embodiments. It is similar to the refrigerant intake passage 1714 in the previous embodiments, so description thereof will be replaced with the description of the refrigerant intake passage 1714 in the previous embodiments. However, the exit of the refrigerant intake passage 1714 according to this embodiment may penetrate the first side 142*a* of the first bearing shell 142, that is, the side facing the rear surface of the first impeller 151.

More specifically, the front sealing portion 1561 constituting the first discharge sealing portion 1561 may be formed on the first side 142*a* of the first bearing shell 142, as explained above. The front sealing portion 1561 may be formed between the outer circumferential surface and inner circumferential surface of the first bearing shell 142 on the first side 142*a* of the first bearing shell 142, thereby preventing refrigerant compressed in the first compression part 150 from leaking to the motor chamber 1114 through a gap between the rear surface of the first impeller 151 and the first side 142*a* of the first bearing shell 142 facing that rear surface.

As such, as in this embodiment, the exit of the refrigerant intake passage 1714 may penetrate the first side 142*a* of the first bearing shell 142, preferably positioned more on the inner circumferential surface than the front sealing portion 1561. Accordingly, the front sealing portion 1561 may be provided between the rear surface of the first impeller 151 and the first side 142*a* of the first bearing shell 142, thereby allowing refrigerant to be quickly supplied to the first radial bearing 143 through the refrigerant intake passage 1714 even if the refrigerant is not introduced to the first radial bearing 143 from the first compression part 1714. As such, the first radial bearing 143 may quickly acquire bearing force and, at the same time, may quickly dissipate heat from the first radial bearing 143 and the rotary shaft 130 facing it.

Moreover, the exit of the refrigerant intake passage 1714 according to this embodiment is positioned farther than the first radial bearing 143 with respect to the refrigerant outlet 1721. Thus, refrigerant introduced into the bearing receiving space 1114*a* through the refrigerant intake passage 1714 may pass through the first shaft hole 142*c* and the first through hole 1115*c* sequentially and therefore move in a relatively forward direction.

In other words, the first shaft hole 142*c* and the second gap G2 may be formed more on the wake side than the exit of the refrigerant intake passage 1714, and the third gap G3 and the first through hole 1115*c* may be formed on the wake side than the second gap G2. Accordingly, refrigerant introduced into the bearing receiving space 1114*a*2 through the refrigerant intake passage 1115*c* may pass through the first shaft hole 142*c*, the second gap G2, the third gap G3, and the first through hole 1115*c*, thereby preventing an increase in flow resistance along a moving path of the refrigerant. This offers advantages in providing a heat dissipation effect and bearing force in each shaft hole and gap.

Another example of a first bearing shell will be described hereinafter. That is, the first bearing shell according to the previous embodiments is formed in the shape of a cylinder in which its outer circumferential surface is blocked, whereas, in some cases, a refrigerant intake recess may be formed on the outer circumferential surface of the first bearing shell.

Figure 19:
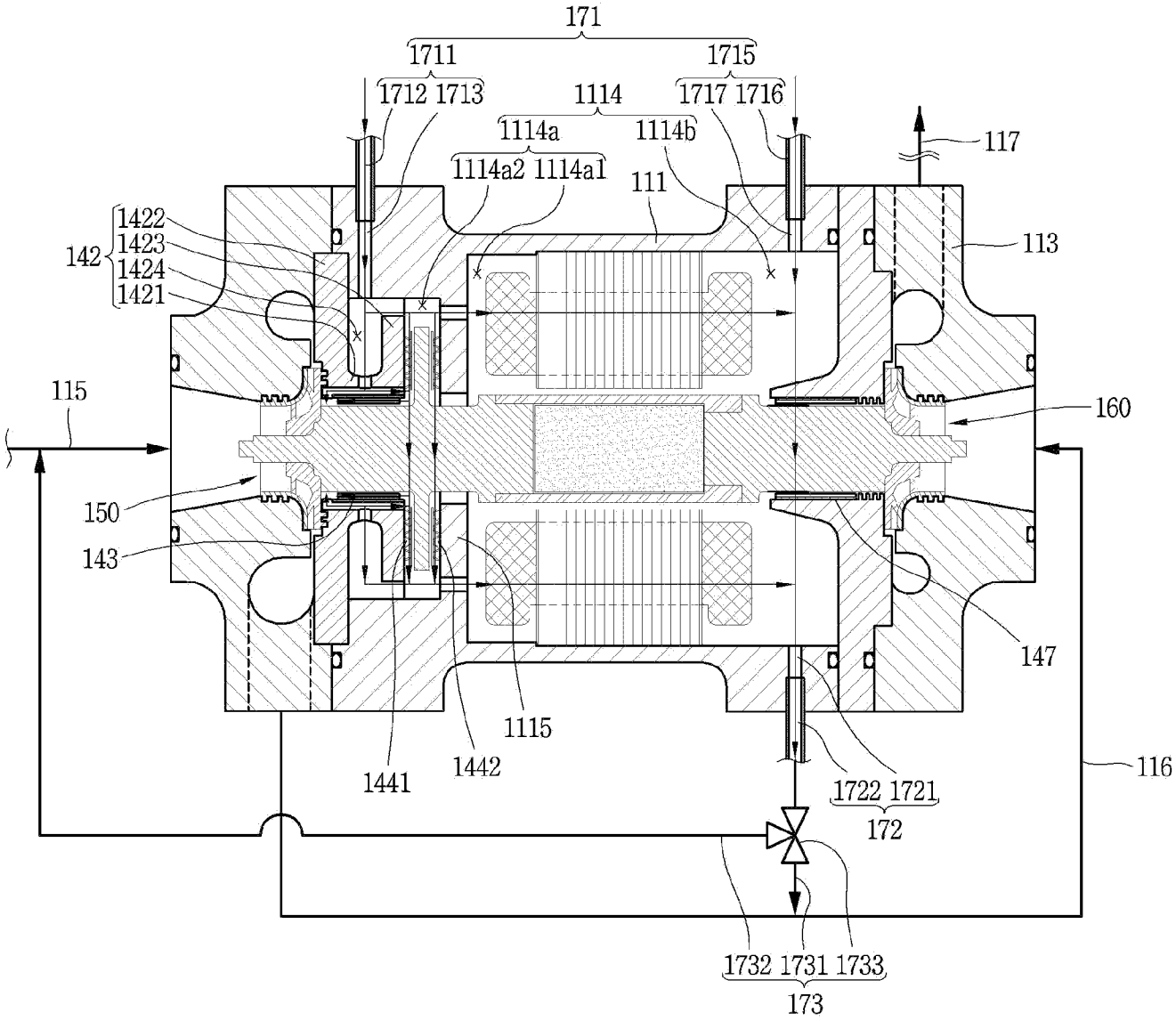
FIG. 19 is a cross-sectional view of an inside of a turbo compressor according to another embodiment.
Figure 20:
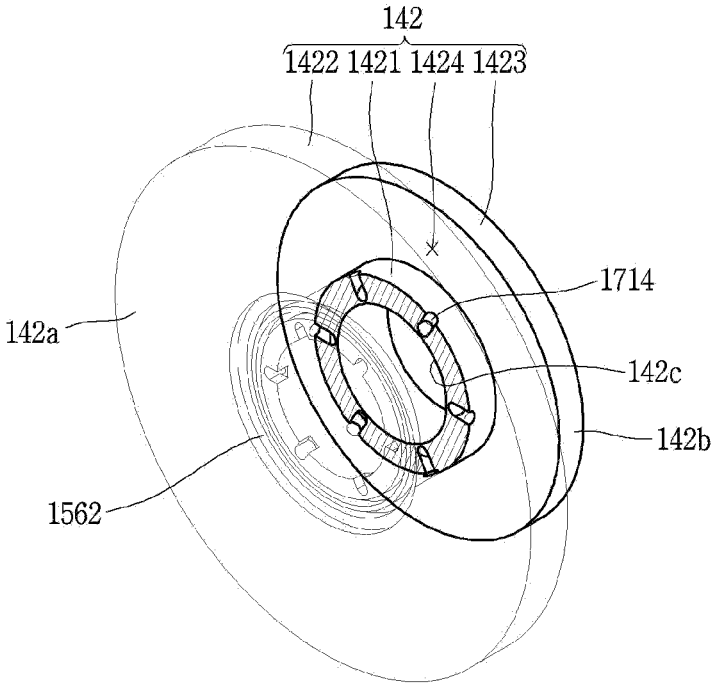
FIGS. 20 and 21 are a perspective view and a cross-sectional view of a first bearing shell of FIG. 19.
Figure 21:
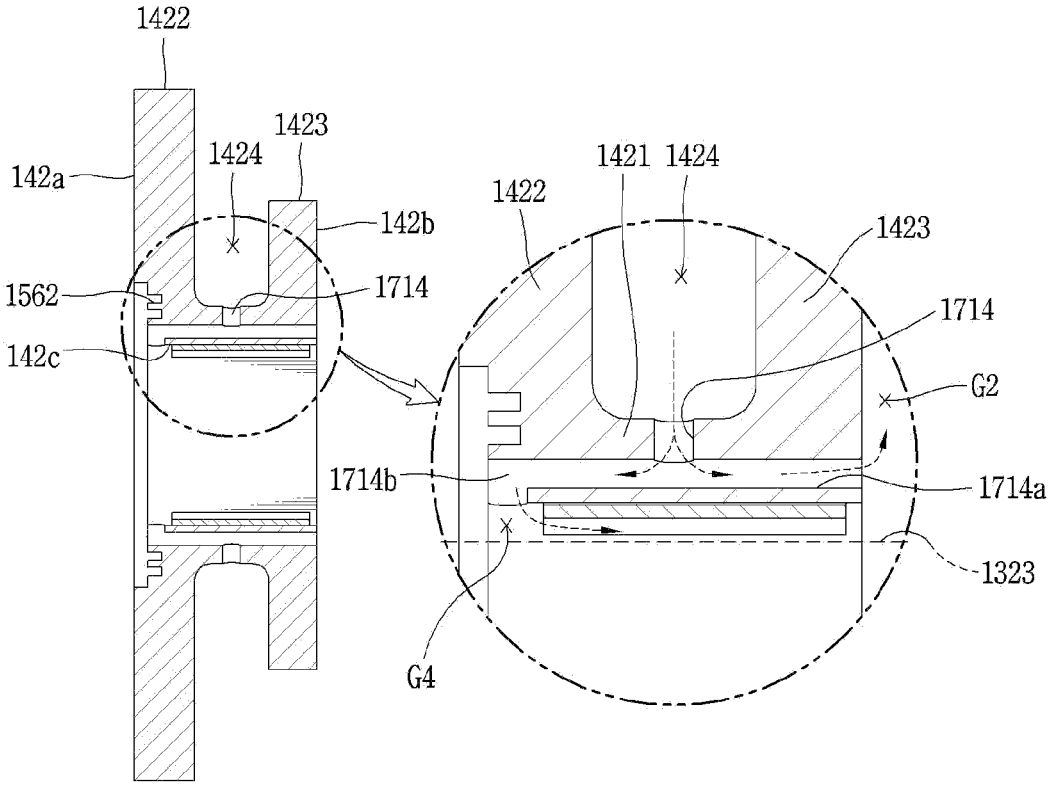
Figure 22:
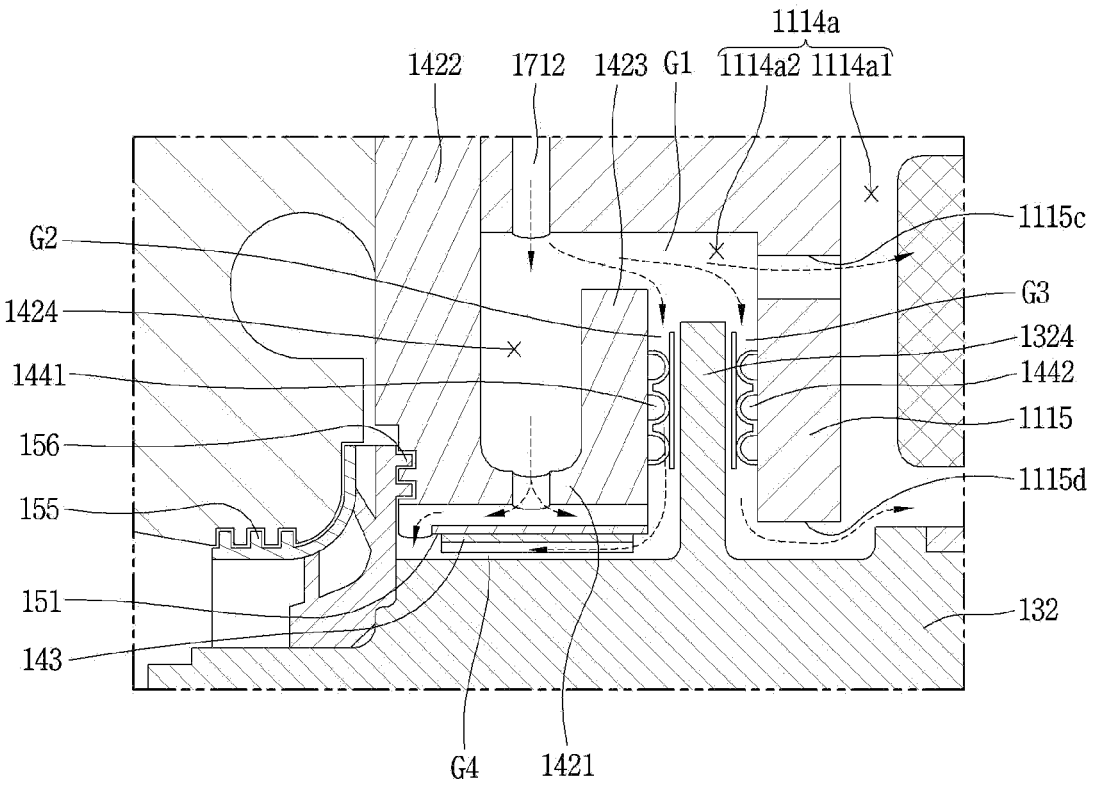
FIG. 22 is a cross-sectional view of an example of a refrigerant passage of FIG. 19.

FIG. 19 is a cross-sectional view of the inside of a turbo compressor according to another embodiment. FIGS. 20 and 21 are a perspective view and a cross-sectional view of a first bearing shell of FIG. 19. FIG. 22 is a cross-sectional view of an example of a refrigerant passage of FIG. 19.

Referring to FIG. 19 and FIG. 22, the first bearing shell 142 according to this embodiment may be formed in the shape of a ring, approximately in the shape of a U-shaped cross-section, with its outer circumferential surface being recessed. For example, the first bearing shell 142 may include inner wall portion 1421, first side wall portion 1422, second side wall portion 1423, and refrigerant receiving portion 1424.

The inner wall portion 1421 may be formed in the shape of a ring so as to surround the outer circumferential surface of the rotary shaft 130 in a circumferential direction, with the inner diameter of the inside being larger than the outer diameter of the rotary shaft 130. Accordingly, the first shaft hole 142*c* which is spaced apart from the outer circumferential surface of the rotary shaft 130 may be formed on outer circumferential surface of the inner wall portion 1421, and the first radial bearing 143 may be provided on the inner circumferential surface of the inner wall portion 1421. The first radial bearing 143 may be formed of a gas foil bearing, as in the previous embodiments.

The first side wall portion 1422 may be formed in the shape of a ring which radially extends from one side of the outer circumferential surface of the inner wall portion 1421, more precisely, the outer circumferential surface on the front side facing the first impeller 151, which is one of opposite axial ends of the first side wall portion 1422. The outer diameter of the first side wall portion 1422 may be almost similar to the inner diameter of the bearing shell receiving groove 112*a* provided on the first impeller housing 112. Accordingly, the outer circumferential surface of the first side wall portion 1422 may be tightly attached to the inner circumferential surface of the bearing shell receiving groove 112*a* and supported radially. Thus, even in the case where the first bearing shell 142 is fastened with a bolt to the motor housing 111, the number of bolts may be reduced, and the first bearing shell 142 may be stably supported. Also, the assembly position of the first bearing shell 142 may be determined by using the bearing shell receiving groove 112*a*, thereby reducing manufacturing costs by eliminating the need for a separate reference pin.

The second side wall portion 1423 may be formed in the shape of a ring as it radially extends from the other side of the outer circumferential surface of the inner wall portion 1421. The second side wall portion 1423 may be shorter in length than the first side wall portion 1422. For example, the outer diameter of the second side wall portion 1423 may be smaller than the inner diameter of the motor housing 111. Accordingly, the first gap G1 may be formed between the outer circumferential surface of the second side wall portion 1423 and the inner circumferential surface of the motor housing 111 radially facing it.

However, in some cases, the outer diameter of the second side wall portion 1423 may be almost equal to the inner diameter of the motor housing 111. In this case, a separate refrigerant passage (not shown) formed of at least one hole or groove may be formed on the second side wall portion 1423.

The refrigerant receiving portion 1424 may be formed between the first side wall portion 1422 and the second side wall portion 1423. More specifically, the refrigerant receiving portion 1424 may be defined as a space that is formed in the shape of a ring by the outer circumferential surface of the inner wall portion 1421, the second side of the first side wall portion 1422, and a first side of the second side wall portion 1423. Accordingly, the inner peripheral side of the refrigerant receiving portion 1424 which faces the rotary shaft 130 may be closed, and the outer peripheral side thereof which faces the inner circumferential surface of the motor housing 111 may be at least partially opened.

The refrigerant receiving portion 1424 may be formed in such a way as to radially overlap the first refrigerant inlet 1713. For example, the exit of the first refrigerant inlet 1713 may be positioned between the first side wall portion 1422 and the second side wall portion 1423.

The refrigerant intake passage 1714 may be formed on the inner wall portion 1421. The refrigerant intake passage 1714 may be formed from a single passage with one entrance and one exit or a dual passage with one entrance and a plurality of exits. An example is illustrated in which the refrigerant intake passage according to this embodiment is a dual passage.

For example, the refrigerant intake passage 1714 may be formed from a first intake passage 1714*a* and a second intake passage 1714*b* whose exits are separated. An entrance of the first intake passage 1714*a* and an entrance of the second intake passage 1714*b* may communicate with each other and be open toward the refrigerant receiving portion 1424 midway through the outer circumferential surface of the inner wall portion 1421. The exit of the first intake passage 1714*a* may be open to the second side 142*b* of the inner wall portion 1421, and the exit of the second intake passage 1714*b* may be open toward the inner circumferential surface of the inner wall portion 1421.

Although not shown, the exit of the first intake passage 1714*a* also may be formed to be open to a side of the second side wall portion 1423 which extends from the inner wall portion 1421. However, this difference occurs because ranges of the inner wall portion 1421 and the second side wall portion 1423 are specified, and the exit of the first intake passage 1714*a* may be substantially open to a side of the inner wall portion 1421 facing the thrust runner 1324.

Only one refrigerant intake passage 1714 may be formed, or a plurality of refrigerant intake passages 1714 may be formed at preset or predetermined intervals along the circumference. In this embodiment, an example is illustrated in which a plurality of refrigerant intake passages 1714 is formed at equal intervals along the circumference of the inner wall portion 1421. Accordingly, refrigerant may be uniformly supplied to the first radial bearing 143 and the first and second axial bearings 1441 and 1442 as the refrigerant is uniformly supplied to each bearing through the plurality of refrigerant intake passages 1714. As such, the first axial bearing 143 and the first and second axial bearings 1441 and 1442 may have uniform bearing force, thereby stably supporting the rotary shaft 130.

In the case where the refrigerant receiving portion 1424 is formed in the shape of a ring on the outer circumferential surface of the first bearing shell 142 as in this embodiment, the refrigerant introduced into the bearing receiving space 1114*a*2 is directly introduced toward and received in the refrigerant receiving portion 1424 of the first bearing shell 142, and this refrigerant moves along the refrigerant receiving portion 1424 in the circumferential direction and is therefore uniformly distributed throughout the refrigerant receiving portion 1424. Thus, the first bearing shell 142 including the refrigerant receiving portion 1424 may be quickly and uniformly cooled by the refrigerant received in the refrigerant receiving portion 1424.

Moreover, as the refrigerant receiving portion 1424 is recessed to a preset or predetermined depth from the outer circumferential surface of the first bearing shell 142 toward the inner circumferential surface thereof, the first intake passage 1714*a* or second intake passage 1714*b* constituting the exit of the refrigerant intake passage 1714 may be machined at an angle. Accordingly, the exit of the refrigerant intake passage 1714 may be formed as close as possible to the rotary shaft 130, thereby increasing the mass flow of refrigerant.

In addition, as the exit of the refrigerant intake passage 1714 may be formed as close as possible to the rotary shaft 130, the radial length of the first axial bearing 1441 may be extended while securing a radial thickness for the inner wall portion 1421. Thus, the bearing force of the first axial bearing 1441 may be secured.

Yet another example of a first bearing shell will be described hereinafter. That is, the refrigerant intake passage according to the previous embodiments is open to the inner circumferential surface of the inner wall portion, whereas, in some cases, a refrigerant intake passage may be open to an outer surface of the first side wall portion, that is, a first side surface of the first bearing shell.

Figure 23:
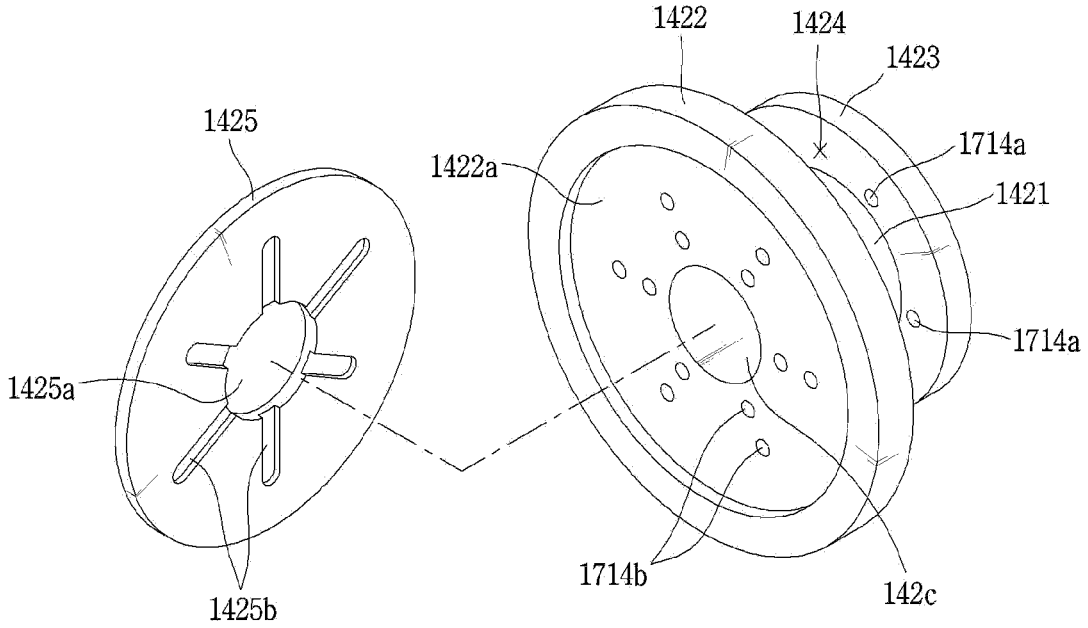
FIG. 23 is an exploded perspective view of another example of the first bearing shell of FIG. 19.
Figure 24:
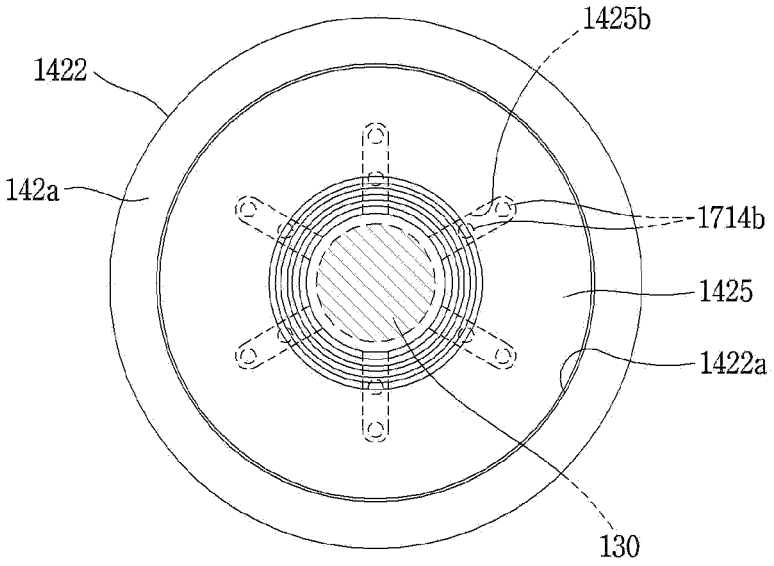
FIG. 24 is a front view of the first bearing shell of FIG. 23 in an assembled state.
Figure 25:
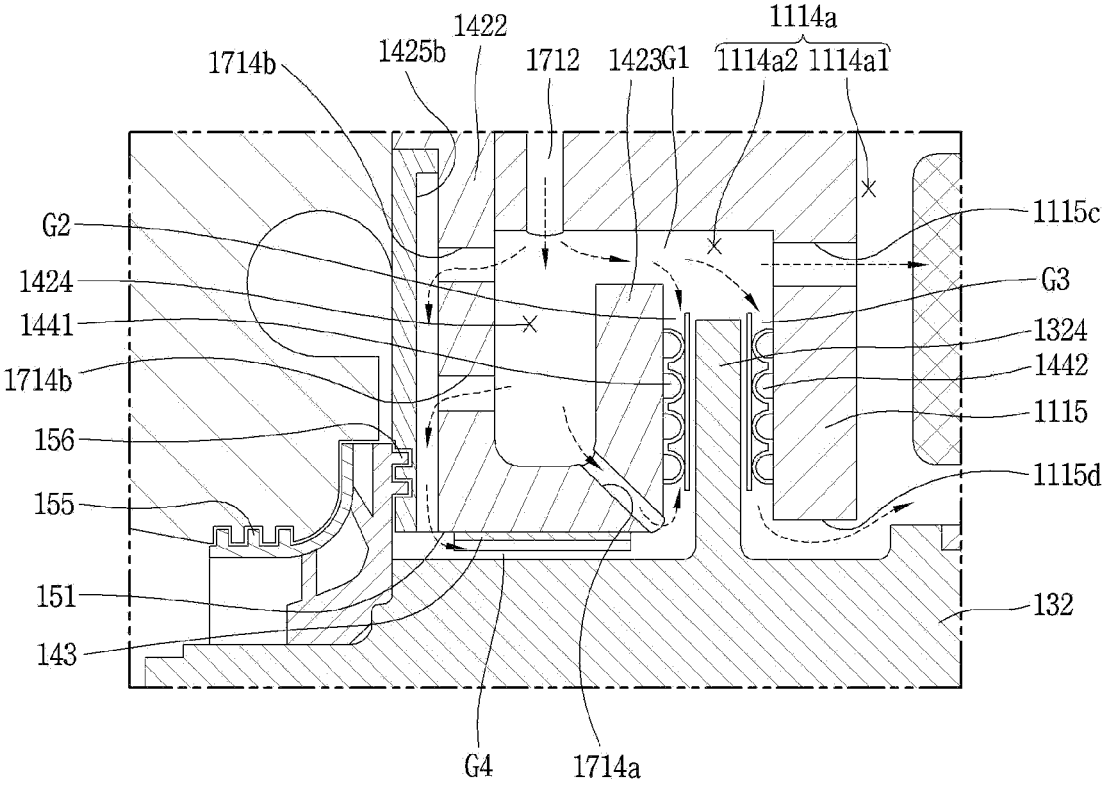
FIG. 25 is a cross-sectional view of how the refrigerant of FIG. 24 is flowing.

FIG. 23 is an exploded perspective view of another example of the first bearing shell of FIG. 19. FIG. 24 is a front view of the first bearing shell of FIG. 23 in an assembled state. FIG. 25 is a cross-sectional view of how the refrigerant of FIG. 24 is flowing.

Referring to FIGS. 23 to 25, the first bearing shell 142 according to this embodiment is formed in the shape of a U-shaped cross section when projected radially, and its basic configuration and the corresponding operational effects are similar to those in the previous embodiment. However, in this embodiment, the first intake passage 1714*a* may penetrate from the inner side surface of the second side wall portion 1423 to the outer surface thereof. Accordingly, an end of the outer circumferential surface constituting the exit of the first intake passage 1714*a* may be formed as close as possible to the rotary shaft 130 in a second bearing gap G2, that is, on the inner circumferential surface of the first axial bearing 1441. Thus, the mass flow of refrigerant may be increased, thereby quickly securing bearing force, and at the same time, the first axial bearing 1441 and its peripheral members may be quickly cooled.

Moreover, the second intake passage 1714*b* may penetrate from the inner side surface of the first side wall portion 1422 to the outer surface thereof. For example, a plurality of second intake passages 1714*b* may be formed at preset or predetermined intervals along the circumference and have the same inner diameter.

The plurality of second intake passages 1714*b* may be formed on a single circumferential line, or may be formed on a plurality of circumferential lines radially spaced apart from each other. In this embodiment, an example is disclosed in which a plurality of second inlet passages 1714*b* is formed at equal intervals on a plurality of circumferential lines, respectively.

In this case, once the rear sealing portion 1562 constituting part of the first discharge sealing portion 156 is formed on the first side 142*a* of the first bearing shell 142 as in the previous embodiment, the rear sealing portion 1562 may interfere with the second intake passage 1714*b*. In this respect, in this embodiment, a refrigerant passage cover 1425 with the rear sealing portion 1562 may be provided on the outer surface of the first side wall portion 1422.

For example, the second intake passage 1714*b* may be formed on the first side wall portion 1422 and penetrate from the inner circumferential surface to the outer circumferential surface, a cover receiving groove 1422*a* may be formed to a preset or predetermined depth on the outer surface of the first side wall portion 1422, and a refrigerant passage cover 1425 for covering the second intake passage 1714*b* may be inserted into and fixed to the cover receiving groove 1422*a*.

A plurality of second intake passages 1714*b* may be formed along the circumference, or may be formed in a plurality of columns along the radius. Inner and outer columns of the second intake passages 1714*b* may be arranged radially.

The cover receiving groove 1422*a* may be formed in the shape of a ring as it extends radially from the inner circumferential surface of the inner wall portion 1421, and the second intake passage 1714*b* may be formed to be wholly received within the cover receiving groove 1422*a*. The inner circumferential surface of the cover receiving groove 1422*a* may communicate to the first shaft hole 142*c* provided between the inner circumferential surface of the inner wall portion 1421 and the outer circumferential surface of the rotary shaft 130, and the outer circumferential surface of the cover receiving groove 1422*a* may be blocked along the circumference.

The refrigerant passage cover 1425 may be formed in the shape of a disc that has the same thickness along the circumference, with a second through hole 1425*a* formed at the center to communicate with the first shaft hole 142*c*. A rear surface of the refrigerant passage cover 1425 facing the first side 142*a* of the first bearing shell 142 may be formed to be flat, with a passage connecting groove 1425*b* connecting the second inlet passage 1714*a* to the first shaft hole 142*c*. Accordingly, even if a rear surface of the refrigerant passage cover 1425 is tightly attached to a front surface of the cover receiving groove 1422*a*, the second intake passage 1714*a* may communicate with the first shaft hole 142*c*.

The passage connecting groove 1425*b* may be formed in the shape of a rectangle that extends radially, with its inner peripheral end being opened to communicate with the first shaft hole 142*c*, and its outer peripheral end being blocked. Also, the passage connecting groove 1425*b* may extend radially so as to receive the second intake passage 1714*b* positioned on the inside and the second intake passage 1714*b* positioned on the outside.

The above-described rear sealing portion 1562 may be formed on the front surface of the refrigerant passage cover 1425, forming the first discharge sealing portion 156, along with the front sealing portion 1561 provided on the first impeller 151.

As described above, in the case where a plurality of second intake passages 1714*b* is formed on the first side wall portion 1422 of the first bearing shell 142, more of the refrigerant received in the refrigerant receiving portion 1424 may be supplied to the front side of the first radial bearing 143. Accordingly, the bearing force of the first radial bearing 143 may be secured more effectively, and the first radial bearing 143 and the rotary shaft 130 facing it may be cooled more effectively.

Moreover, in this case, too, a first intake passage 1714*a*, as well as the second intake passage 1714*b* provided on the first side wall portion 1422, may be formed on the second side wall portion 1423 or inner wall portion 1421 of the first bearing shell 142. The first intake passage 1714*a* provided on the second side wall portion 1423 or the inner wall portion 1421 may be formed in the same manner as in the above-described embodiment.

A further example of a second inlet passage portion will be described hereinafter. That is, the second side of the second bearing shell facing the second chamber is blocked, except for the second shaft hole, whereas, in some cases, a refrigerant passage penetrating through the second shaft hole may be formed on the second side of the second bearing shell.

Figure 26:
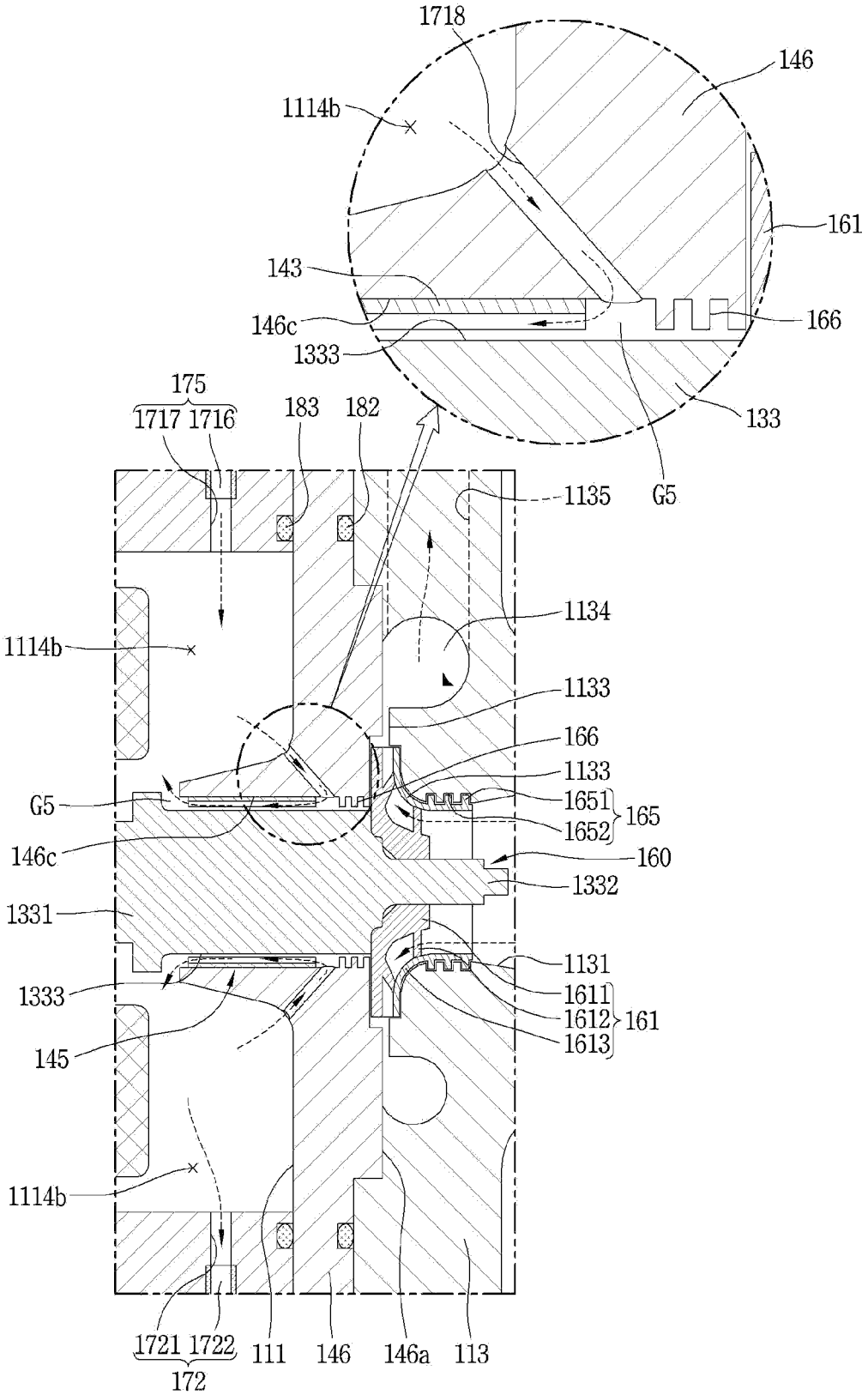
FIG. 26 is a cross-sectional view of a refrigerant passage.

FIG. 26 is a cross-sectional view of a refrigerant passage. Referring to FIG. 26, the second refrigerant inlet 1716 and the second refrigerant inlet port 1717 may communicate with the second chamber 1114*b* of the motor chamber 1114 of the motor housing 111. Accordingly, a part or portion of the refrigerant passed through the condenser 20 may be introduced to the second chamber 1114*b* of the motor housing 111 through the second refrigerant inlet pipe 1716 and the second refrigerant inlet port 1717, and this refrigerant is introduced into the first chamber 1114*a* through the first refrigerant inlet pipe 1712 and the first refrigerant inlet port 1713 and them combines with the refrigerant moving to the second chamber 1114*b*. A part or portion of this refrigerant is introduced between the second shaft hole 146*c* and the outer circumferential surface of the rotary shaft 130 facing it, thereby operating the second radial bearing 147 and at the same time cooling the radial bearing 147 and the rotary shaft 130.

However, in the case where the second discharge sealing portion 166 is formed closer to the second impeller 161 than to the second radial bearing 147 as in this embodiment, it may be hard for the refrigerant in the second chamber 1114*b* to move to the fifth gap G5 including the second shaft hole 146*c*. The actual distance between the second radial bearing 147 provided on the second shaft hole 146*c* and the outer circumferential surface of the rotary shaft 130 facing it is as small as several tens of μm, which may make it impossible to quickly supply the refrigerant in the motor chamber 1114 to the second radial bearing 147. Due to this, the operation of the second radial bearing 147 may be delayed, or the area between the second radial bearing 147 and the rotary shaft 130 may not be cooled properly.

In this respect, in this embodiment, at least one third intake passage 1718 penetrating through the second shaft hole 146*c* may be formed on the second side 146*b* of the second bearing shell 146. For example, one (first) end of the third intake passage 1718 may be open toward the second chamber 1114*b* from the second side 146*b* of the second bearing shell 146, and the other (second) end of the third intake passage 1718 may be open toward the rotary shaft 130, more specifically, the second bearing surface portion 1333 of the second impeller shaft portion 133 from the second shaft hole 146*c* of the second bearing shell 146. Accordingly, a kind of bypass passage may be formed between the second chamber 1114*b* and the second shaft hole 146*c*, and therefore refrigerant introduced into the second chamber 1114*b* may be supplied directly into the second shaft hole 146*c* constituting the fifth gap G5 through the third intake passage 1718 which is a bypass passage. As such, the second radial bearing 147 may be operated smoothly, and at the same time, the second radial bearing 147 and the rotary shaft 130 facing it may be cooled quickly.

Moreover, the third intake passage 1718 may be made wider than the distance the second radial bearing 147 and the outer circumferential surface of the rotary shaft 130 facing it. Thus, the second refrigerant in the second chamber 1114*b* may be quickly supplied to the second shaft hole 146*c* constituting the fifth gap G5.

In addition, a second end of the third intake passage 1718, which is an exit thereof, may be formed to be open to the inner circumferential surface of the second shaft hole 146*c* between the second bearing shell 146 and the second discharge sealing portion 166. Accordingly, the refrigerant supplied to the second shaft hole 146*c* constituting the fifth gap G5, along with the refrigerant leaking toward to the motor chamber 1114 through a fine gap in the second discharge sealing portion 166 of the second compression part 160, may pass through the second radial bearing 147 and be collected in the second chamber 1114*b*. As such, the second radial bearing 147 may be properly operated and quickly cooled.

The invention claimed is:

1. A turbo compressor, comprising:

a housing having a motor chamber;

a drive motor having a stator and a rotor in the motor chamber of the housing;

a first compression portion and a second compression portion, respectively, provided on opposite ends of a rotary shaft;

a connecting passage that connects an exit of the first compression portion and an entrance of the second compression portion;

an inlet passage that penetrates a first side of the housing to communicate with an inside of the motor chamber and guide a refrigeration fluid to the motor chamber; and an outlet passage that penetrates a second side of the housing to communicate with the inside of the motor chamber and guide the refrigeration fluid in the motor chamber out of the housing, wherein an axial support portion is provided in the motor chamber to provide support with respect to an axial direction for the rotary shaft, the axial support portion including:

a thrust runner that radially extends from the rotary shaft;

a first partition wall fixed to the housing and positioned between the thrust runner and the first compression portion; and a second partition wall axially spaced apart from the first partition wall and fixed to the housing, that axially overlaps the thrust runner and is positioned between the thrust runner and the drive motor, wherein a refrigerant intake passage forming the inlet passage is provided in the first partition wall, and an end of the refrigerant intake passage is open to a side of the first partition wall facing the thrust runner, wherein an axial bearing is provided between a first side of the thrust runner and the first partition wall and between a second side of the thrust runner and the second partition wall, and wherein the end of the refrigerant intake passage is positioned radially farther away from the rotary shaft than the axial bearing.

2. The turbo compressor of claim 1, wherein the motor chamber includes a first chamber provided on a first axial side with respect to the drive motor and a second chamber provided on a second axial side, wherein the axial bearing is provided in the first chamber to provide support with respect to the axial direction for the rotary shaft, and wherein the inlet passage communicates with the first chamber.

3. The turbo compressor of claim 1, wherein the motor chamber includes a first chamber provided on a first axial side with respect to the drive motor and facing the first compression portion and a second chamber provided on a second axial side and facing the second compression portion, wherein the first chamber and the second chamber communicate with each other, and the outlet passage communicates with the second chamber, and wherein the inlet passage includes:

a first inlet passage that communicates with the first chamber; and a second inlet passage that communicates with the second chamber.

4. The turbo compressor of claim 1, wherein a refrigerant passage is formed to radially penetrate the rotary shaft, wherein a cross-sectional area of the refrigerant passage is larger than or equal to a distance between either side of the thrust runner and a partition wall facing the same, wherein the refrigerant passage includes a first refrigerant passage that radially penetrates a first axial side and a second refrigerant passage that radially penetrates a second axial side, with the thrust runner interposed therebetween, and wherein the first refrigerant passage and the second refrigerant passage communicate with each other by a third refrigerant passage which extends axially therebetween.

5. The turbo compressor of claim 1, wherein a first refrigerant passage or a second refrigerant passage radially penetrates the rotary shaft at least one of opposite axial sides, with the thrust runner interposed therebetween, wherein a fourth refrigerant passage is formed to radially penetrate the thrust runner, and wherein the fourth refrigerant passage communicates with the first refrigerant passage or/and the second refrigerant passage by a third refrigerant passage which axially extends.

6. The turbo compressor of claim 1, wherein the motor chamber is divided into a first chamber and a second chamber on opposite axial sides, with the drive motor interposed therebetween, and the inlet passage portion includes:

a first inlet passage that communicates with the first chamber; and a second inlet passage that communicates with the second chamber, wherein the first inlet passage and the second inlet passage communicate with the motor chamber on a same axial line, and wherein the outlet passage is positioned farthest away from the first inlet passage or the second inlet passage in a circumferential direction.

7. The turbo compressor of claim 1, wherein the motor chamber is divided into a first chamber and a second chamber on opposite axial sides, with the drive motor interposed therebetween, and the inlet passage includes:

a first inlet passage that communicates with the first chamber; and a second inlet passage that communicates with the second chamber, wherein the first inlet passage and the second inlet passage communicate with the motor chamber on a same axial line, and wherein an inner diameter of the first inlet passage is larger than or equal to an inner diameter of the second inlet passage.

8. The turbo compressor of claim 1, wherein the motor chamber is divided into a first chamber and a second chamber on opposite axial sides, with the drive motor interposed therebetween, wherein the axial support portion is provided in the first chamber to provide support with respect to the axial direction for the rotary shaft, and the outlet passage communicates with the second chamber, wherein the outlet passage includes:

a first connecting passage having a first end that communicates with the second chamber, and a second end that communicates with the connecting passage;

a second connecting passage having a first end that communicates with the connecting passage, and a second end that communicates with an entrance of the first compression portion; and a refrigerant control valve configured to control a flow of refrigerant passed through the motor chamber to be directed toward the first connecting passage or the second connecting passage.

9. The turbo compressor of claim 8, wherein the refrigerant control valve includes a valve control portion that controls opening/closing directions according to predetermined conditions, and wherein the valve control portion allows the second chamber to communicate with the entrance of the second compression portion under a high-load condition, and allows the second chamber to communicate with an entrance of the first compression portion under a low-load condition.

10. A turbo compressor, comprising:

a housing having a motor chamber;

a drive motor having a stator and a rotor in the motor chamber of the housing;

a first compression portion and a second compression portion, respectively, provided on opposite ends of a rotary shaft;

a connecting passage that connects an exit of the first compression portion and an entrance of the second compression portion;

an inlet passage that penetrates a first side of the housing to communicate with an inside of the motor chamber and guide a refrigeration fluid to the motor chamber; and an outlet passage that penetrates a second side of the housing to communicate with the inside of the motor chamber and guide the refrigeration fluid in the motor chamber out of the housing, wherein an axial support portion is provided in the motor chamber to provide support with respect to an axial direction for the rotary shaft, the axial support portion including:

a thrust runner that radially extends from the rotary shaft;

a first partition wall fixed to the housing and positioned between the thrust runner and the first compression portion; and a second partition wall axially spaced apart from the first partition wall and fixed to the housing, that axially overlaps the thrust runner and is positioned between the thrust runner and the drive motor, wherein a refrigerant intake passage forming the inlet passage is provided in the first partition wall, and an end of the refrigerant intake passage is open to a first side of the first partition wall facing the thrust runner, wherein an axial bearing is provided between a first side of the thrust runner and the first partition wall and between a second side of the thrust runner and the second partition wall, and wherein the end of the refrigerant intake passage is positioned radially closer to the rotary shaft than the axial bearing.

11. The turbo compressor of claim 10, wherein the refrigerant intake passage includes:

a first intake passage open to a second side of the first partition wall, which is one of opposite axial sides thereof and faces the thrust runner; and a second intake passage open to a first side or an inner circumferential surface of the first partition wall, which is one of the opposite axial sides thereof and is the opposite side of the second side.

12. The turbo compressor of claim 10, wherein the motor chamber includes a first chamber provided on a first axial side with respect to the drive motor and a second chamber provided on a second axial side, wherein the axial bearing is provided in the first chamber to provide support with respect to the axial direction for the rotary shaft, and wherein the inlet passage communicates with the first chamber.

13. The turbo compressor of claim 10, wherein the motor chamber includes a first chamber provided on a first axial side with respect to the drive motor and facing the first compression portion and a second chamber provided on a second axial side and facing the second compression portion, wherein the first chamber and the second chamber communicate with each other, and the outlet passage communicates with the second chamber, wherein the inlet passage includes:

a first inlet passage that communicates with the first chamber; and a second inlet passage that communicates with the second chamber, and wherein the axial support portion is provided in the first chamber to provide support with respect to the axial direction for the rotary shaft, and the refrigerant intake passage is formed in the axial support portion to allow the first inlet passage to communicate with the first chamber.

14. The turbo compressor of claim 10, wherein the motor chamber is divided into a first chamber and a second chamber on opposite axial sides, with the drive motor interposed therebetween, wherein the axial support portion is provided in the first chamber to provide support with respect to the axial direction for the rotary shaft, and the outlet passage communicates with the second chamber, and wherein the outlet passage includes:

a first connecting passage having a first end that communicates with the second chamber, and a second end that communicates with the connecting passage;

a second connecting passage having a first end that communicates with the connecting passage, and a second end that communicates with an entrance of the first compression portion; and a refrigerant control valve configured to control a flow of refrigerant passed through the motor chamber to be directed toward the first connecting passage or the second connecting passage.

15. The turbo compressor of claim 14, wherein the refrigerant control valve includes a valve control portion that controls opening/closing directions according to predetermined conditions, wherein the valve control portion allows the second chamber to communicate with the entrance of the second compression portion under a high-load condition, and allows the second chamber to communicate with an entrance of the first compression portion under a low-load condition.

16. A turbo compressor, comprising:

a housing having a motor chamber;

a drive motor having a stator and a rotor in the motor chamber of the housing;

a first compression portion and a second compression portion, respectively, provided on opposite ends of a rotary shaft;

a connecting passage that connects an exit of the first compression portion and an entrance of the second compression portion;

an inlet passage that penetrates a first side of the housing to communicate with an inside of the motor chamber and guide a refrigeration fluid to the motor chamber; and an outlet passage that penetrates a second side of the housing to communicate with the inside of the motor chamber and guide the refrigeration fluid in the motor chamber out of the housing, wherein an axial support portion is provided in the motor chamber to provide support with respect to an axial direction for the rotary shaft, the axial support portion including:

a thrust runner that radially extends from the rotary shaft;

a first bearing shell fixed to the housing and positioned between the thrust runner and the first compression portion; and a second bearing shell axially spaced apart from the first bearing shell and fixed to the housing, that axially overlaps the thrust runner and is positioned between the thrust runner and the drive motor, wherein the first bearing shell includes:

an inner wall portion with a first shaft hole into which a first end of the rotary shaft is rotatably inserted;

a first side wall portion formed in the shape of a ring that radially extends from a first side of an outer circumferential surface of the inner wall portion;

a second side wall portion formed in the shape of a ring that radially extends from a second side of the outer circumferential surface of the inner wall portion; and a refrigerant receiving portion provided between the first side wall portion and the second side wall portion, with an inner peripheral side facing the rotary shaft and being blocked by the inner wall portion, and an outer peripheral side facing an inner circumferential surface of the housing and being at least partially open, wherein the inlet passage radially overlaps the refrigerant receiving portion.

17. The turbo compressor of claim 16, wherein a first radial bearing is provided between the first shaft hole of the inner wall portion and an outer circumferential surface of the rotary shaft, and a refrigerant passage is formed through at least one of the inner wall portion or the first side wall portion to allow the refrigerant receiving portion to communicate with the motor chamber, wherein the refrigerant passage is open toward the motor chamber, in a position axially closer to the first compression portion than the first radial bearing, wherein a first discharge sealing portion is formed on an outer surface of the first side wall portion axially facing the first compression portion, configured to seal a gap between the first compression portion and the first side wall portion, and wherein the refrigerant passage is open so as to communicate with the motor chamber, at a position closer to the rotary shaft than the first discharge sealing portion.

18. The turbo compressor of claim 16, wherein a first radial bearing is provided between the first shaft hole of the inner wall portion and the outer circumferential surface of the rotary shaft, and a refrigerant passage is formed through at least one of the inner wall portion or the first side wall portion to allow the refrigerant receiving portion to communicate with the motor chamber, wherein the refrigerant passage is open toward the motor chamber, in a position axially closer to the first compression portion than the first radial bearing, wherein a plurality of refrigerant passages is formed at predetermined intervals along a radius thereof, and a passage cover is provided on an outer surface of the first side wall portion axially facing the first compression portion, configured to allow open ends of the plurality of refrigerant passages to communicate with each other, wherein a passage connecting groove is formed on a first side of the passage cover facing the first side wall portion and extends radially, configured to allow the plurality of refrigerant passages to communicate with each other, and the passage connecting groove communicates with the first shaft hole of the inner wall portion.

19. The turbo compressor of claim 18, wherein a first discharge sealing portion is formed on a second side of the passage cover facing the first compression portion, configured to seal a gap between the first compression portion and the first side wall portion.

20. The turbo compressor of claim 16, wherein a first axial bearing is provided between the second side wall portion and the thrust runner, and a refrigerant passage is formed through at least one of the inner wall portion or the second side wall portion to allow the refrigerant receiving portion to communicate with the motor chamber, and wherein the refrigerant passage is open, at a position radially closer to an outer circumferential surface of the rotary shaft than the first axial bearing.

21. The turbo compressor of claim 16, wherein a first intake passage penetrates at least one of the inner wall portion or the second side wall portion to allow the refrigerant receiving portion to communicate with the motor chamber, and a second intake passage penetrates at least one of the inner wall portion or the first side wall portion to allow the refrigerant receiving portion to communicate with the motor chamber.

22. The turbo compressor of claim 16, further comprising a second bearing shell fixed to the housing and positioned between the drive motor and the second compression portion, wherein the second bearing shell has a second shaft hole into which a second end of the rotary shaft is rotatably inserted, and a refrigerant passage that penetrates through the second shaft hole on a side of the second bearing shell facing the motor chamber.

23. The turbo compressor of claim 16, wherein the motor chamber includes a first chamber provided on a first axial side with respect to the drive motor and a second chamber provided on a second axial side, wherein the axial bearing is provided in the first chamber to provide support with respect to the axial direction for the rotary shaft, and wherein the inlet passage communicates with the first chamber.

24. The turbo compressor of claim 16, wherein the motor chamber includes a first chamber provided on a first axial side with respect to the drive motor and facing the first compression portion and a second chamber provided on a second axial side and facing the second compression portion, wherein the first chamber and the second chamber communicate with each other, and the outlet passage communicates with the second chamber, and wherein the inlet passage includes:

a first inlet passage that communicates with the first chamber; and a second inlet passage that communicates with the second chamber, and wherein the axial support portion is provided in the first chamber to provide support with respect to the axial direction for the rotary shaft, and the refrigerant intake passage is formed in the axial support portion to allow the first inlet passage to communicate with the first chamber.

25. The turbo compressor of claim 16, wherein the motor chamber is divided into a first chamber and a second chamber on opposite axial sides, with the drive motor interposed therebetween, wherein the axial support portion is provided in the first chamber to provide support with respect to the axial direction for the rotary shaft, and the outlet passage communicates with the second chamber, and wherein the outlet passage includes:

a first connecting passage having a first end that communicates with the second chamber, and a second end that communicates with the connecting passage;

a second connecting passage having a first end that communicates with the connecting passage, and a second end that communicates with an entrance of the first compression portion; and a refrigerant control valve configured to control a flow of refrigerant passed through the motor chamber to be directed toward the first connecting passage or the second connecting passage.

26. The turbo compressor of claim 25, wherein the refrigerant control valve includes a valve control portion that controls opening/closing directions according to predetermined conditions, and wherein the valve control portion allows the second chamber to communicate with the entrance of the second compression portion under a high-load condition, and allows the second chamber to communicate with an entrance of the first compression portion under a low-load condition.

* * * * *